US012075895B1

(12) United States Patent
Lynch et al.

(10) Patent No.: US 12,075,895 B1
(45) Date of Patent: Sep. 3, 2024

(54) PORTABLE ELECTRONIC DEVICE CASE ACCESSORY SYSTEM

(71) Applicant: Pioneer Square Brands, Inc., High Point, NC (US)

(72) Inventors: Riley Edwin Lynch, Greensboro, NC (US); Quentin Wade Forbes, Winston Salem, NC (US)

(73) Assignee: Pioneer Square Brands, Inc., High Point, NC (US)

( * ) Notice: Subject to any disclaimer, the term of this patent is extended or adjusted under 35 U.S.C. 154(b) by 0 days.

(21) Appl. No.: 18/660,031

(22) Filed: May 9, 2024

(51) Int. Cl.
*A45C 11/00* (2006.01)
*A45C 11/38* (2006.01)
*A45F 5/10* (2006.01)

(52) U.S. Cl.
CPC ..... *A45C 11/38* (2013.01); *A45F 5/1026* (2013.01); *A45C 2011/003* (2013.01); *A45F 2005/1033* (2013.01)

(58) Field of Classification Search
CPC . A45C 11/38; A45C 2011/003; A45F 5/1026; A45F 2005/1033; A45F 2200/05; A45F 2200/0508; A45F 2200/0516; A45F 2200/0525; A45F 2200/055
USPC ..... 206/320, 576, 701
See application file for complete search history.

(56) References Cited

U.S. PATENT DOCUMENTS

RE24,067 E * 10/1955 Drogin ..... A45C 13/26 16/114.1
4,794,667 A * 1/1989 Nelson ..... B25G 1/00 294/58
4,844,645 A * 7/1989 Rasmussen ..... H05K 5/0013 403/14
5,048,161 A * 9/1991 Watanabe ..... H01R 13/73 24/669
5,708,707 A * 1/1998 Halttunen ..... H02J 7/0044 379/446
6,017,106 A * 1/2000 Adams ..... G06F 1/1616 361/679.55
7,069,063 B2 * 6/2006 Halkosaari ..... H04M 1/0283 455/575.8
7,612,997 B1 * 11/2009 Diebel ..... H04M 1/0262 361/679.41
8,070,026 B2 * 12/2011 Wadsworth ..... F16M 13/04 224/269

(Continued)

*Primary Examiner* — Jacob K Ackun
(74) *Attorney, Agent, or Firm* — Grandview Law PLLC

(57) ABSTRACT

Systems involve implementations such as (I) an accessory assembly including (A) a first side portion including and an exterior surface portion with at least one first notch portion therein, and (B) a second side portion extending perpendicular with the first side portion; wherein the accessory assembly is removably couplable to the portable electronic device case and is removably couplable to the portable electronic device, wherein the accessory assembly includes at least one electronic function for the portable electronic device, wherein the first side portion of the accessory assembly remains unobstructed when the accessory assembly is coupled with the portable electronic device case, and wherein the first side portion of the accessory assembly remains unobstructed when the accessory assembly is coupled with the portable electronic device. Other aspects are described in the claims, drawings, and text forming a part of the present disclosure.

20 Claims, 93 Drawing Sheets

(56) References Cited

U.S. PATENT DOCUMENTS

| | | | | |
|---|---|---|---|---|
| 8,167,127 | B2 * | 5/2012 | Martin | G11B 31/00 206/320 |
| 9,185,953 | B2 * | 11/2015 | Whitten | B62J 11/00 |
| 9,319,501 | B2 * | 4/2016 | Huang | H04M 1/0283 |
| 9,356,267 | B1 * | 5/2016 | To | H01M 50/24 |
| 9,388,939 | B2 * | 7/2016 | Girault | F21V 33/0052 |
| 9,551,915 | B2 * | 1/2017 | Clearman | F16M 11/041 |
| 11,240,359 | B2 * | 2/2022 | Wilson | A45F 5/00 |
| RE49,702 | E * | 10/2023 | Barnett | F16M 11/10 455/575.8 |
| 11,839,290 | B1 | 12/2023 | Lynch | |
| 11,857,044 | B1 | 1/2024 | Lynch | |
| 11,930,604 | B1 | 3/2024 | Lynch et al. | |
| 2008/0053851 | A1 * | 3/2008 | Ko | A45C 11/00 206/320 |
| 2011/0299231 | A1 * | 12/2011 | Gaddis, II | H05K 5/023 361/679.01 |
| 2012/0309475 | A1 * | 12/2012 | Johnson | H04M 1/17 455/575.8 |
| 2014/0099526 | A1 * | 4/2014 | Powell | G06K 7/10881 429/100 |
| 2015/0008687 | A1 * | 1/2015 | Lindsey | H04B 1/385 294/137 |
| 2016/0134142 | A1 * | 5/2016 | Murphy | H02J 7/0044 455/573 |
| 2019/0269212 | A1 * | 9/2019 | Swart | A45C 11/182 |
| 2020/0076937 | A1 * | 3/2020 | Ackerman | H04B 1/3888 |
| 2022/0191670 | A1 * | 6/2022 | Kutscher | H04W 4/90 |

* cited by examiner

PORTABLE ELECTRONIC DEVICE CASE ACCESSORY SYSTEM

SUMMARY

In one or more aspects a system for a portable electronic device and a portable electronic device case includes (I) an accessory assembly including (A) a first side portion including and an exterior surface portion with at least one first notch portion therein, and (B) a second side portion extending perpendicular with the first side portion; wherein the accessory assembly is removably couplable to the portable electronic device case and is removably couplable to the portable electronic device, wherein the accessory assembly includes at least one electronic function for the portable electronic device, wherein the first side portion of the accessory assembly remains unobstructed when the accessory assembly is coupled with the portable electronic device case, and wherein the first side portion of the accessory assembly remains unobstructed when the accessory assembly is coupled with the portable electronic device. Wherein the at least one first notch portion is positioned adjacent to an edge of the first side portion shared by the second side portion. Wherein the accessory assembly includes a third side portion extending perpendicularly to the first side portion and the second side portion, wherein the accessory assembly includes at least one second notch portion, and wherein the at least one second notch portion is positioned adjacent to an edge of the first side portion shared by the third side portion. Wherein the accessory assembly includes a fourth side portion extending perpendicularly to the first side portion and the third side portion, wherein the accessory assembly includes at least one third notch portion, and wherein the at least one third notch portion is positioned adjacent to an edge of the first side portion shared by the fourth side portion. Further including a cover assembly, wherein the cover assembly is removably couplable with the first side portion of the accessory assembly. Wherein the cover assembly includes at least one protrusion removably couplable with the at least one first notch portion the accessory assembly. Further including an adapter assembly, wherein the adapter assembly is removably couplable with the first side portion of the accessory assembly, and wherein the adapter assembly is removably couplable with at least one third assembly. Wherein the adapter assembly includes at least one protrusion removably couplable with the at least one first notch portion of the accessory assembly. Wherein the at least one third assembly is at least one electronic payment card reader.

In one or more aspects a portable electronic device and a portable electronic device case includes (I) an accessory assembly including (A) a first side portion including an exterior surface portion; and (II) a second assembly including at least one exterior surface portion removably couplable with the exterior surface portion of the accessory assembly, wherein the accessory assembly is removably couplable to the portable electronic device case and is removably couplable to the portable electronic device, wherein the accessory assembly includes at least one electronic function for the portable electronic device, wherein the first side portion of the accessory assembly remains unobstructed when the accessory assembly is coupled with the portable electronic device case, and wherein the first side portion of the accessory assembly remains unobstructed when the accessory assembly is coupled with the portable electronic device. Wherein the exterior surface portion of the first side portion of the accessory assembly includes at least one first notch portion therein, wherein the accessory assembly includes a second side portion extending perpendicularly to the first side portion, and wherein the at least one first notch portion is positioned adjacent to an edge of the first side portion shared by the second side portion. Wherein the second assembly includes at least one first protrusion removably couplable with the at least one first notch portion of the accessory assembly. Wherein the second assembly is a cover assembly. Wherein the second assembly is an adapter assembly removably couplable with at least one electronic payment card reader assembly.

In one or more aspects a system for a portable electronic computing device includes (I) an accessory assembly including (A) a first side portion including and an exterior surface portion with at least one notch portion therein, and (B) a second side portion extending perpendicular with the first side portion; and (II) a portable electronic device case assembly including (A) a coupler assembly; wherein the accessory assembly includes at least one electronic function for the portable electronic device, wherein the accessory assembly is removably couplable with the coupler assembly of the portable electronic device case, and wherein the first side portion of the accessory assembly remains unobstructed when the accessory assembly is coupled with the portable electronic device case. Further including a third assembly removably couplable with the accessory assembly. Wherein the third assembly is removably couplable with the at least one notch portion of the accessory assembly. Wherein the third assembly is a cover assembly. Wherein the third assembly is an adapter assembly removably couplable with a fourth assembly. Wherein the fourth assembly is at least one electronic payment card reader assembly.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Portable Electronic Device Case Accessory System, articles of manufacture, compositions of matter for same that may provide context, for instance, in introducing one or more processes and/or devices described herein.

DETAILED DESCRIPTION

Figure 1:
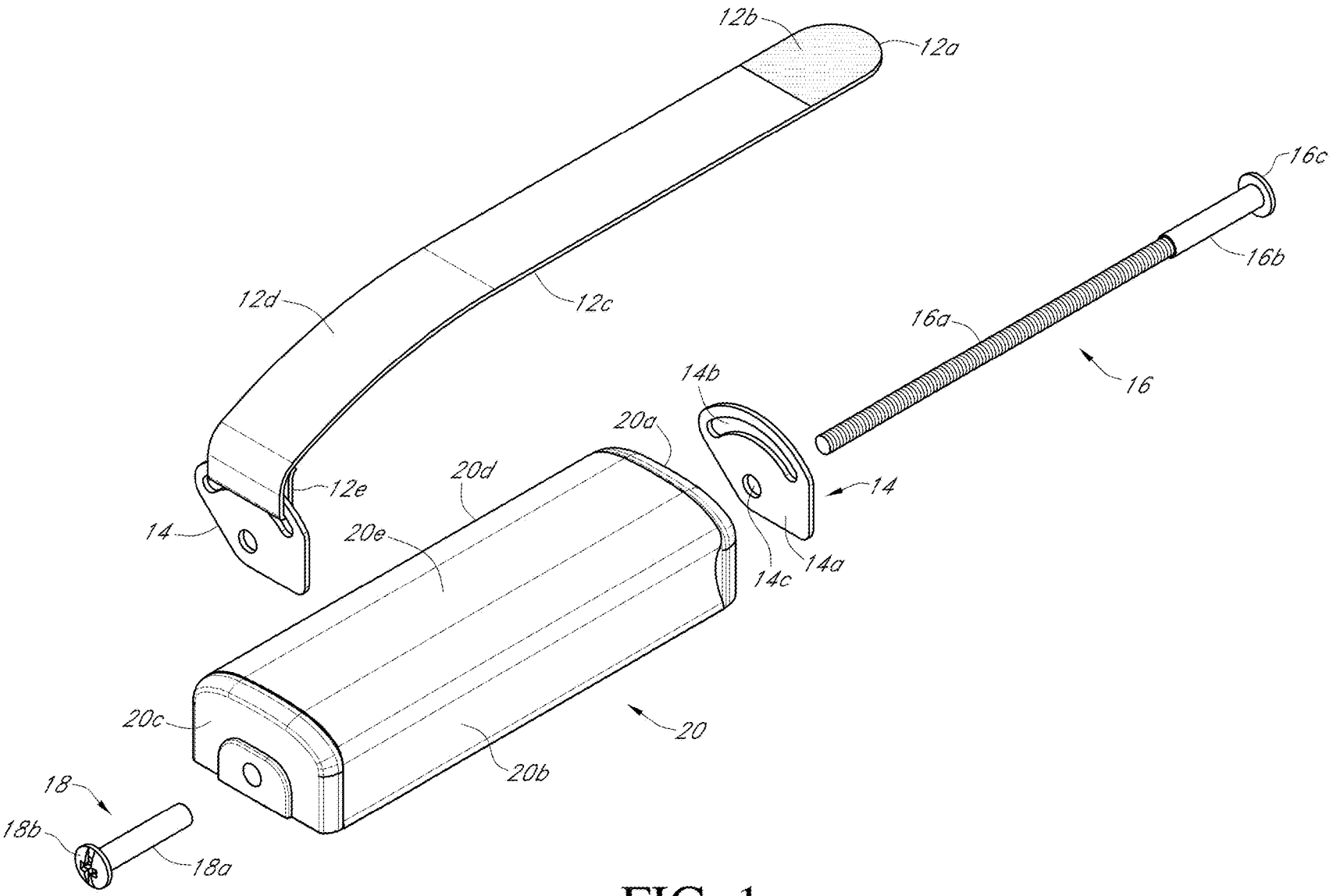
FIG. 1 is an exploded perspective view of a handle assembly.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is an exploded perspective view of handle assembly 10. Depicted implementation of handle assembly 10 is shown to include elongated strap assembly 12, bracket assembly 14, pin member 16, pin member 18, and bar member 20.

Depicted implementation of elongated strap assembly 12 is shown to include tip end portion 12*a*, first material portion 12*b*, second material portion 12*c*, edge portion 12*d*, and stitched end portion 12*e*. In implementations first material portion 12*b* and second material portion 12*c* are made from hook and loop material couplable with each other, respectively, or loop and hook material couplable with each other, respectively.

Depicted implementation of bracket assembly 14 is shown to include main portion 14*a*, curvilinear slot 14*b*, and aperture 14*c*. Depicted implementation of pin member 16 is shown to include rod portion 16*a*, collar portion 16*b*, and head portion 16*c*.

Depicted implementation of pin member 18 is shown to include rod portion 18*a*, and head portion 18*b*. In implementations pin member 16 is couplable with pin member 18. In implementations aperture 14*c* of bracket assembly 14 is shaped and sized to receive pin member 16 and pin member 18.

Depicted implementation of bar member 20 is shown to include end portion 20*a*, elongated side portion 20*b*, end portion 20*c*, elongated side portion 20*d*, and elongated top portion 20*e*. In implementations end portion 20*a* and end portion 20*c* can be positioned at least two inches from one another. In implementations elongated side portion 20*b* and elongated side portion 20*d* can be positioned at least one inch from one another.

Figure 2:
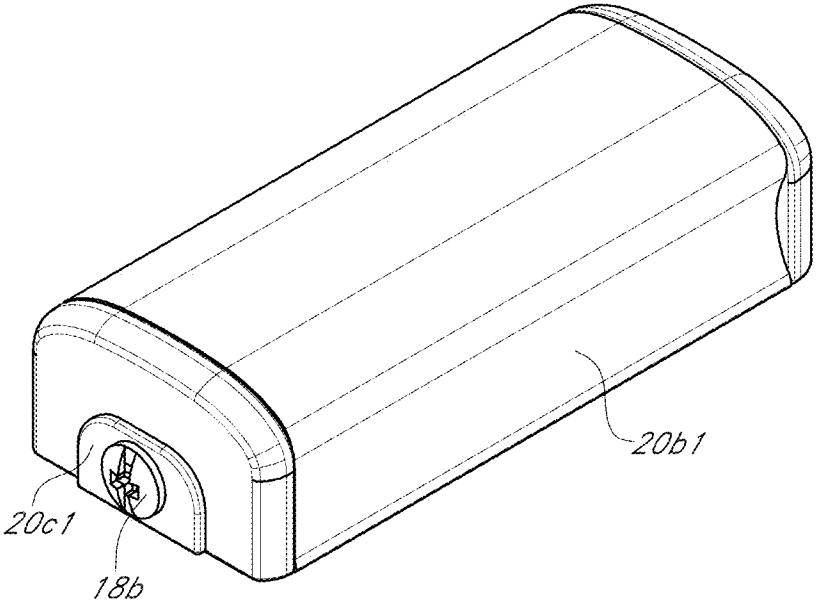
FIG. 2 is a top-perspective view of a handle member of the handle assembly of FIG. 1.

Turning to FIG. 2, depicted therein is a top-perspective view of bar member 20 of handle assembly 10. Depicted implementation of bar member 20 is shown to include elongated groove portion 20*b*1, and raised portion 20*c*1.

Figure 3:
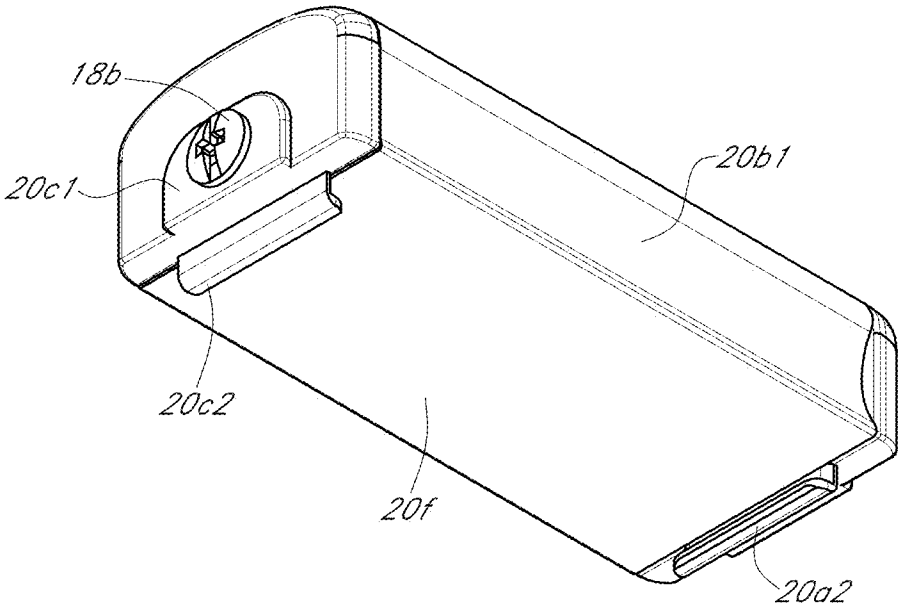
FIG. 3 is a bottom-perspective view of the handle member of FIG. 2.

Turning to FIG. 3, depicted therein is a bottom-perspective view of bar member 20. Depicted implementation of bar member 20 is shown to include clip portion 20*a*2, clip portion 20*c*2, and elongated bottom portion 20*f*. As shown, elongated side portion 20*b*, and elongated side portion 20*d* extend between elongated top portion 20*e* and elongated bottom portion 20*f*. As shown, clip portion 20*a*2 and clip portion 20*c*2 extend away from elongated bottom portion 20*f*.

Figure 4:
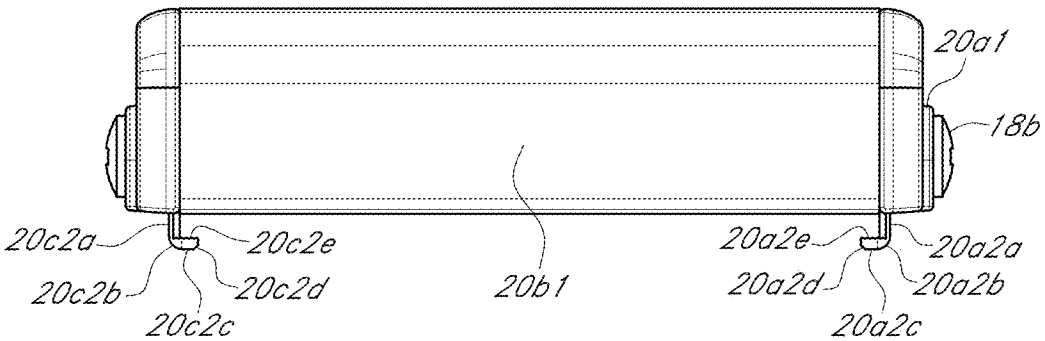
FIG. 4 is a side-elevational view of the handle member of FIG. 2.

Turning to FIG. 4, depicted therein is a side-elevational view of bar member 20. Depicted implementation of bar member 20 is shown to include raised portion 20*a*1, and clip portion 20*a*2 includes leg portion 20*a*2*a*, corner 20*a*2*b*, lower surface 20*a*2*c*, and tapered portion 20*a*2*d*, and inner portion 20*a*2*e* that are shown to be in an L-shape. Depicted implementation of clip portion 20*c*2 of bar member 20 is shown to include leg portion 20*c*2*a*, corner 20*c*2*b*, lower surface 20*c*2*c*, tapered portion 20*c*2*d*, and inner portion 20*c*2*e*.

Figure 5:
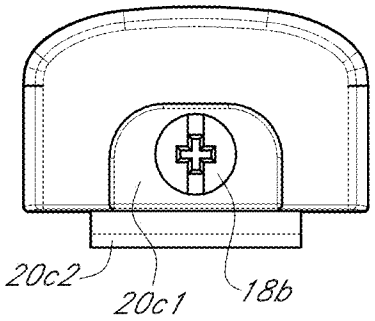
FIG. 5 is an end-elevational view of the handle member of FIG. 2.

Turning to FIG. 5, depicted therein is an end-elevational view of bar member 20.

Figure 6:
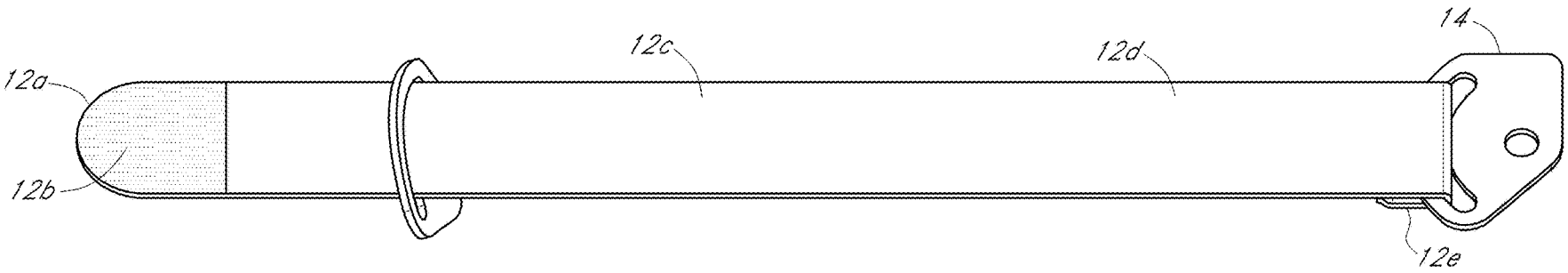
FIG. 6 is a perspective view of a portion of the strap assembly being coupled with a bracket assembly of the handle assembly of FIG. 1.

Turning to FIG. 6, depicted therein is a perspective view of a portion of elongated strap assembly 12 coupled with bracket assembly 14.

Figure 7:
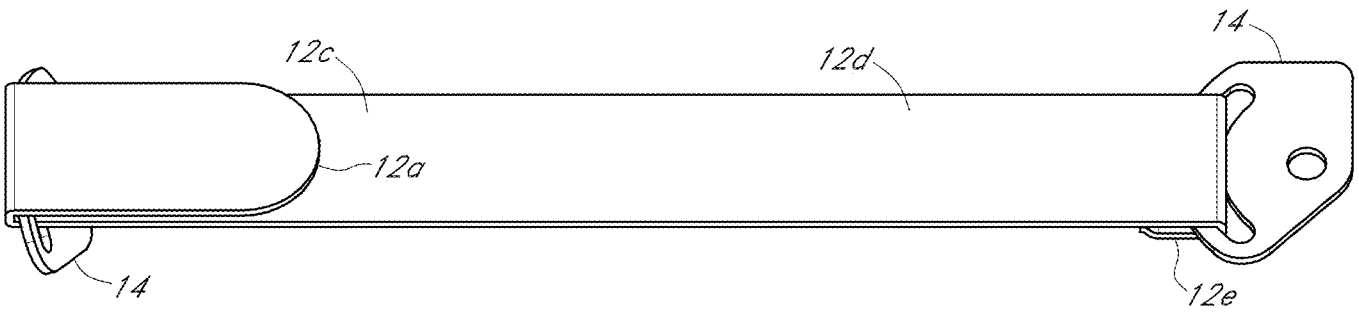
FIG. 7 is a plan view of a portion of the strap assembly of FIG. 6 coupled with the bracket assembly of FIG. 6.

Turning to FIG. 7, depicted therein is a plan view of a portion of elongated strap assembly 12 coupled with bracket assembly 14.

Figure 8:
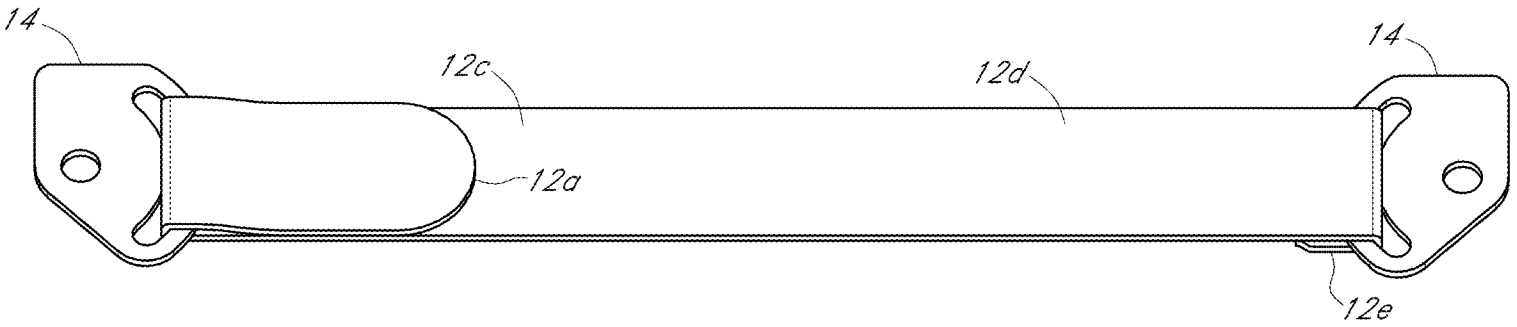
FIG. 8 is a plan view of the strap assembly coupled with the bracket assembly of FIG. 6.

Turning to FIG. 8, depicted therein is a plan view of elongated strap assembly 12 coupled with bracket assembly 14.

Figure 9:
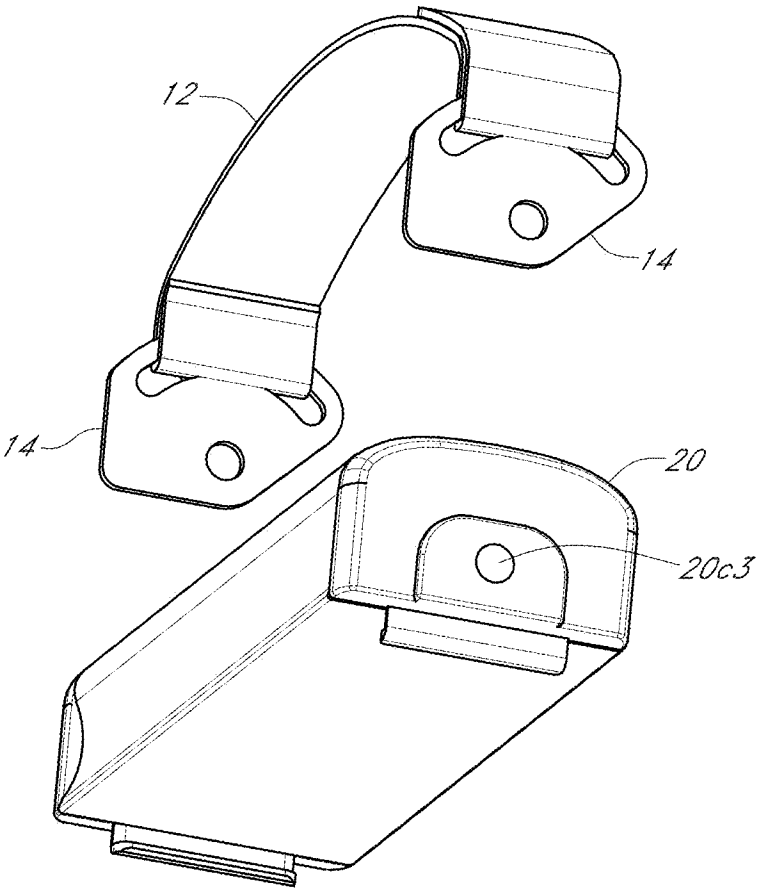
FIG. 9 is a perspective view of portions of the handle member of FIG. 2 and the strap assembly coupled with the bracket assembly of FIG. 6.

Turning to FIG. 9, depicted therein is a perspective view of portions of bar member 20 and elongated strap assembly 12 coupled with bracket assembly 14. Depicted implementation of bar member 20 is shown to include aperture 20*c*3.

Figure 10:
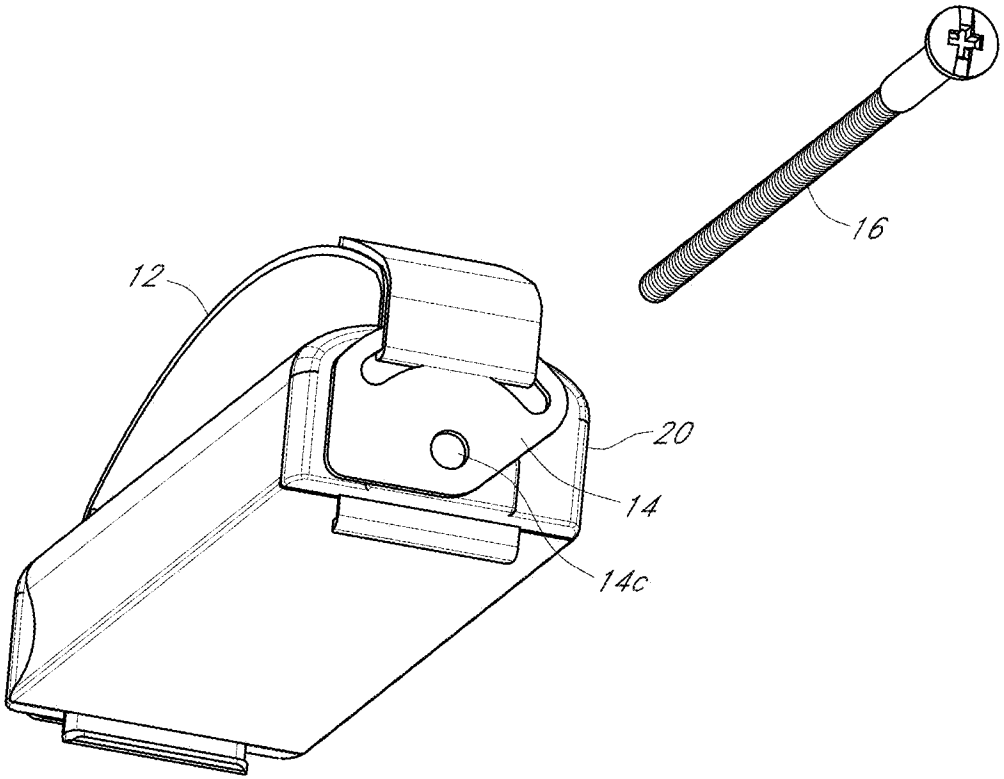
FIG. 10 is a perspective view of portions of the handle member of FIG. 2, the strap assembly coupled with the bracket assembly of FIG. 6, and a pin member of FIG. 1.

Turning to FIG. 10, depicted therein is a perspective view of portions of bar member 20, elongated strap assembly 12 coupled with bracket assembly 14, and pin member 16.

Figure 11:
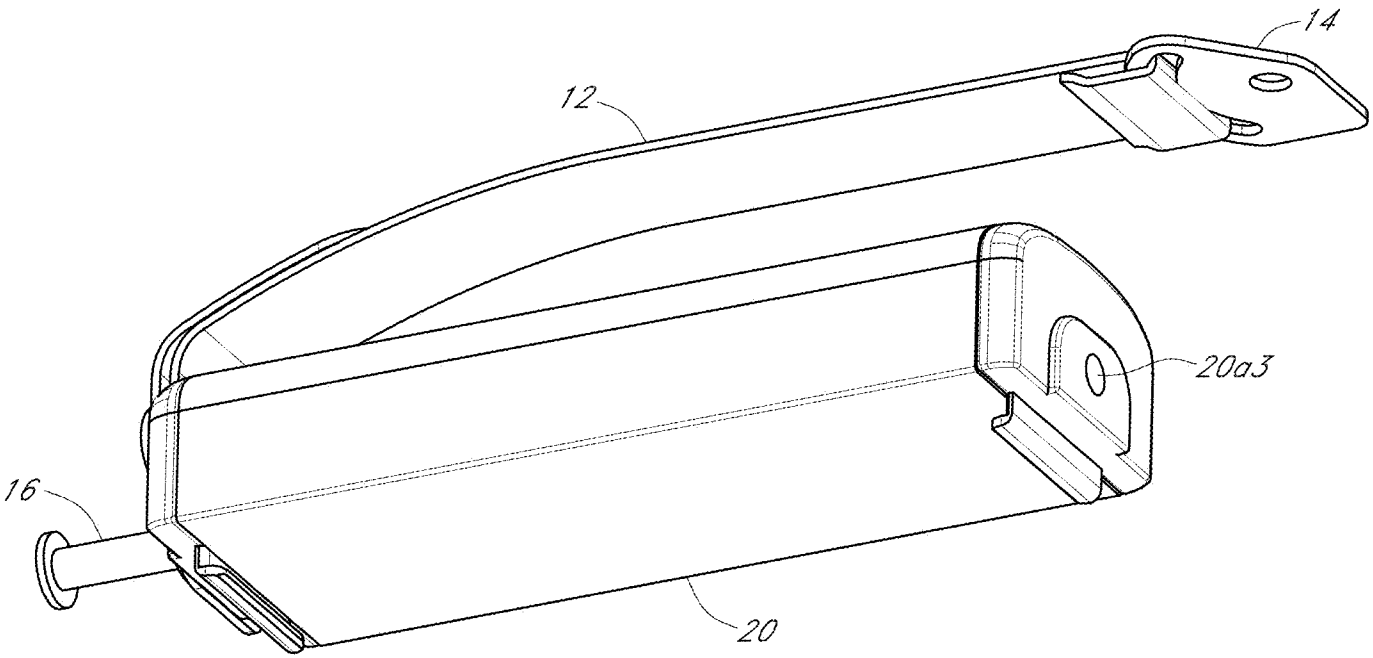
FIG. 11 is a perspective view of portions of the handle member of FIG. 2, the strap assembly coupled with the bracket assembly of FIG. 6, and the pin member of FIG. 1.

Turning to FIG. 11, depicted therein is a perspective view of portions of bar member 20, elongated strap assembly 12 coupled with bracket assembly 14, and pin member 16. Depicted implementation of bar member 20 is shown to include aperture 20*a*3.

Figure 12:
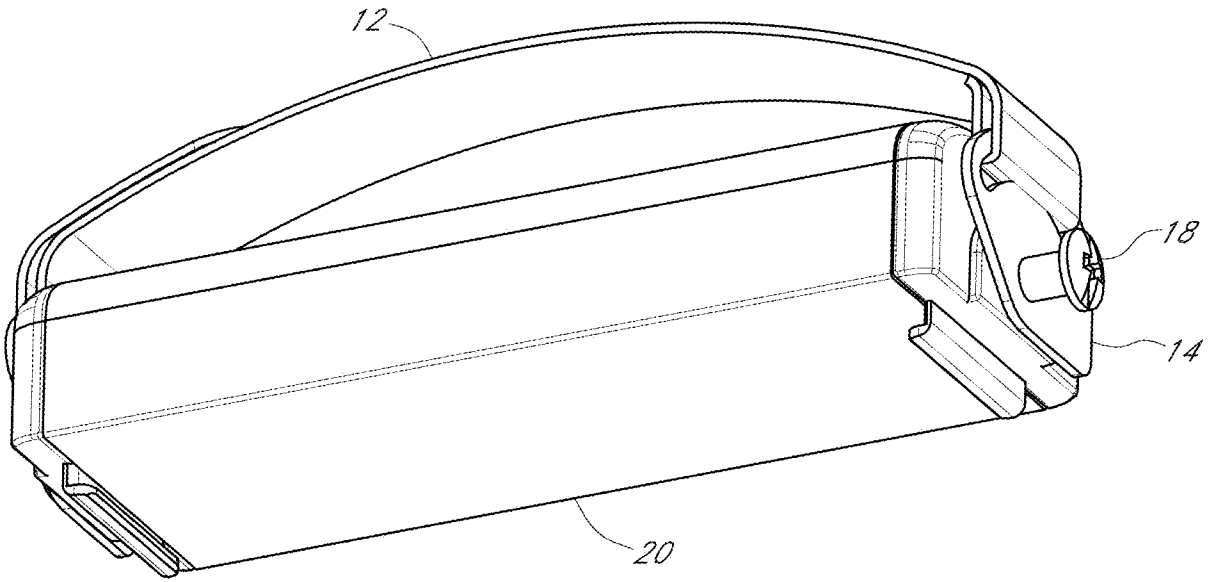
FIG. 12 is a side-perspective view of portions of the handle member of FIG. 2, the strap assembly coupled with the bracket assembly of FIG. 6, and the pin member of FIG. 1.

Turning to FIG. 12, depicted therein is a side-perspective view of portions of bar member 20, elongated strap assembly 12 coupled with bracket assembly 14, and pin member 16.

Figure 13:
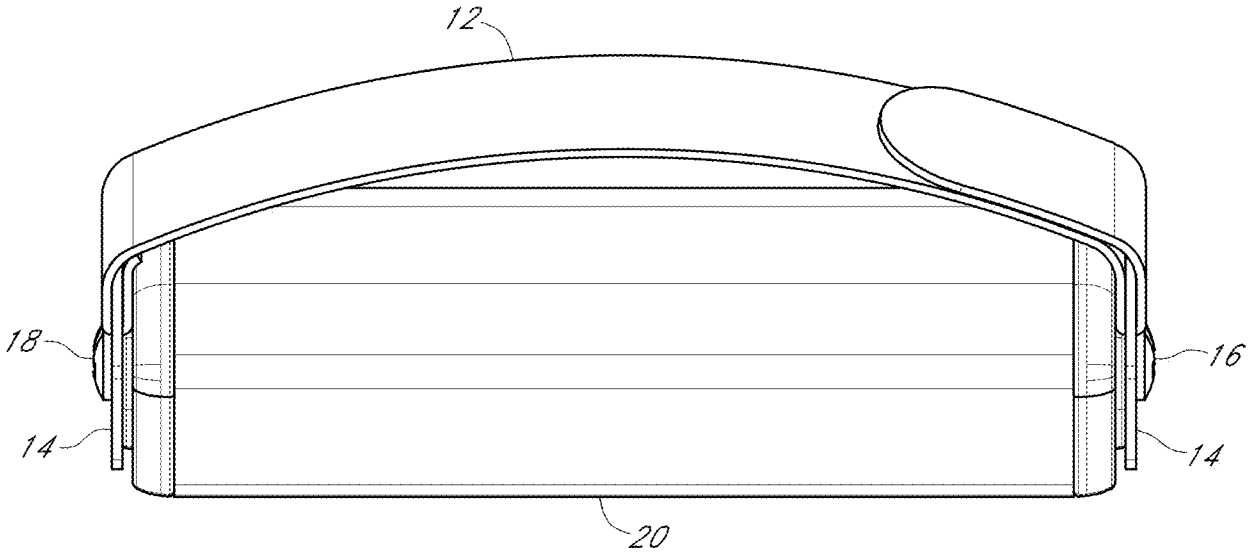
FIG. 13 is a top-perspective view of portions of the handle member of FIG. 2, the strap assembly coupled with the bracket assembly of FIG. 6, and the pin member of FIG. 1.

Turning to FIG. 13, depicted therein is a top-perspective view of portions of bar member 20, elongated strap assembly 12 coupled with bracket assembly 14, and pin member 16.

Figure 14:
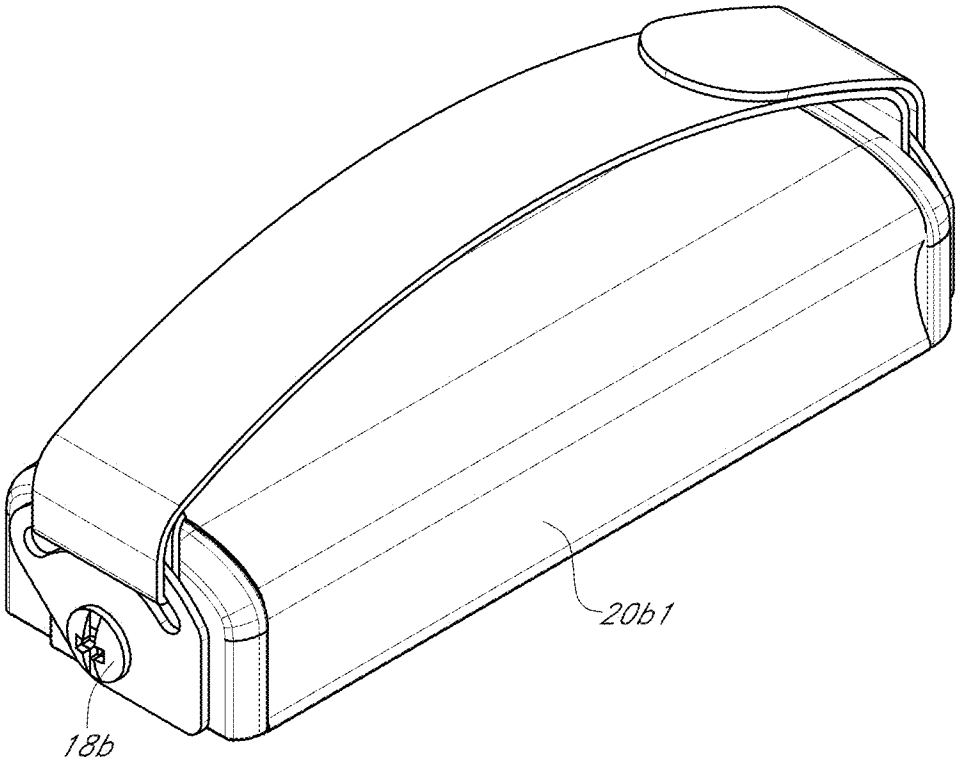
FIG. 14 is a top-perspective view of the handle assembly of FIG. 1.

Turning to FIG. 14, depicted therein is a top-perspective view of handle assembly 10.

Figure 15:
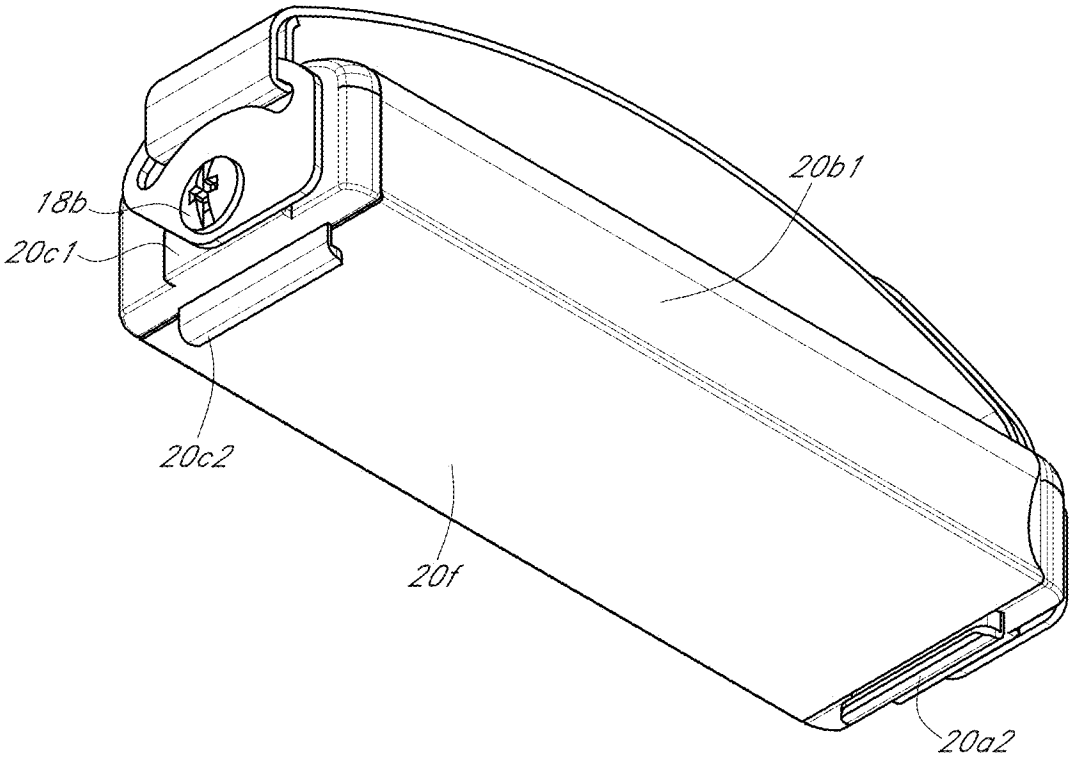
FIG. 15 is a bottom-perspective view of the handle assembly of FIG. 1.

Turning to FIG. 15, depicted therein is a bottom-perspective view of handle assembly 10.

Figure 16:
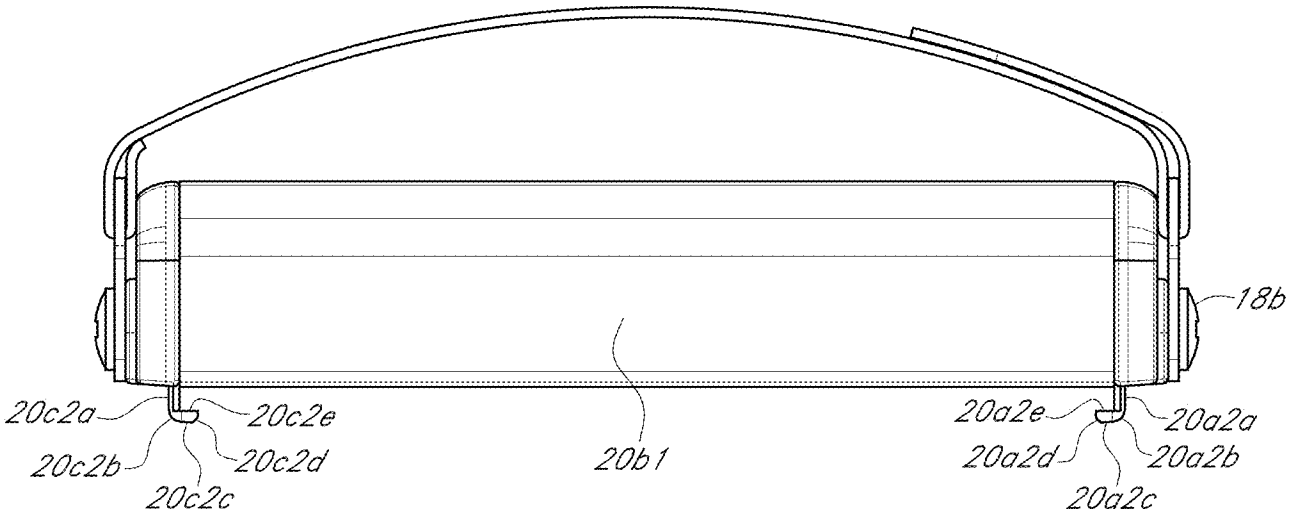
FIG. 16 is a side-elevational view of the handle assembly of FIG. 1.

Turning to FIG. 16, depicted therein is a side-elevational view of handle assembly 10.

Figure 17:
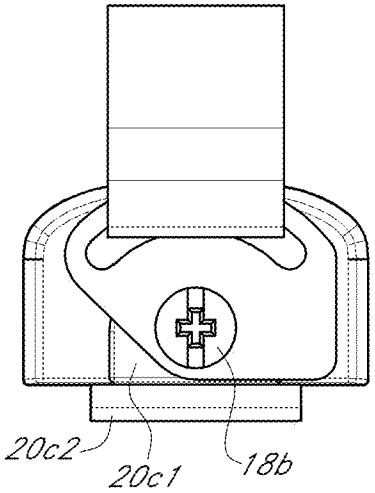
FIG. 17 is a end-elevational view of the handle assembly of FIG. 1.

Turning to FIG. 17, depicted therein is a end-elevational view of handle assembly 10.

Figure 18:
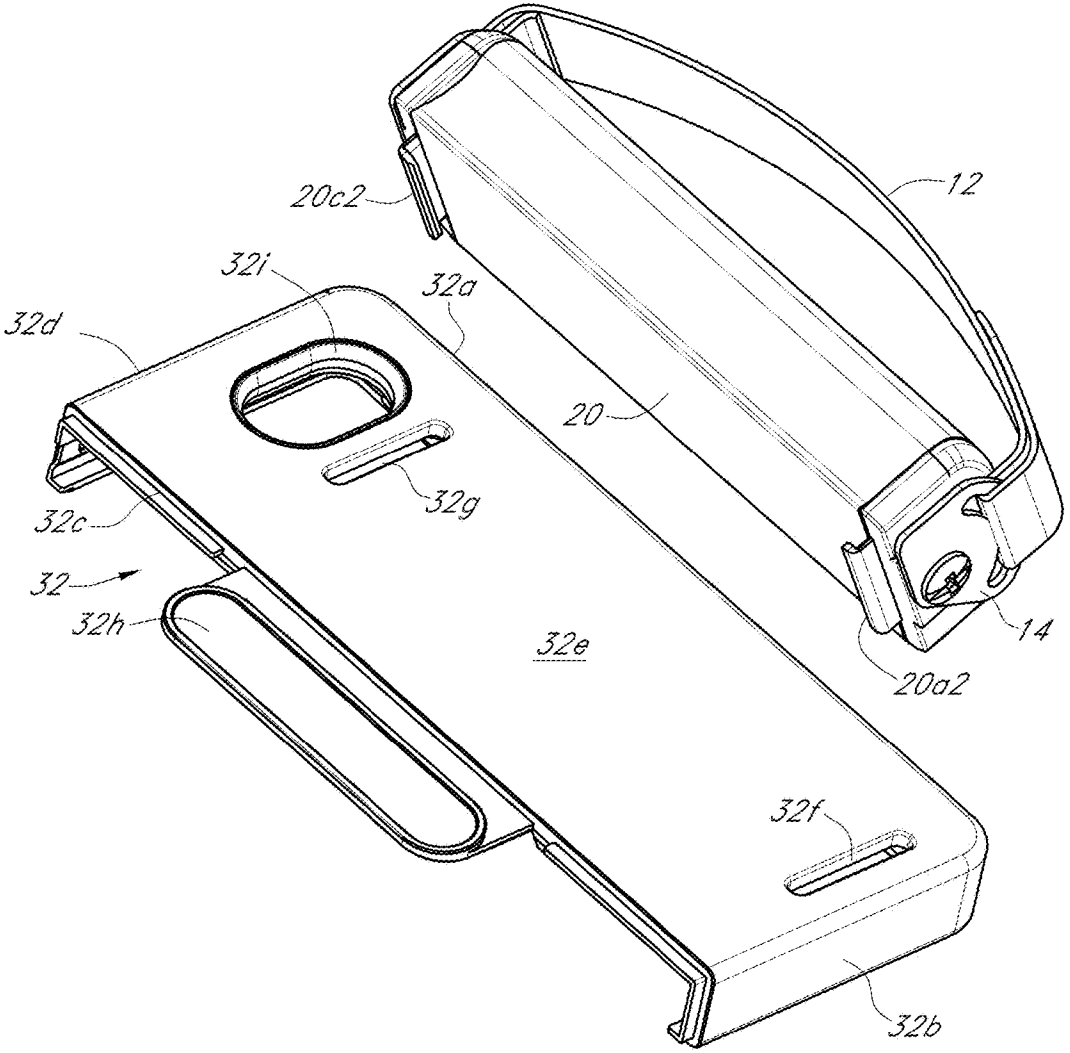
FIG. 18 is a perspective view of a cap assembly and the handle assembly of FIG. 1.

Turning to FIG. 18, depicted therein is a perspective view of cap assembly 32 and handle assembly 10. Depicted implementation of cap assembly 32 is shown to include side wall 32*a*, side wall 32*b*, side edge 32*c*, side wall 32*d*, base 32*e*, elongated aperture 32*f* (shaped, sized, and positioned to couple with clip portion 20*c*2), elongated aperture 32*g* (shaped, sized, and positioned to couple with clip portion 20*a*2), tab member 32*h*, and lens portion 32*i*. As depicted, tab member 32*h* extends away from side edge 32*c* and extends away from side wall 32*a* as well.

Figure 19:
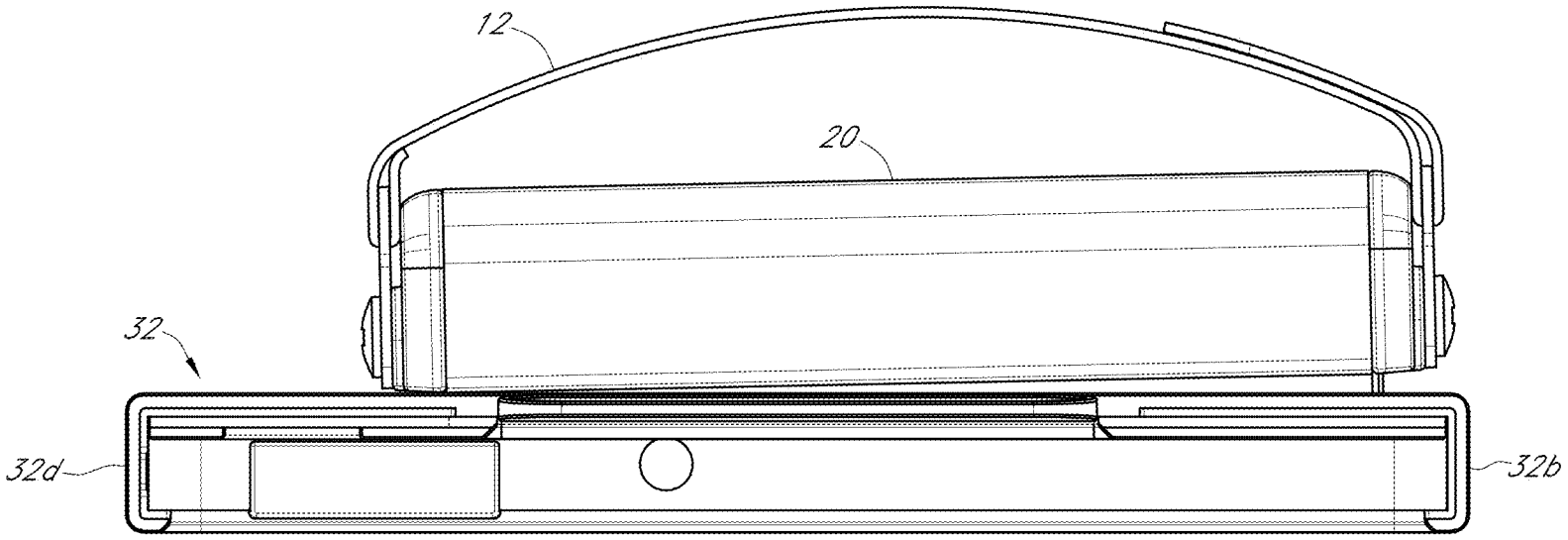
FIG. 19 is a perspective view of the cap assembly of FIG. 18 and the handle assembly of FIG. 1.

Turning to FIG. 19, depicted therein is a perspective view of cap assembly 32 and the handle assembly of FIG. 1.

Figure 20:
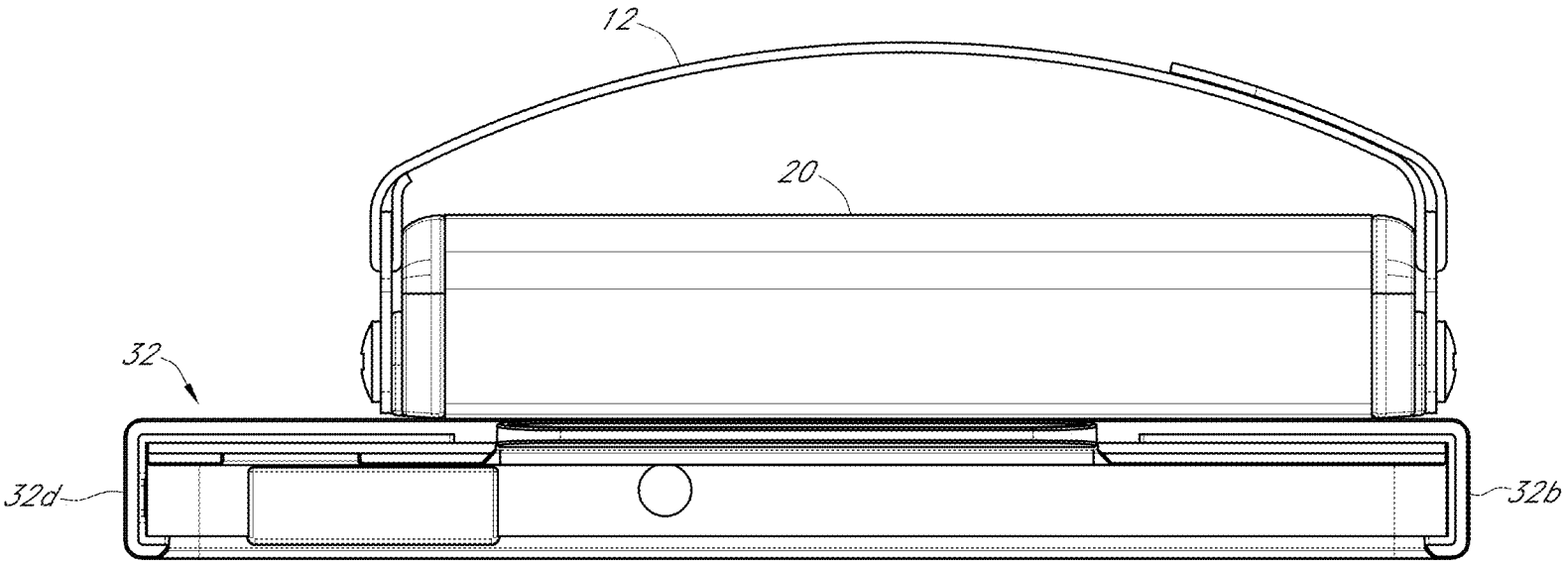
FIG. 20 is a perspective view of the cap assembly of FIG. 18 and the handle assembly of FIG. 1 coupled together.

Turning to FIG. 20, depicted therein is a perspective view of bar member 20 and the handle assembly 10 coupled together. In implementations, wherein elongated top portion 20 is positioned at least one half inch from the cap assembly 32 when bar member 20 is coupled with the device case assembly.

Figure 21:
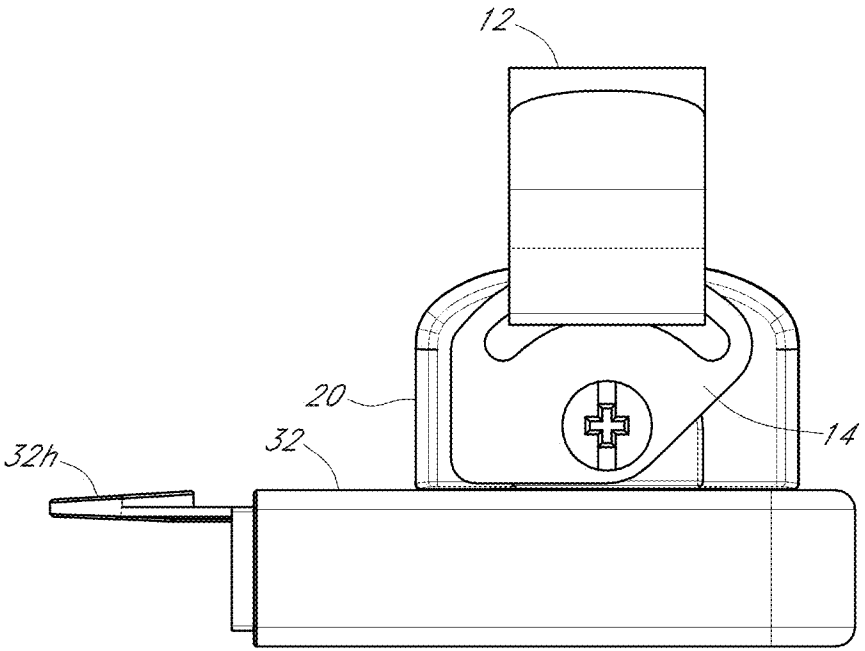
FIG. 21 is an end view of the cap assembly of FIG. 18 and the handle assembly of FIG. 1 coupled together.

Turning to FIG. 21, depicted therein is an end view of cap assembly 32 and handle assembly 10.

Figure 22:
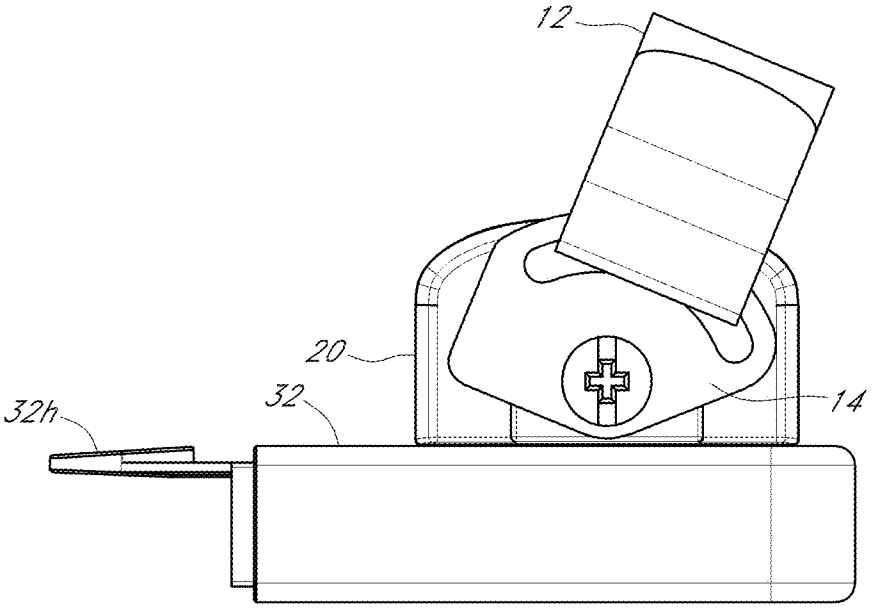
FIG. 22 is an end view of the cap assembly of FIG. 18 and the handle assembly of FIG. 1 coupled together.

Turning to FIG. 22, depicted therein is an end view of cap assembly 32 and handle assembly 10 coupled together.

Figure 23:
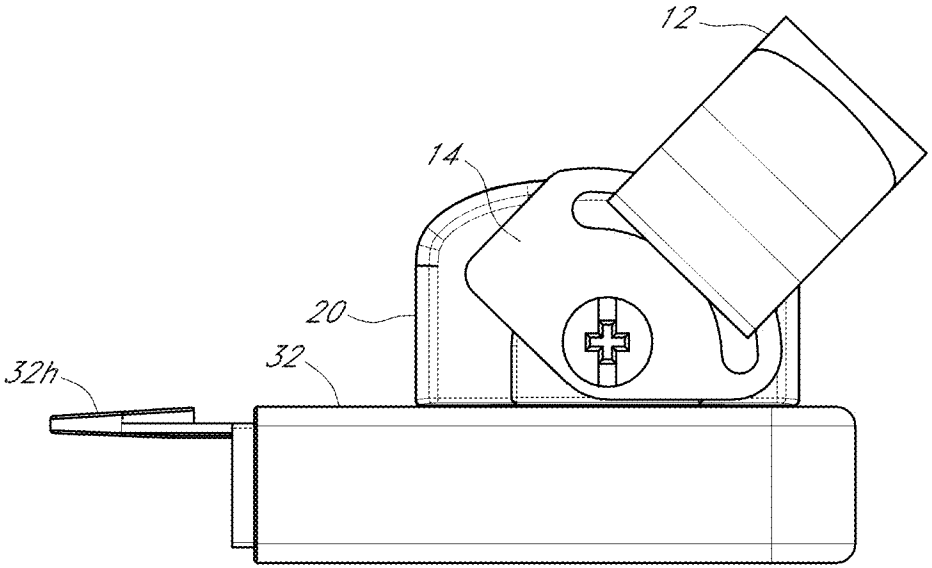
FIG. 23 is an end view of the cap assembly of FIG. 18 and the handle assembly of FIG. 1 coupled together.

Turning to FIG. 23, depicted therein is an end view of cap assembly 32 and handle assembly 10 coupled together.

Figure 24:
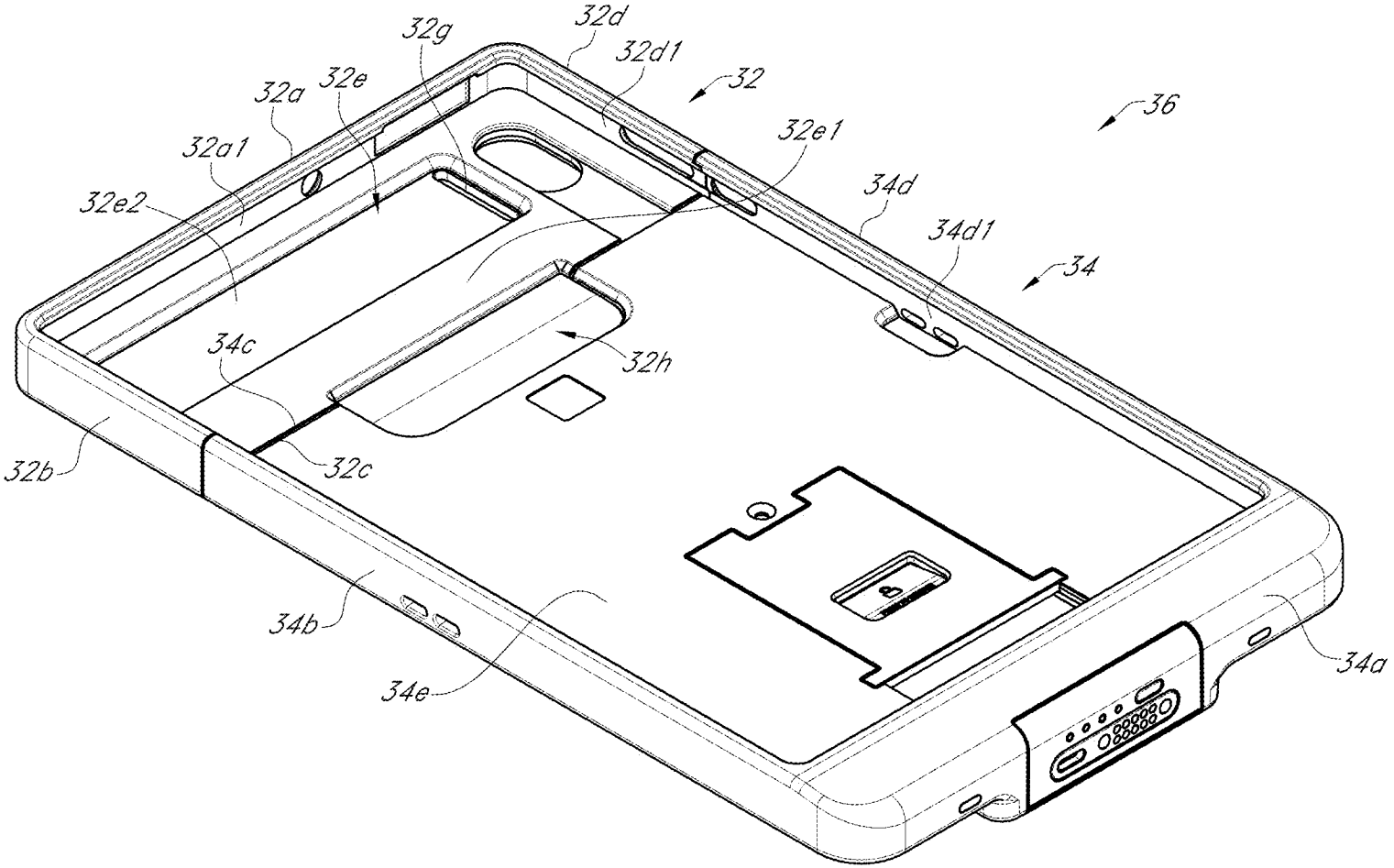
FIG. 24 is a rear-top-perspective view of the cap assembly of FIG. 18 and a main assembly coupled together to form a case assembly.

Turning to FIG. 24, depicted therein is a rear top perspective view of cap assembly 32 and main assembly 34 coupled together to form device case assembly 30.

Depicted implementation of cap assembly 32 is shown to include elongated groove 32*d*1, raised portion 32*e*1, and recessed portion 32*e*2. As depicted, side wall 32*b* and side wall 32*d* extend perpendicular with respect to side wall 32*a*. As depicted, side edge 32*c* extends parallel with respect to side wall 32*a*. As depicted, side edge 32*c* is spaced from side wall 32*a* along side wall 32*b* and side wall 32*d*.

Depicted implementation of main assembly 34 is shown to include side wall 34*a*, side wall 34*b*, side edge 34*c*, side wall 34*d*, groove 34*d*1, and base 34*e*. As depicted, side wall 34*b* and side wall 34*d* extend perpendicular with respect to side wall 34*a*. As depicted, side edge 34*c* extends parallel with respect to side wall 34*a*. As depicted, when cap assembly 32, and cap assembly 32, are coupled together, side wall 32*a*, side wall 32*b*, side wall 32*d*, and base 32*e* of cap assembly 32, and side wall 34*a*, side wall 34*b*, side wall 32*d*, and base 34*e* of main assembly 34 form an interior area to couple with portable electronic device 100 (shown in FIG. 30).

Figure 25:
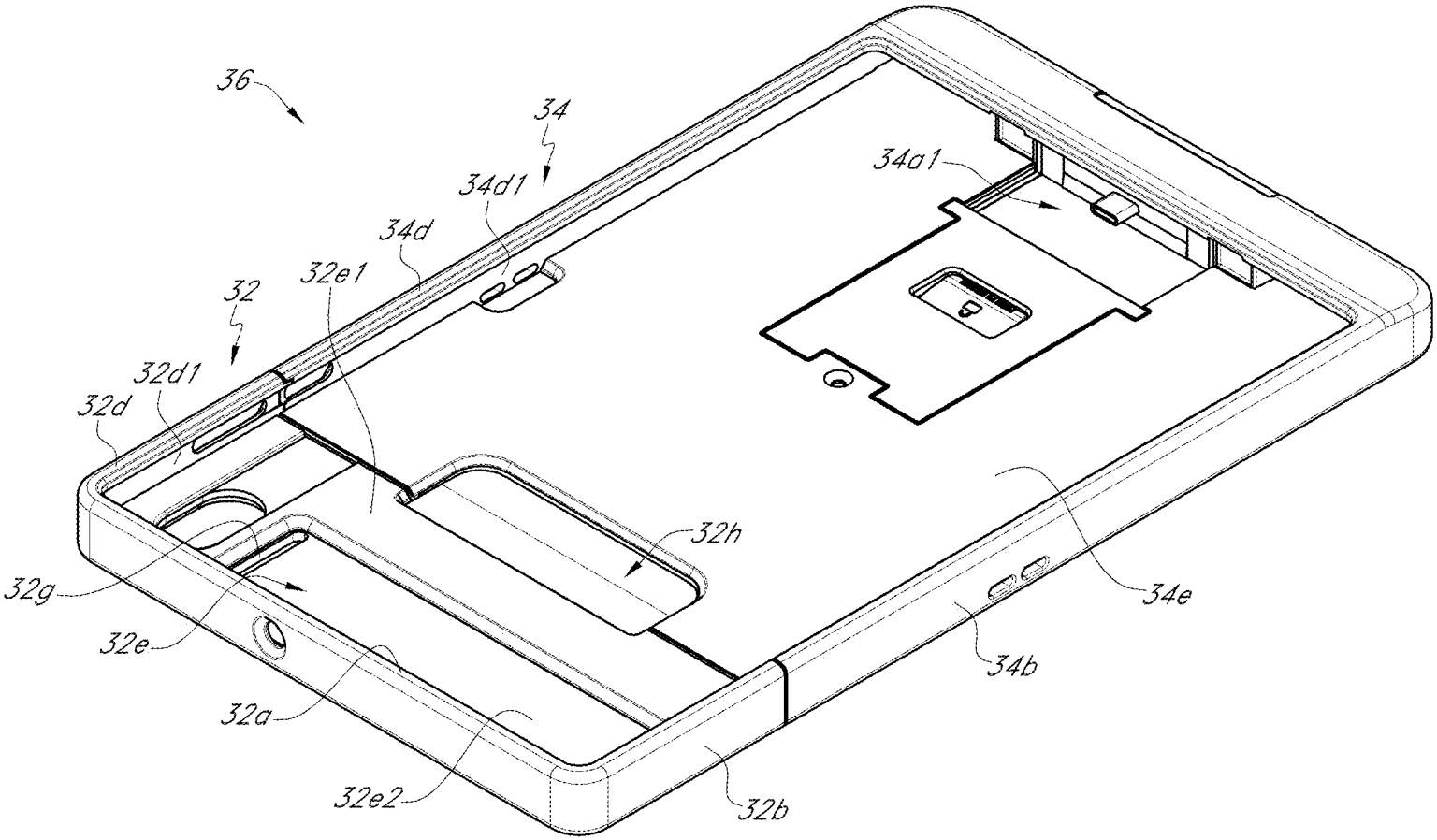
FIG. 25 is a front-top-perspective view of the case assembly of FIG. 24.

Turning to FIG. 25, depicted therein is a front-top-perspective view of device case assembly 30. Depicted implementation of main assembly 34 is shown to include portable electric interface 34*a*1.

Figure 26:
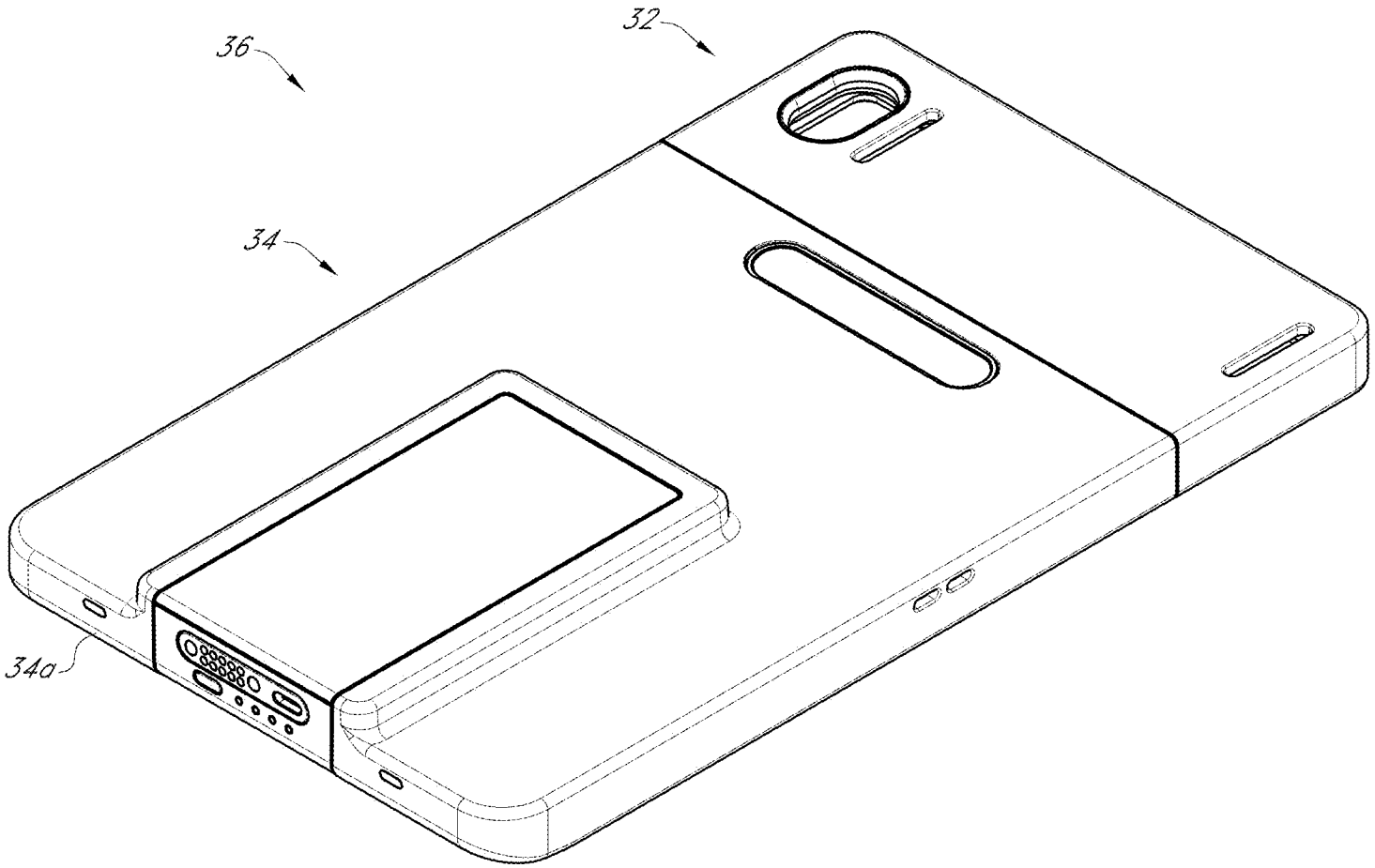
FIG. 26 is a rear-bottom-perspective view of the case assembly of FIG. 24.

Turning to FIG. 26, depicted therein is a rear-bottom-perspective view of device case assembly 30.

Figure 27:
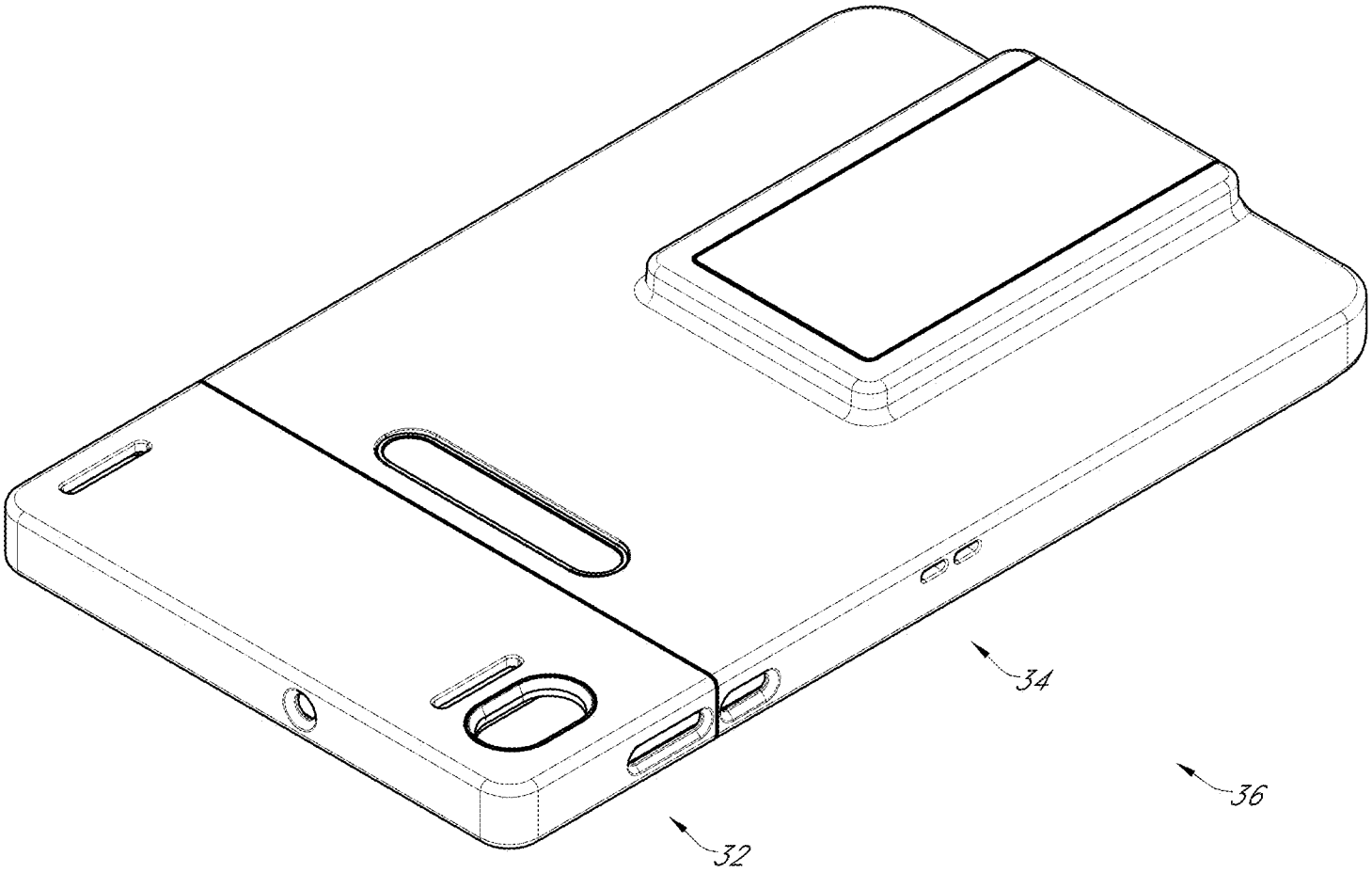
FIG. 27 is a front-bottom-perspective view of the case assembly of FIG. 24.

Turning to FIG. 27, depicted therein is a front-bottom-perspective view of device case assembly 30.

Figure 28:
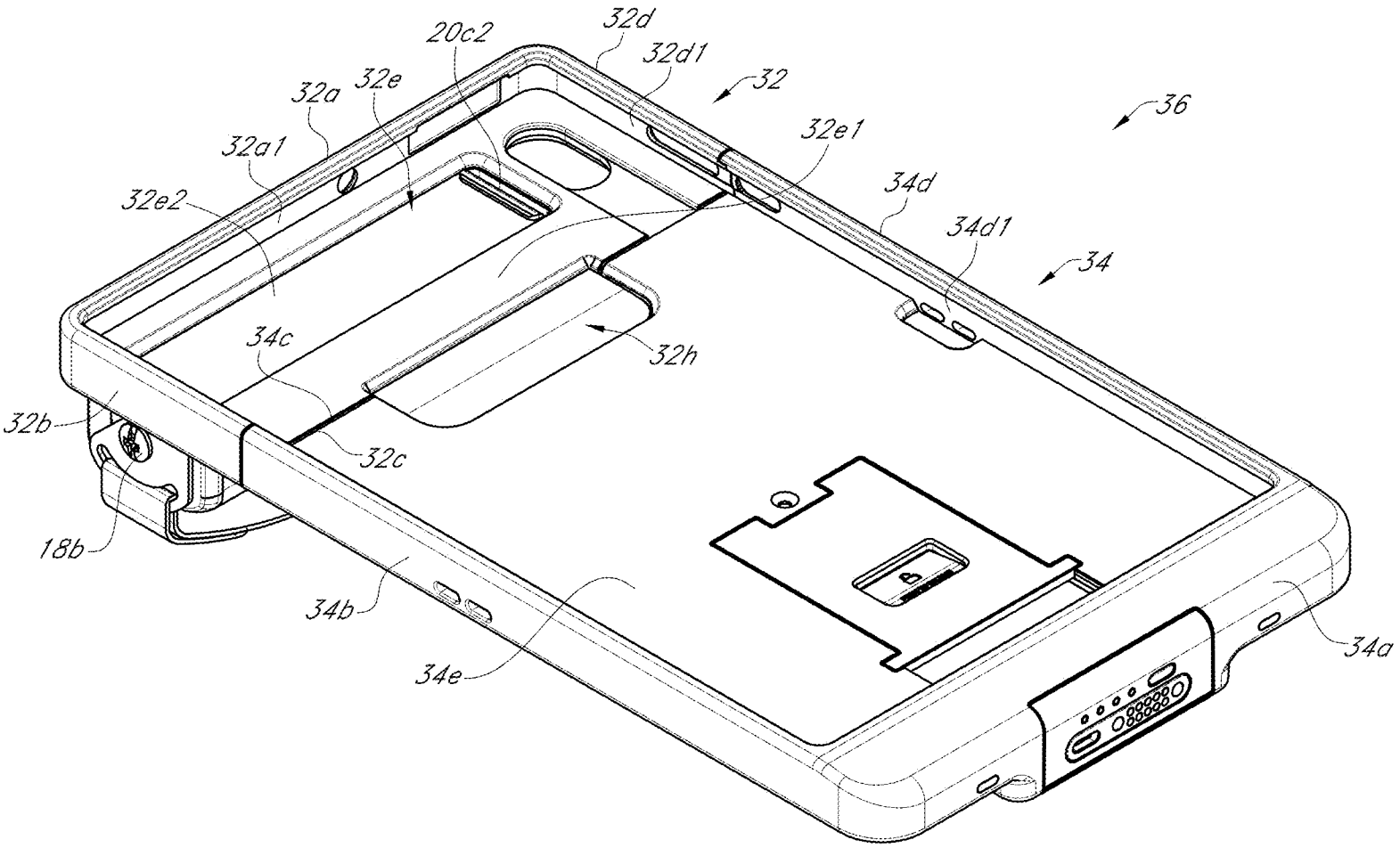
FIG. 28 is a rear-top-perspective view of the case assembly of FIG. 24 coupled with the handle assembly of FIG. 1.
Figure 29:
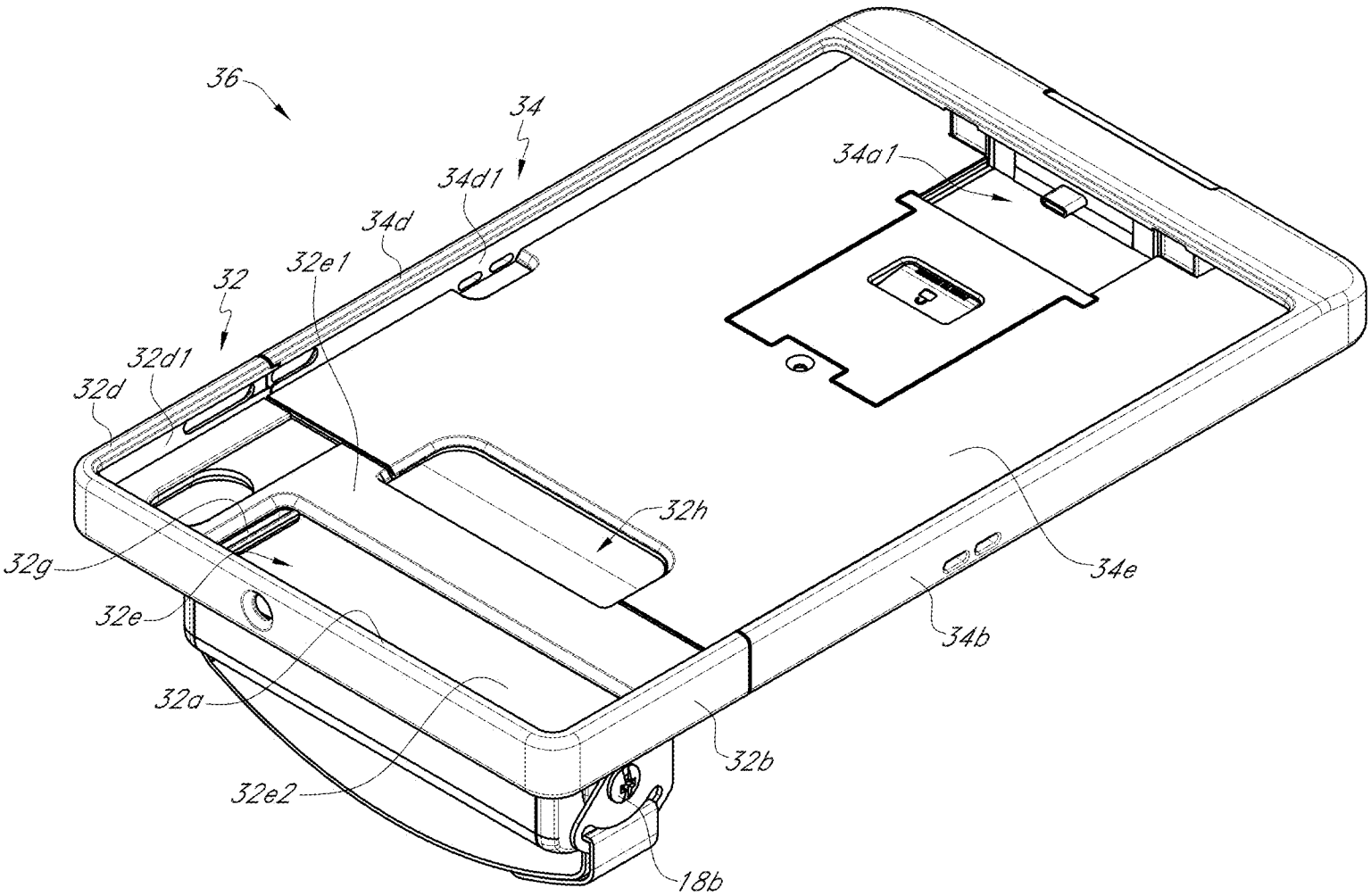
FIG. 29 is a front-top-perspective view of the case assembly of FIG. 24 coupled with the handle assembly of FIG. 1.

Turning to FIG. 28, depicted therein is a rear-top-perspective view of device case assembly 30 coupled with handle assembly 10. As depicted, Turning to FIG. 29, depicted therein is a front-top-perspective view of device case assembly 30 coupled with device case assembly 30.

Figure 30:
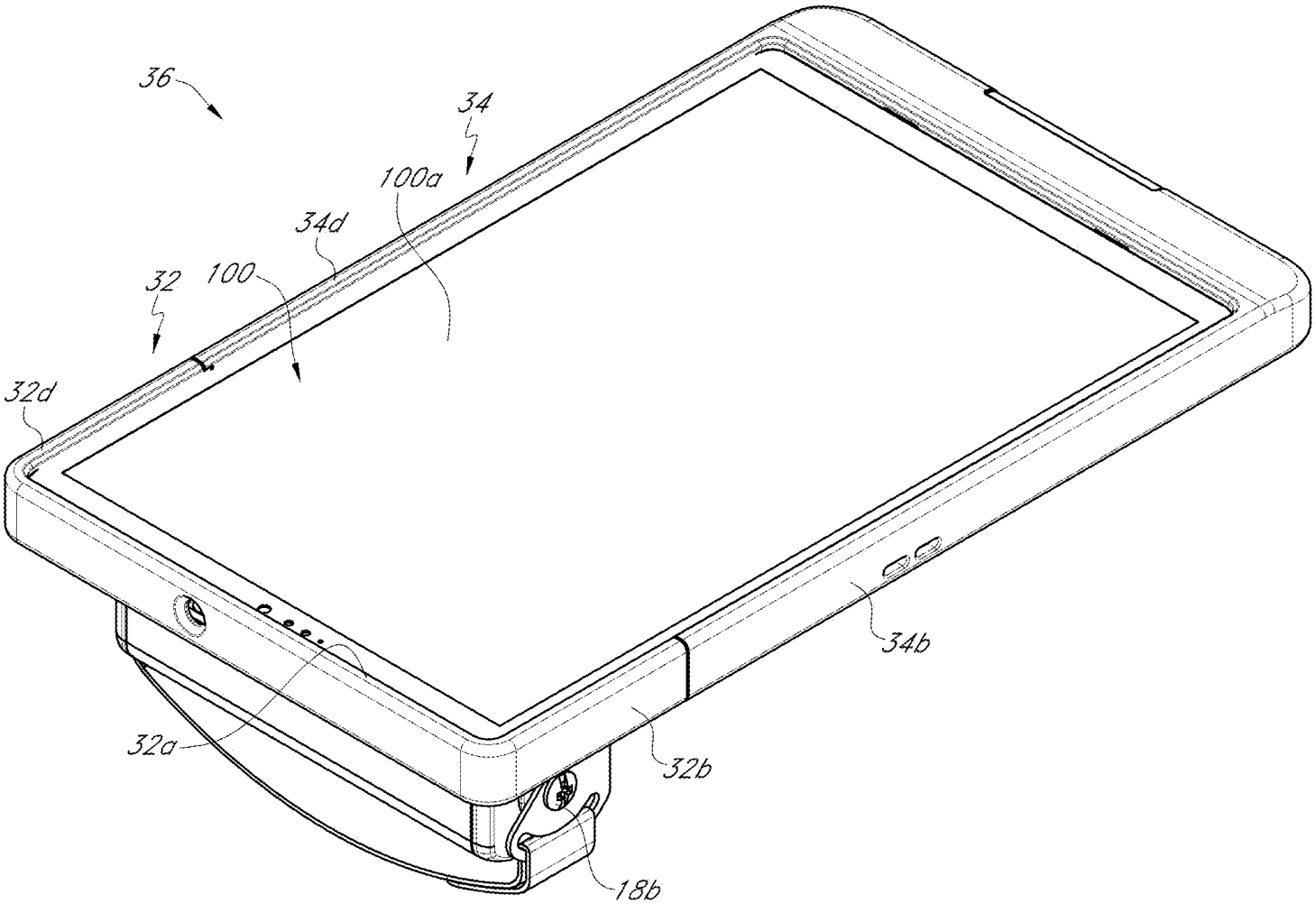
FIG. 30 is a front-top-perspective view of the case assembly of FIG. 24 coupled with the handle assembly of FIG. 1 and coupled with an electronic device.

Turning to FIG. 30, depicted therein is a front-top-perspective view of device case assembly 30 coupled with handle assembly 10 and coupled with portable electronic device 100. Depicted implementation of portable electronic device 100 is shown to include display 100*a*.

Figure 31:
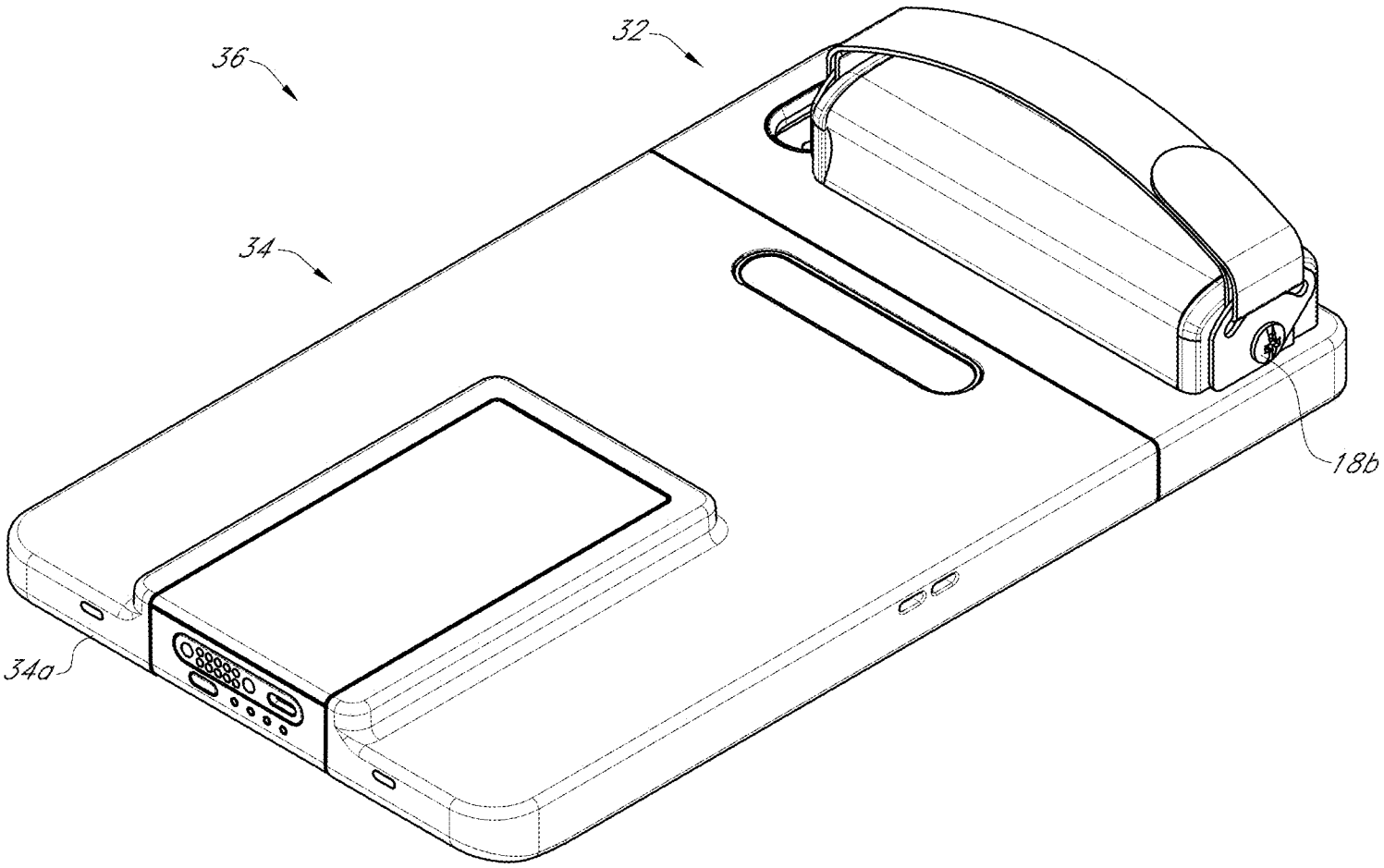
FIG. 31 is a rear-bottom-perspective view of the case assembly of FIG. 24 coupled with the handle assembly of FIG. 1.

Turning to FIG. 31, depicted therein is a rear-bottom-perspective view of device case assembly 30 with handle assembly 10.

Figure 32:
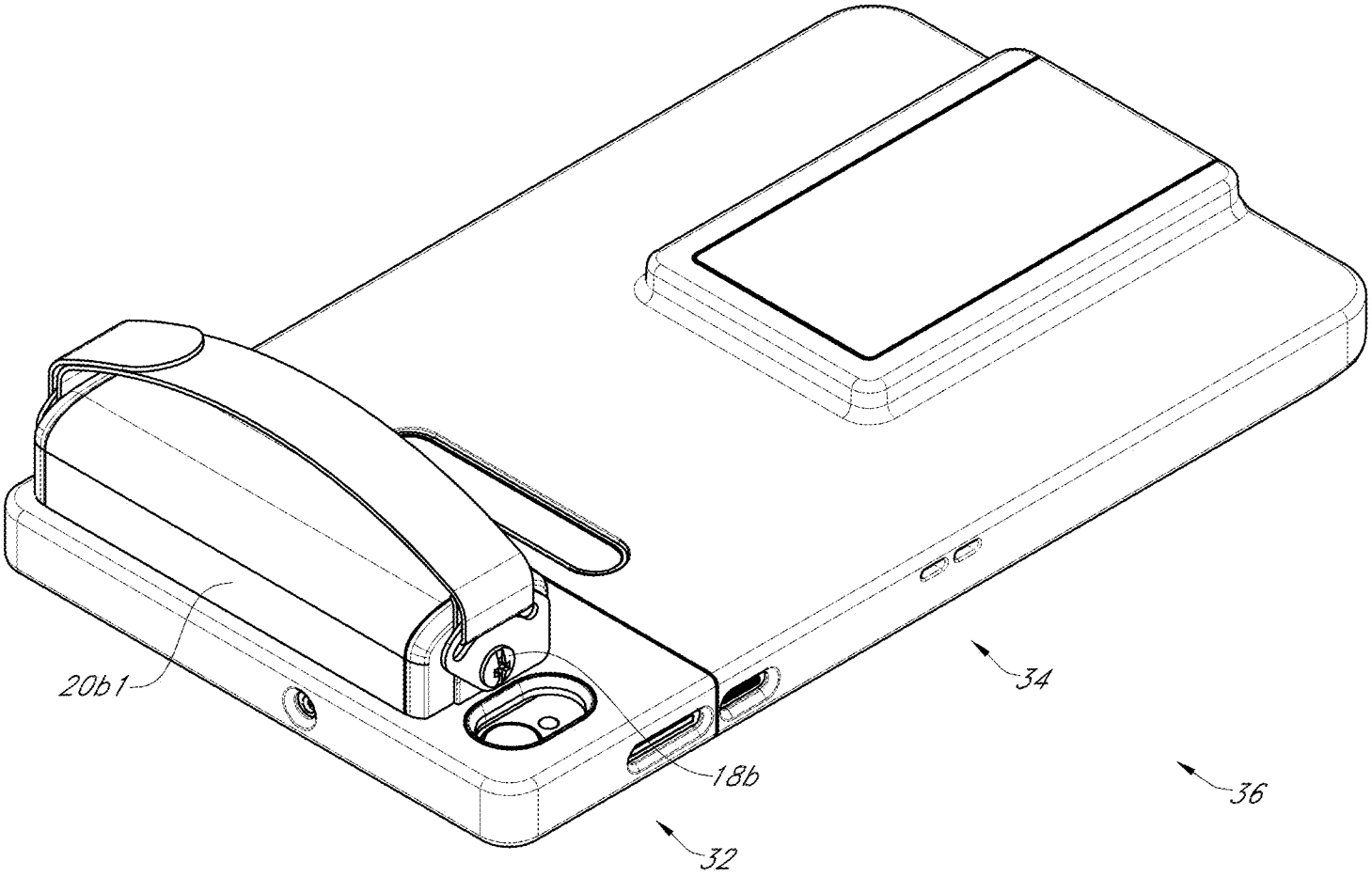
FIG. 32 is a front-bottom-perspective view of the case assembly of FIG. 24 coupled with the handle assembly of FIG. 1.

Turning to FIG. 32, depicted therein is a front-bottom-perspective view of device case assembly 30 coupled with handle assembly 10.

Figure 33:
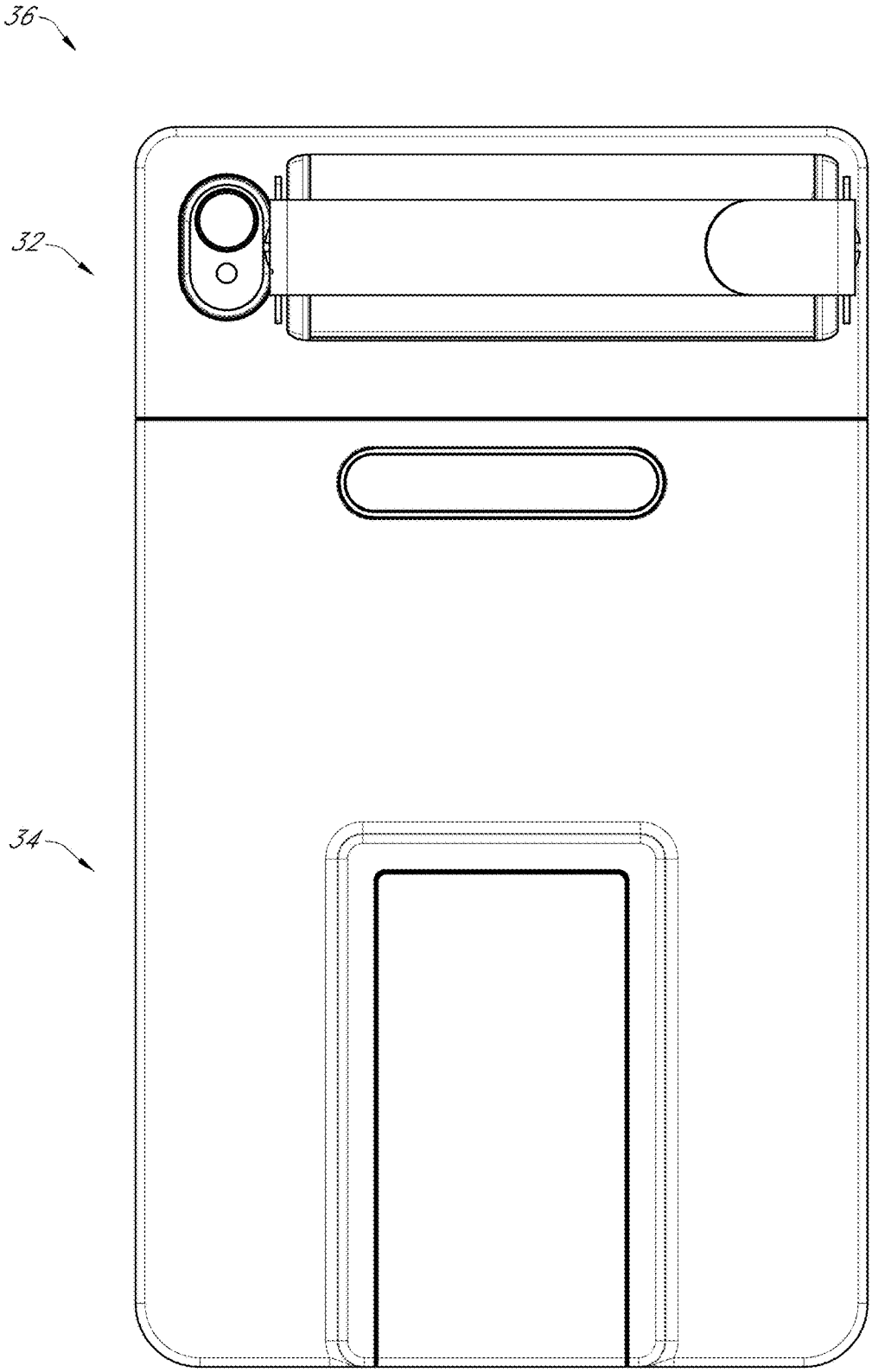
FIG. 33 is a bottom-plan-view of the case assembly of FIG. 24 coupled with the handle assembly of FIG. 1.

Turning to FIG. 33, depicted therein is a bottom-plan-view of device case assembly 30 coupled with handle assembly 10.

Figure 34:
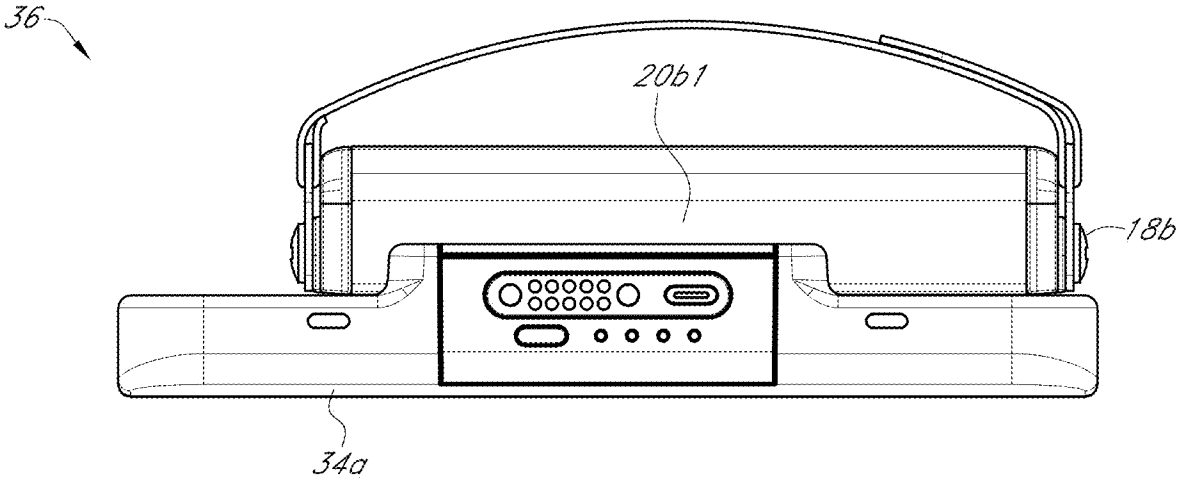
FIG. 34 is a rear-elevational view of the case assembly of FIG. 24 coupled with the handle assembly of FIG. 1.

Turning to FIG. 34, depicted therein is a rear-elevational view of device case assembly 30 coupled with handle assembly 10.

Figure 35:
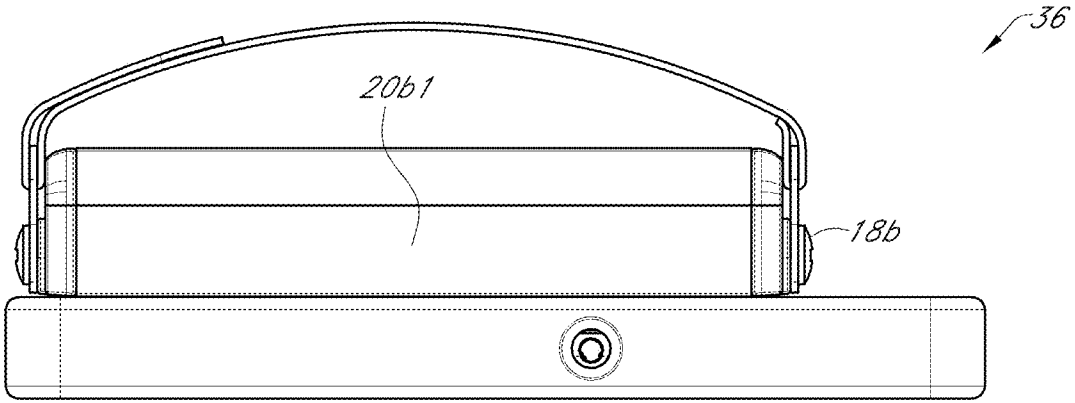
FIG. 35 is a front-elevational view of the case assembly of FIG. 24 coupled with the handle assembly of FIG. 1.

Turning to FIG. 35, depicted therein is a front-elevational view of device case assembly 30 coupled with handle assembly 10.

Figure 36:
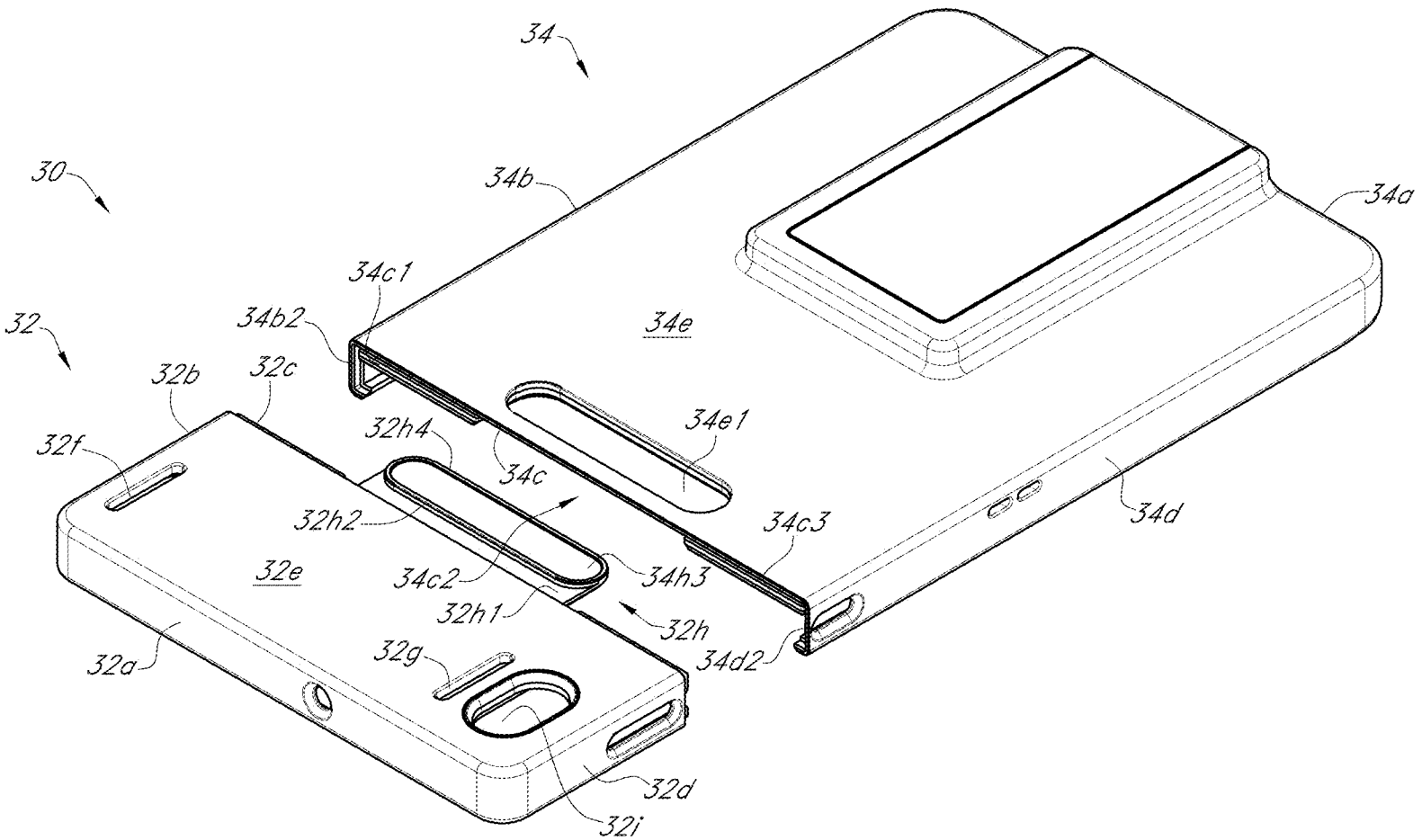
FIG. 36 is a partial-exploded-front-bottom-perspective view of the case assembly of FIG. 24.

Turning to FIG. 36, depicted therein is a partial-exploded-front-bottom-perspective view of device case assembly 30. Depicted implementation of tab member 32*h* of cap assembly 32 is shown to include recess 32*h*1, and a raised and tapered portion to include back edge 32*h*2, middle 32*h*3, and front edge 32*h*4, which are decreasingly less raised, respectively, with respect to recess 32*h*1 as also further shown in FIG. 52. As also depicted in FIG. 36, recess 32*h*1 is positioned closer to side edge 32*c* than back edge 32*h*2, middle 32*h*3, and front edge 32*h*4 are positioned to side edge 32*c*.

Depicted implementation of main assembly 34 is shown to include groove 34*b*2, groove 34*c*1, gap 34*c*2, groove 34*c*3, groove 34*d*2, and elongated aperture 34*e*1. As depicted, elongated aperture 34*e*1 is sized, shaped and positioned to receive tab member 32*h* (e.g., back edge 32*h*2, middle 32*h*3, and front edge 32*h*4) when cap assembly 32 and main assembly 34 are coupled together.

Figure 37:
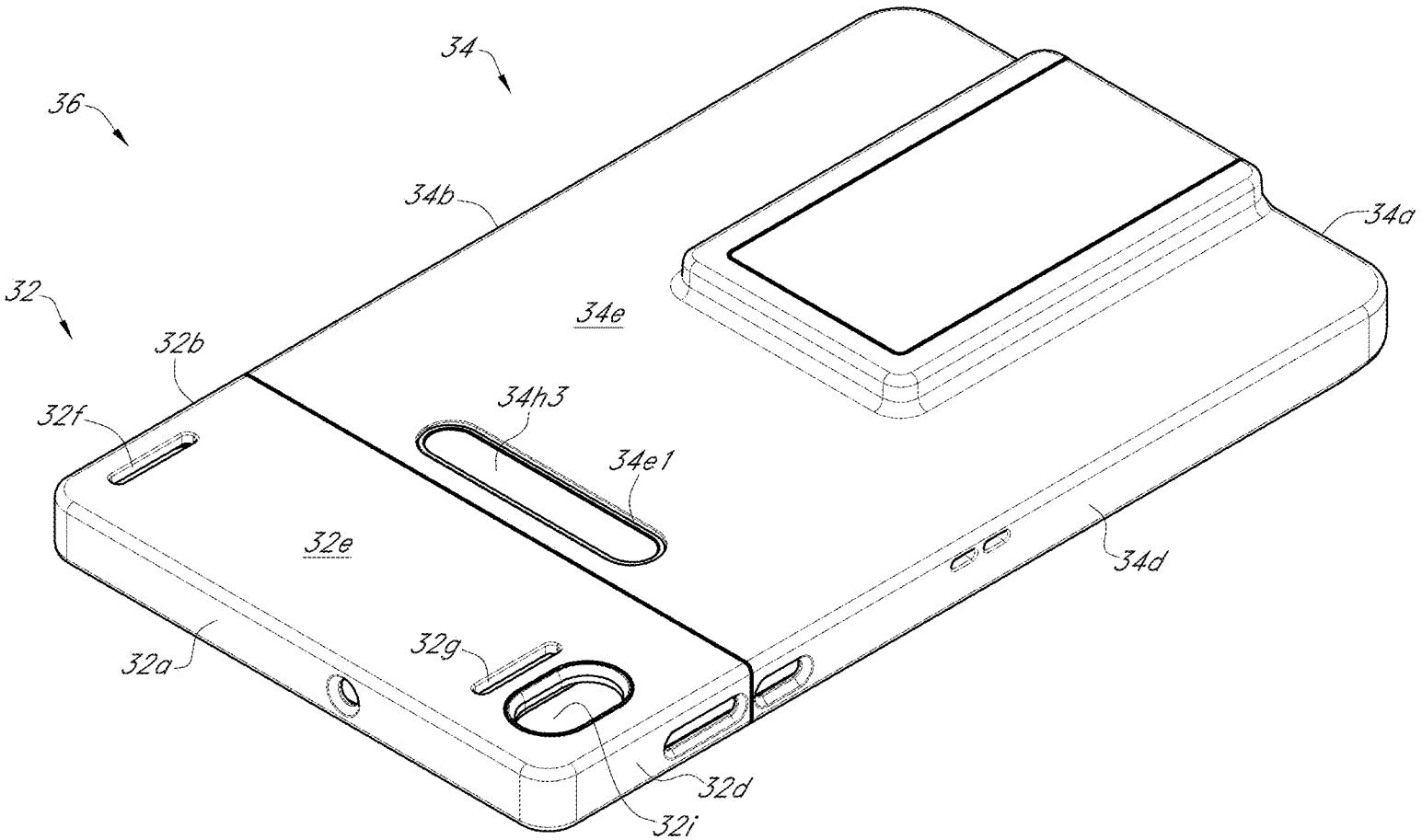
FIG. 37 is a front-bottom-perspective view of the case assembly of FIG. 24.

Turning to FIG. 37, depicted therein is a front-bottom-perspective view of device case assembly 30.

Figure 38:
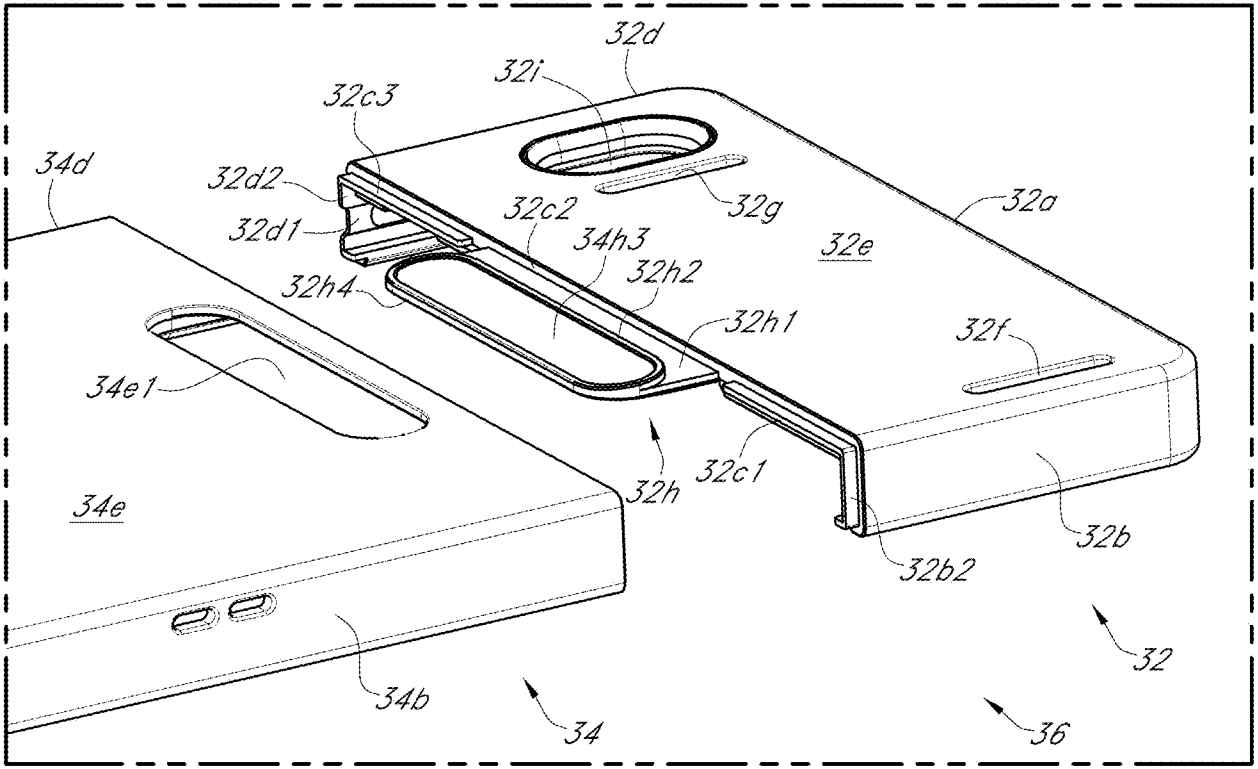
FIG. 38 is a partial-exploded-bottom-perspective view of a portion of the case assembly of FIG. 24.

Turning to FIG. 38, depicted therein is a partial-exploded-bottom-perspective view of a portion of device case assembly 30. Depicted implementation of cap assembly 32 is shown to include protrusion 32*b*2, protrusion 32*c*1, gap 32*c*2, protrusion 32*c*3, and protrusion 32*d*2 with protrusion 32*b*2, protrusion 32*c*1, protrusion 32*c*3, and protrusion 32*d*2 for coupling with groove 34*b*2, groove 34*c*1, groove 34*c*3, and groove 34*d*2, respectively when cap assembly 32 is coupled with main assembly 34.

Depicted implementation of main assembly 34 is shown to include groove 34*b*2, groove 34*c*1, gap 34*c*2, groove 34*c*3, groove 34*d*2, and elongated aperture 34*e*1. As depicted, elongated aperture 34*e*1 is sized, shaped and positioned to receive tab member 32*h* (e.g., back edge 32*h*2, middle 32*h*3, and front edge 32*h*4) when cap assembly 32 and main assembly 34 are coupled together.

Figure 39:
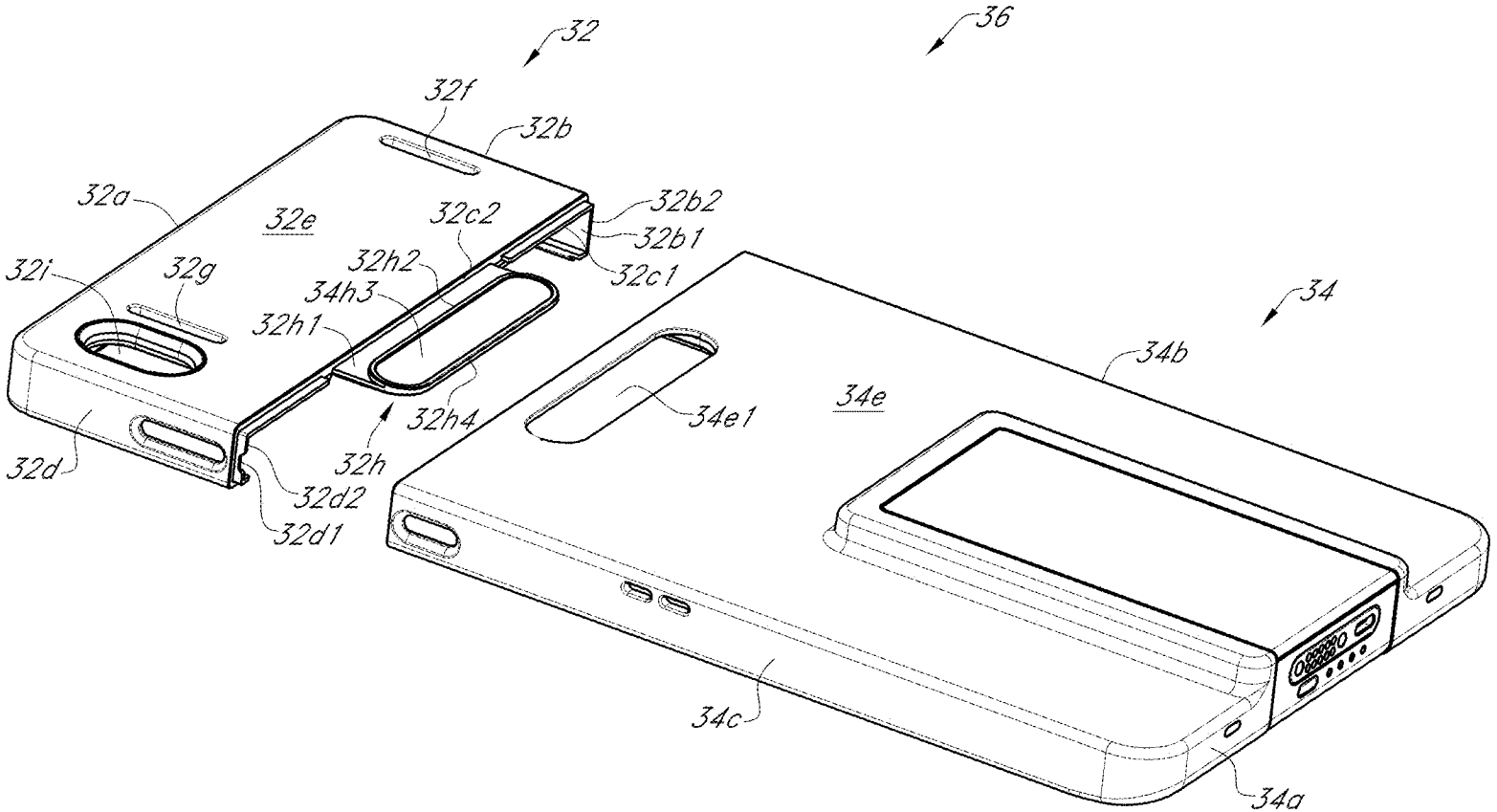
FIG. 39 is a partial-exploded-rear-bottom-perspective view of the case assembly of FIG. 24.

Turning to FIG. 39, depicted therein is a partial-exploded-rear-bottom-perspective view of device case assembly 30. Depicted implementation of cap assembly 32 is shown to include elongated groove 32*b*1.

Figure 40:
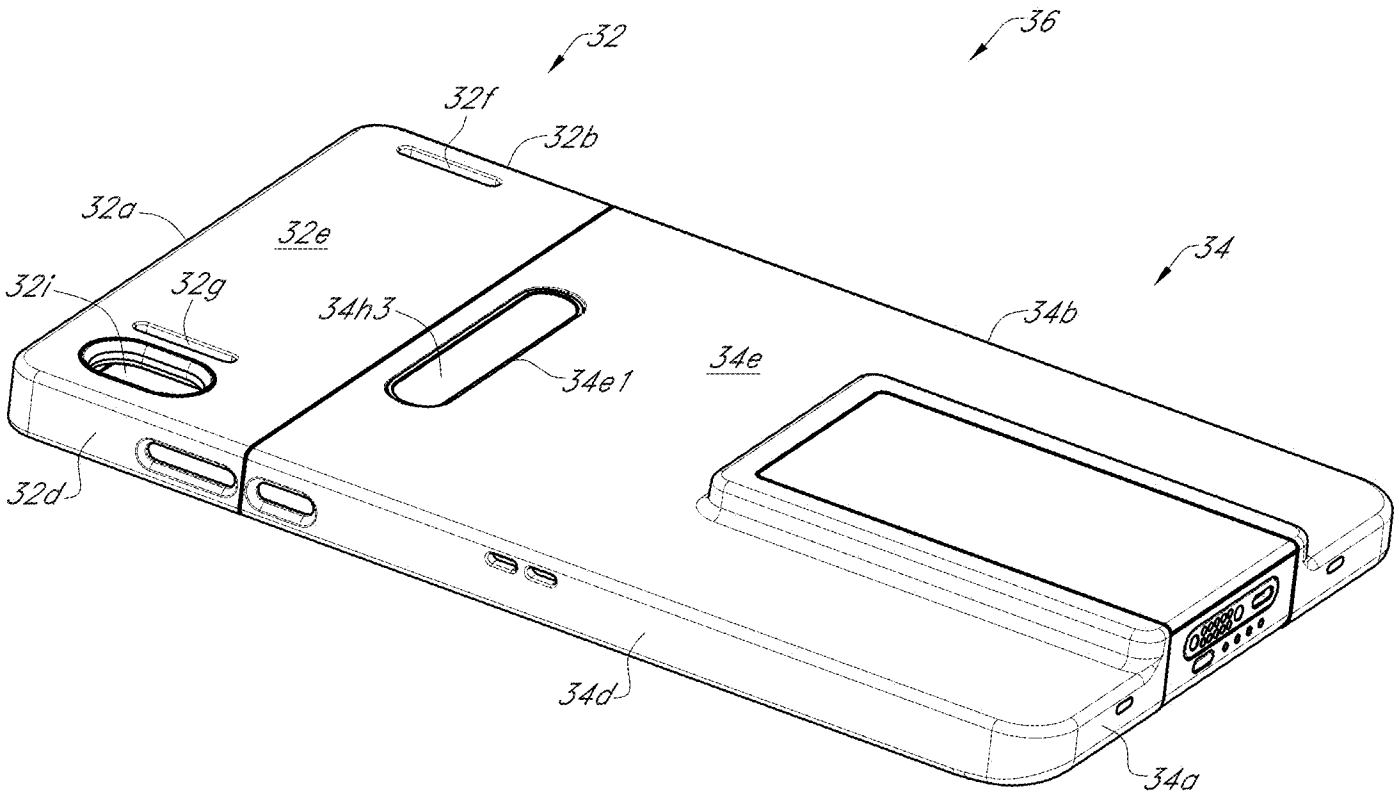
FIG. 40 is a rear-bottom-perspective view of the case assembly of FIG. 24.

Turning to FIG. 40, depicted therein is a rear-bottom-perspective view of device case assembly 30.

Figure 41:
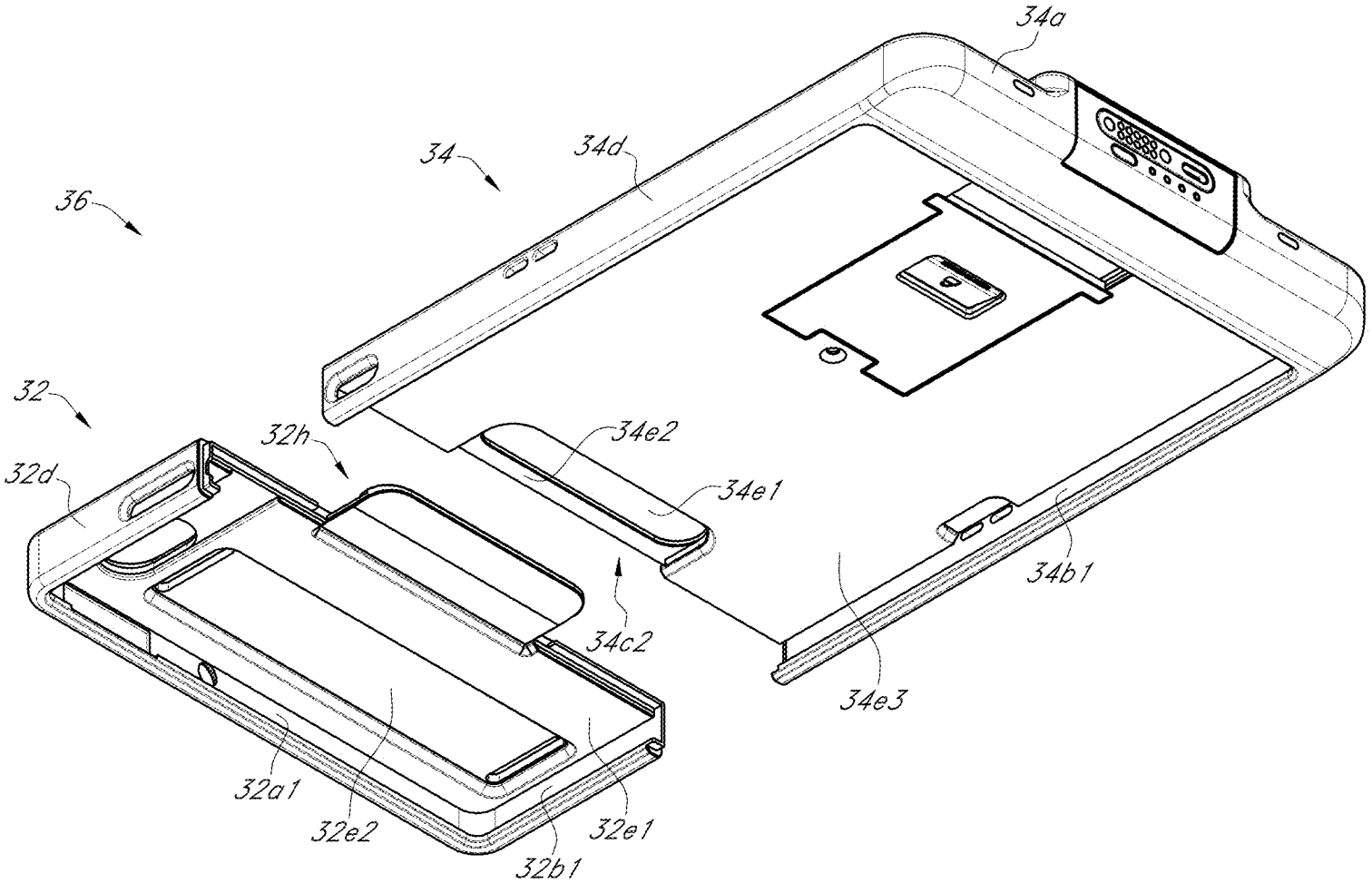
FIG. 41 is a partial-exploded-rear-top-perspective view of a portion of the case assembly of FIG. 24.

Turning to FIG. 41, depicted therein is a partial-exploded-rear-top-perspective view of a portion of device case assembly 30. Depicted implementation of main assembly 34 is shown to include elongated groove 34*b*1, recessed portion 34*e*2, and raised portion 34*e*3.

Figure 42:
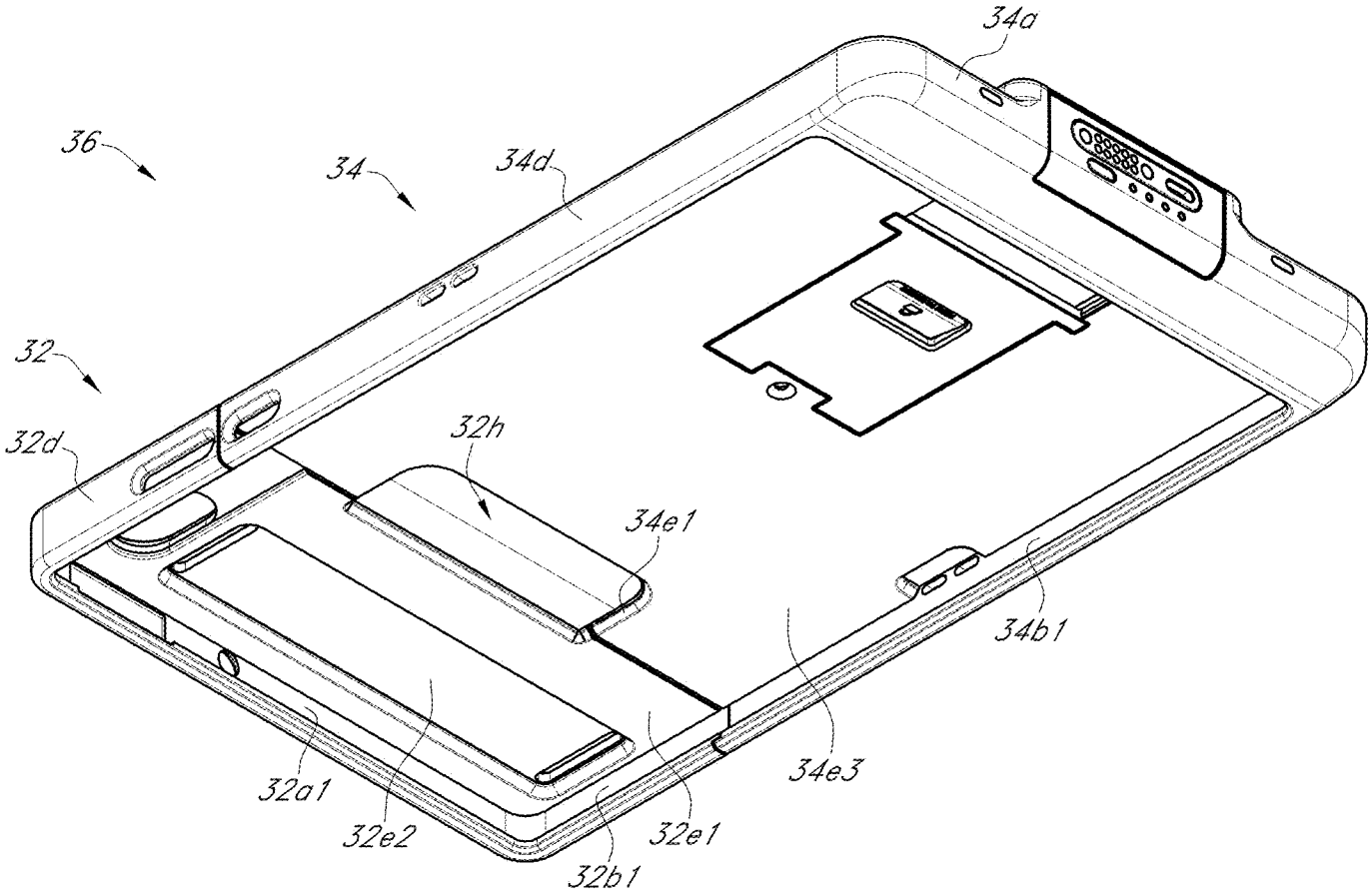
FIG. 42 is a rear-top-perspective view of the case assembly of FIG. 24.

Turning to FIG. 42, depicted therein is a rear-top-perspective view of device case assembly 30.

Figure 43:
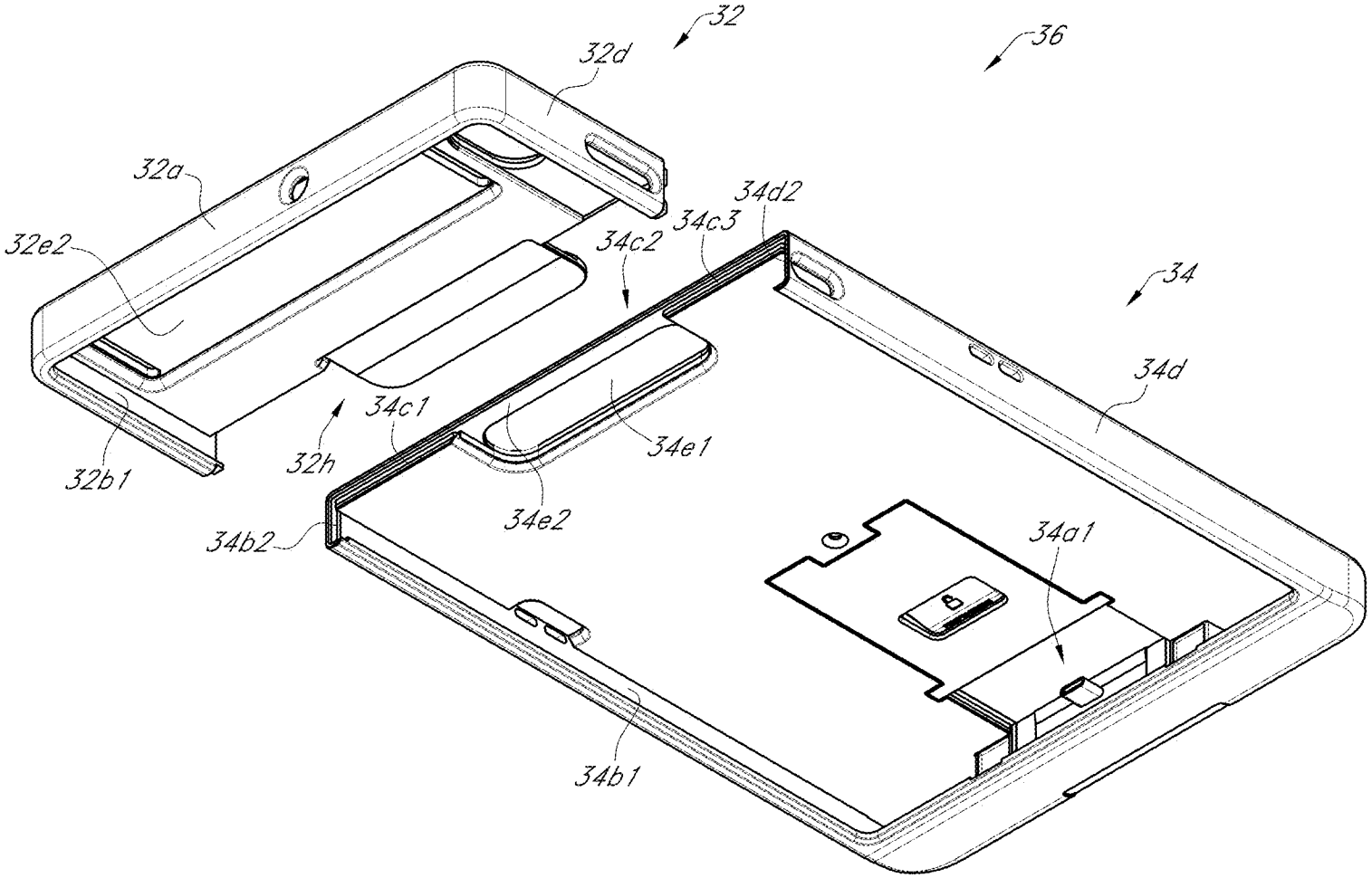
FIG. 43 is a partial-exploded-front-top-perspective view of the case assembly of FIG. 24.

Turning to FIG. 43, depicted therein is a partial-exploded-front-top-perspective view of device case assembly 30.

Figure 44:
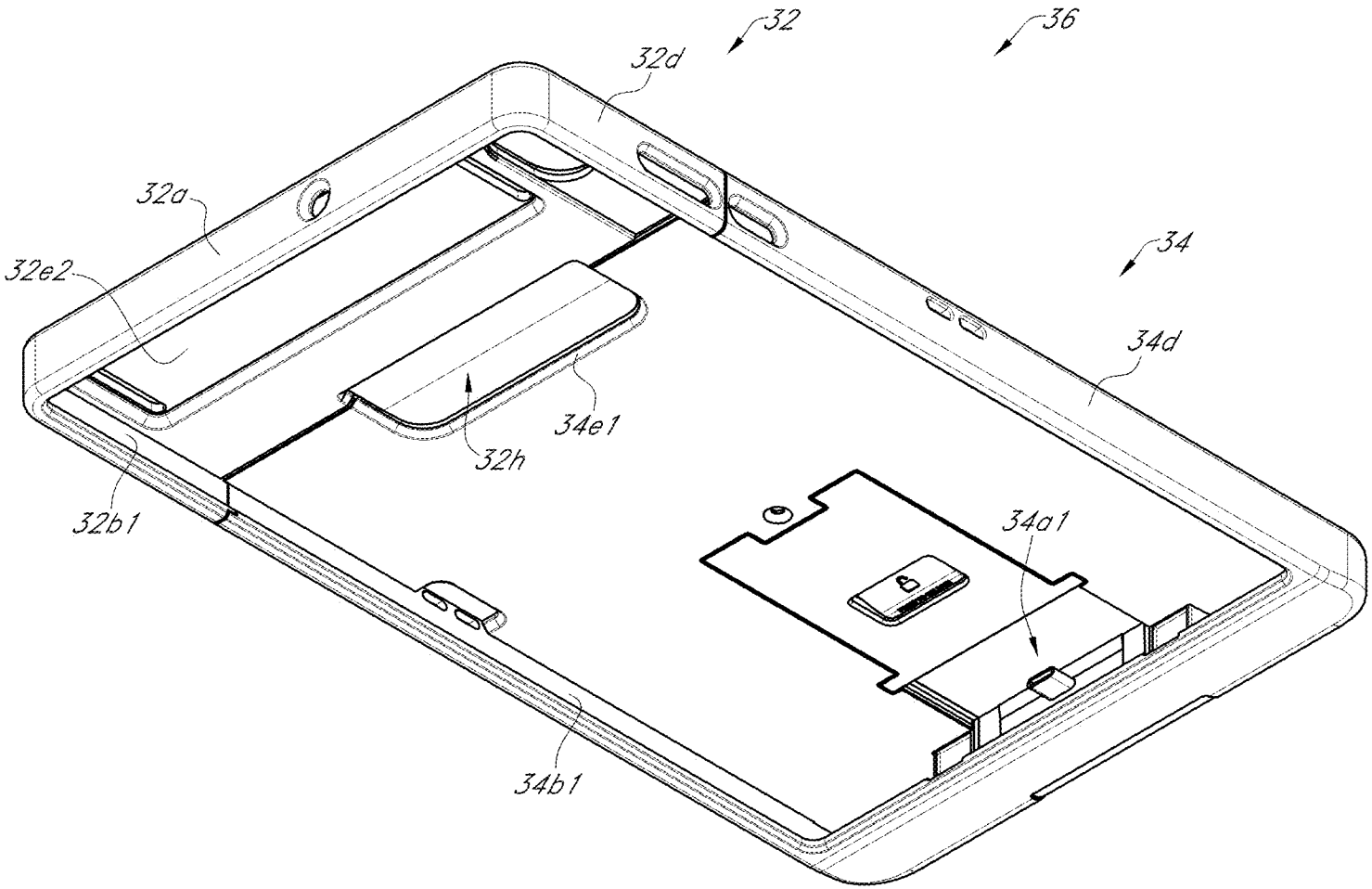
FIG. 44 is a front-top-perspective view of the case assembly of FIG. 24.

Turning to FIG. 44, depicted therein is a front-top-perspective view of device case assembly 30.

Figure 45:
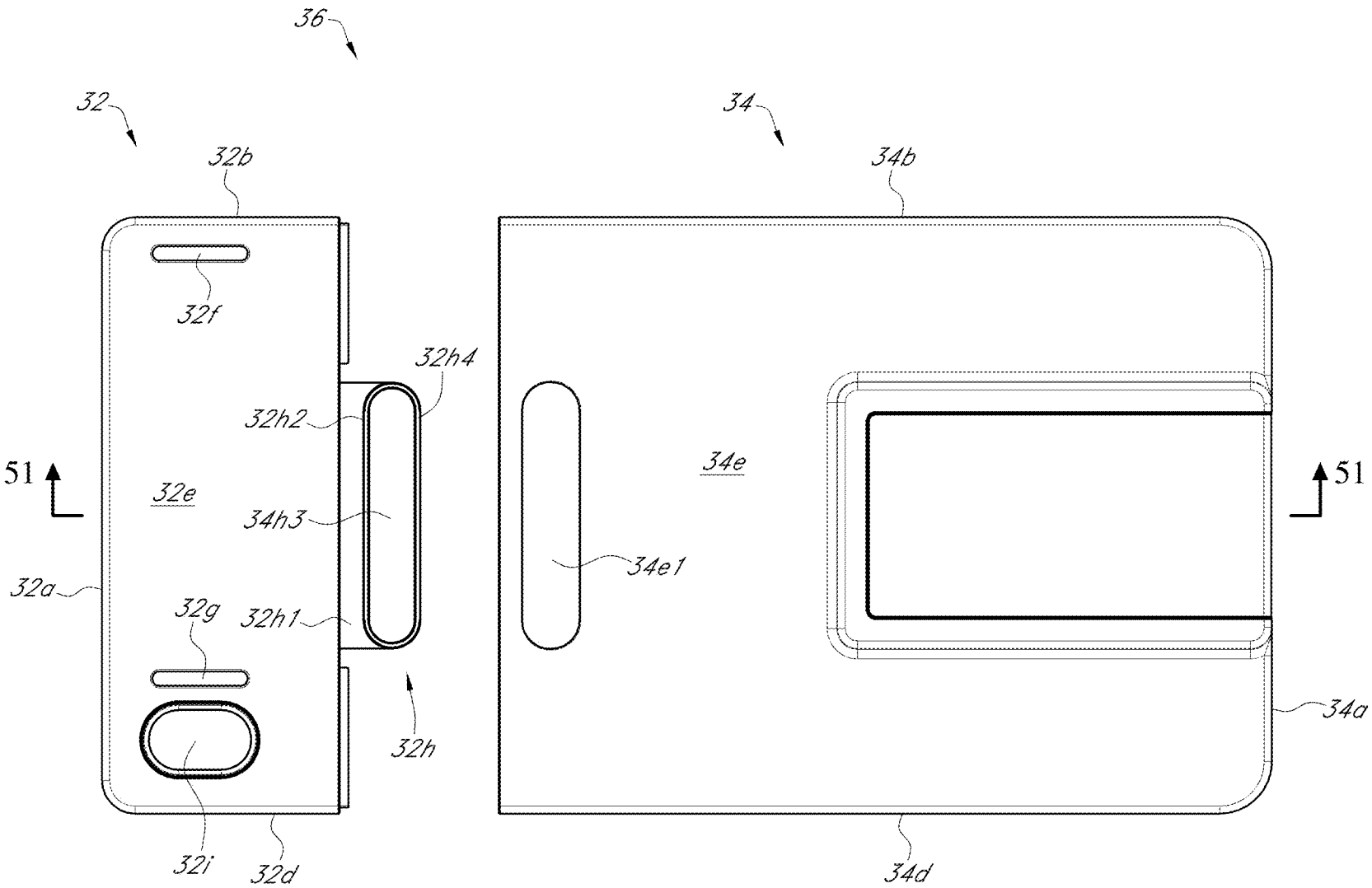
FIG. 45 is a partial-exploded-bottom-plan view of the case assembly of FIG. 24.

Turning to FIG. 45, depicted therein is a partial-exploded-bottom-plan view of device case assembly 30.

Figure 46:
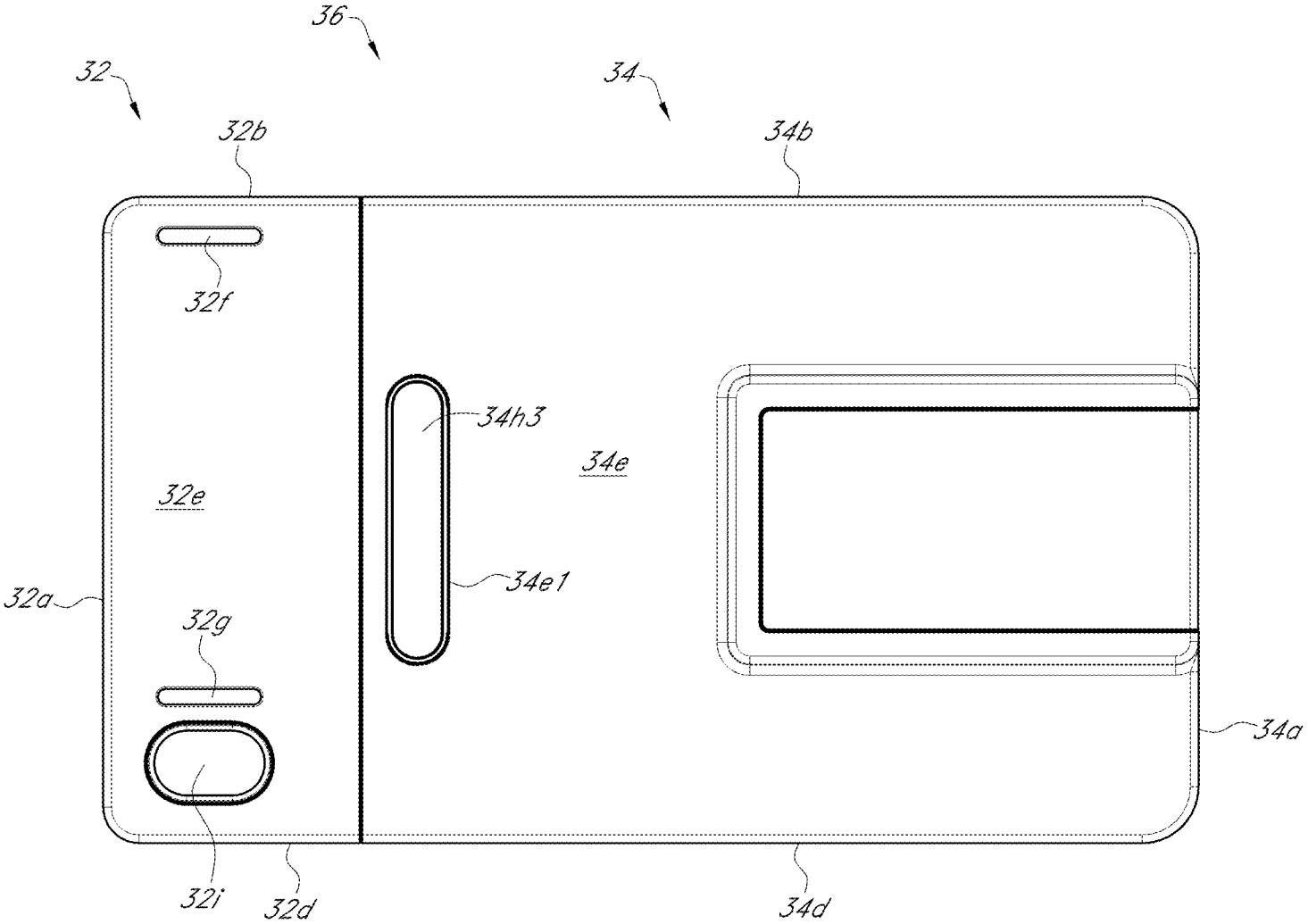
FIG. 46 is a bottom-plan view of the case assembly of FIG. 24.

Turning to FIG. 46, depicted therein is a bottom-plan view of device case assembly 30.

Figure 47:
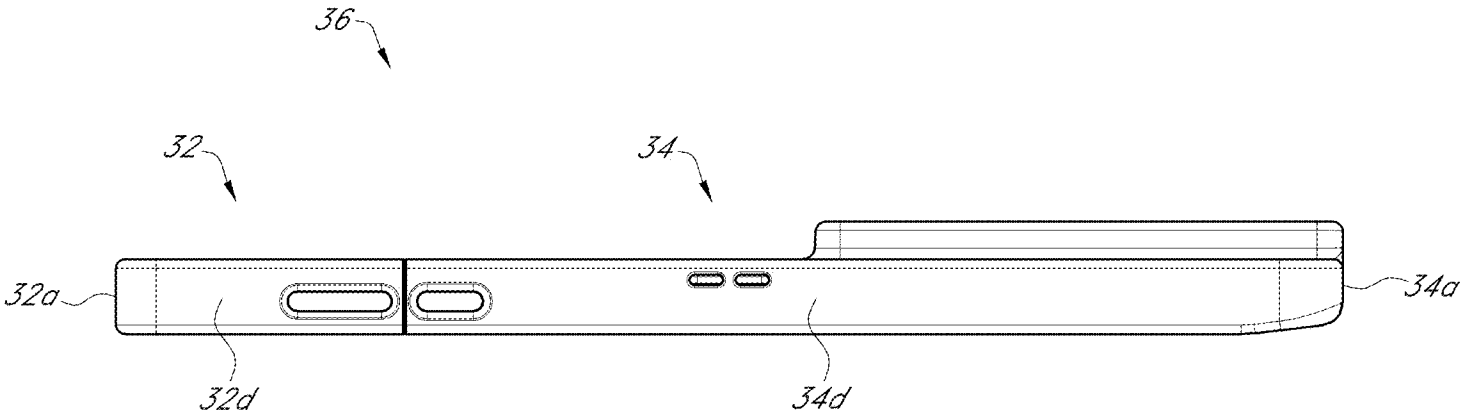
FIG. 47 is a side-elevational view of the case assembly of FIG. 24.

Turning to FIG. 47, depicted therein is a side-elevational view of device case assembly 30.

Figure 48:
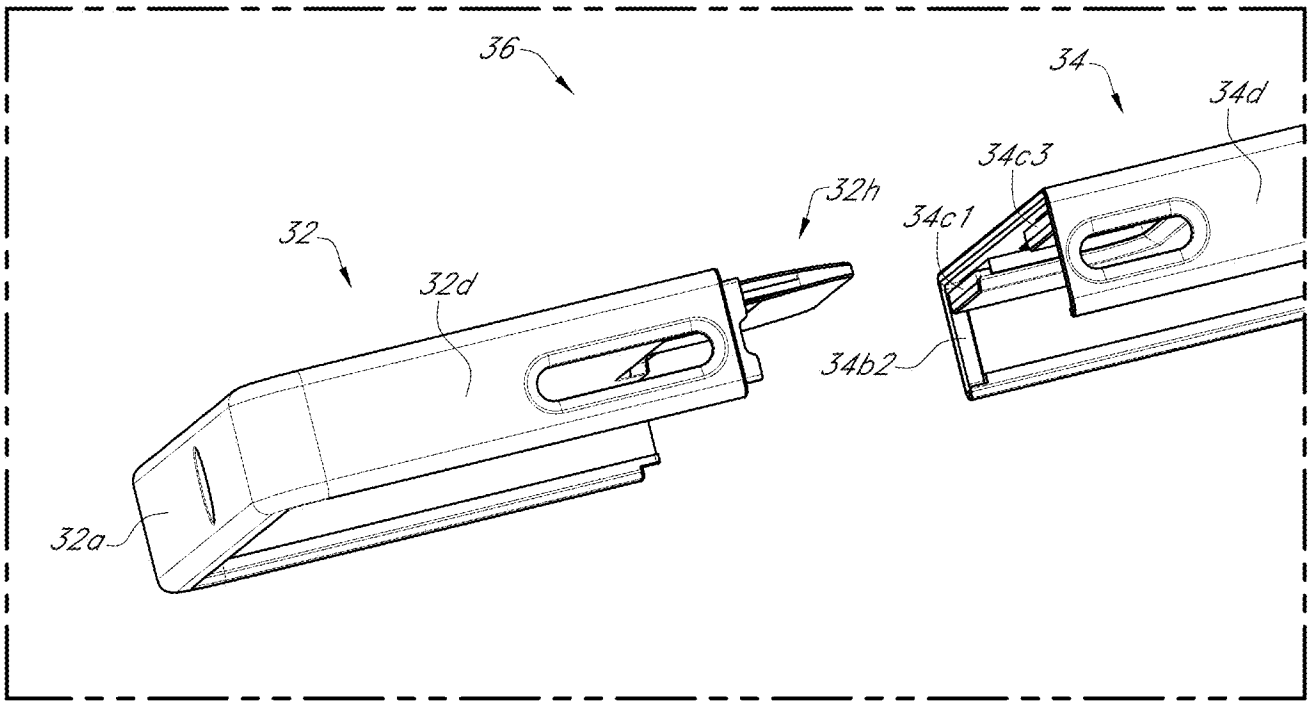
FIG. 48 is a partial-exploded-perspective view of a portion of the case assembly of FIG. 24.

Turning to FIG. 48, depicted therein is a partial-exploded-perspective view of a portion of device case assembly 30.

Figure 49:
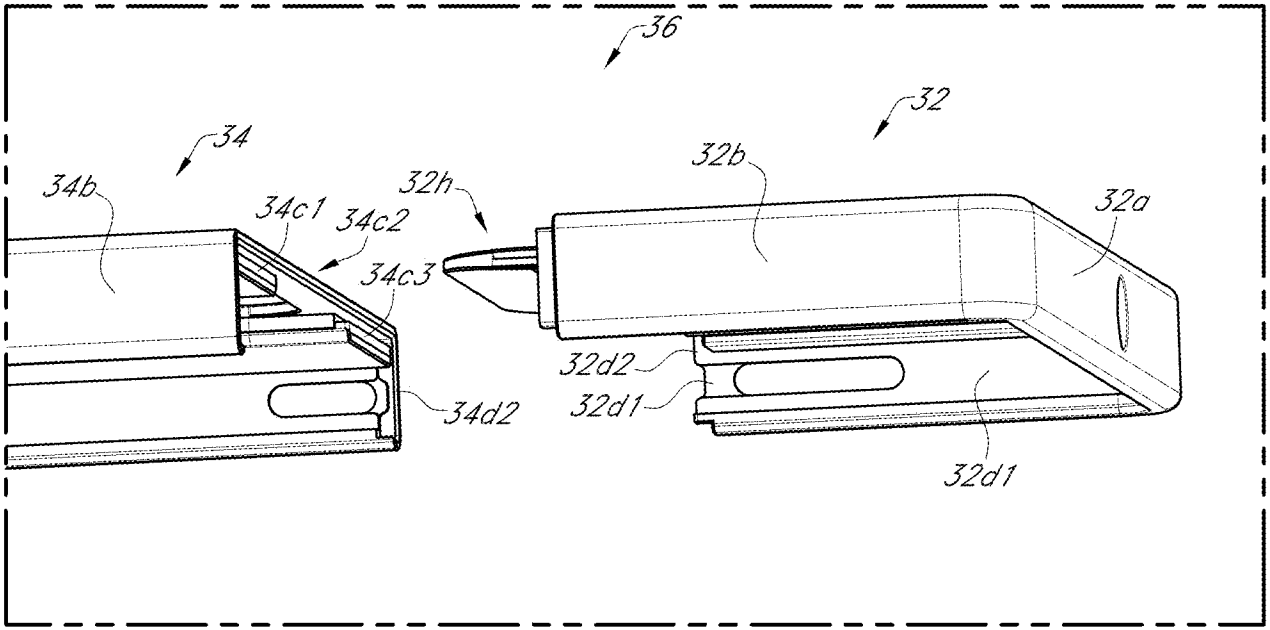
FIG. 49 is a partial-exploded-perspective view of a portion of the case assembly of FIG. 24.

Turning to FIG. 49, depicted therein is a partial-exploded-perspective view of a portion of device case assembly 30.

Figure 50:
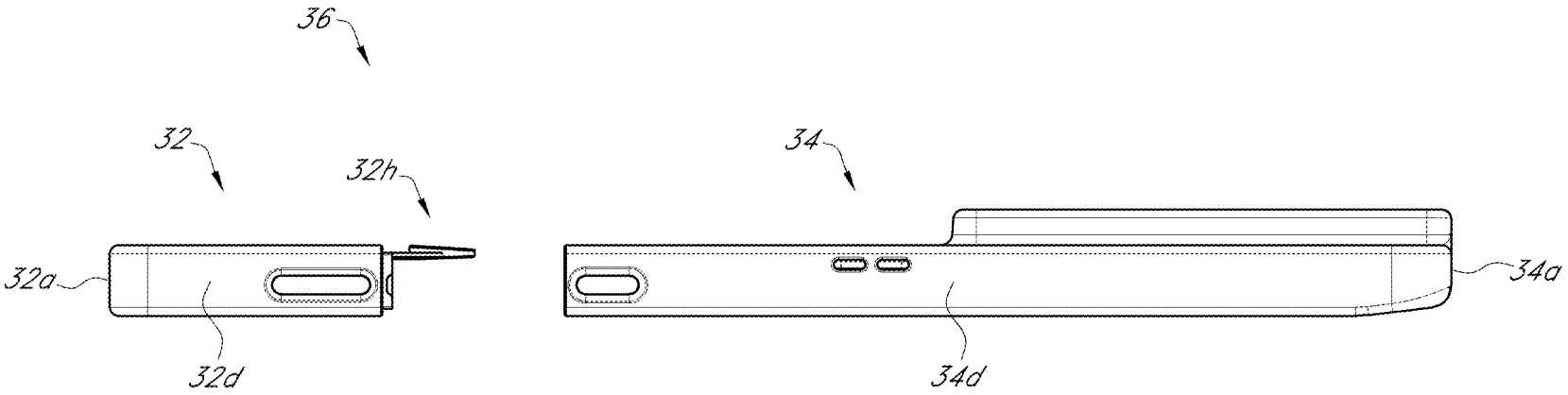
FIG. 50 is a partial-exploded-side-elevational view of the case assembly of FIG. 24.

Turning to FIG. 50, depicted therein is a partial-exploded-side-elevational view of device case assembly 30.

Figure 51:
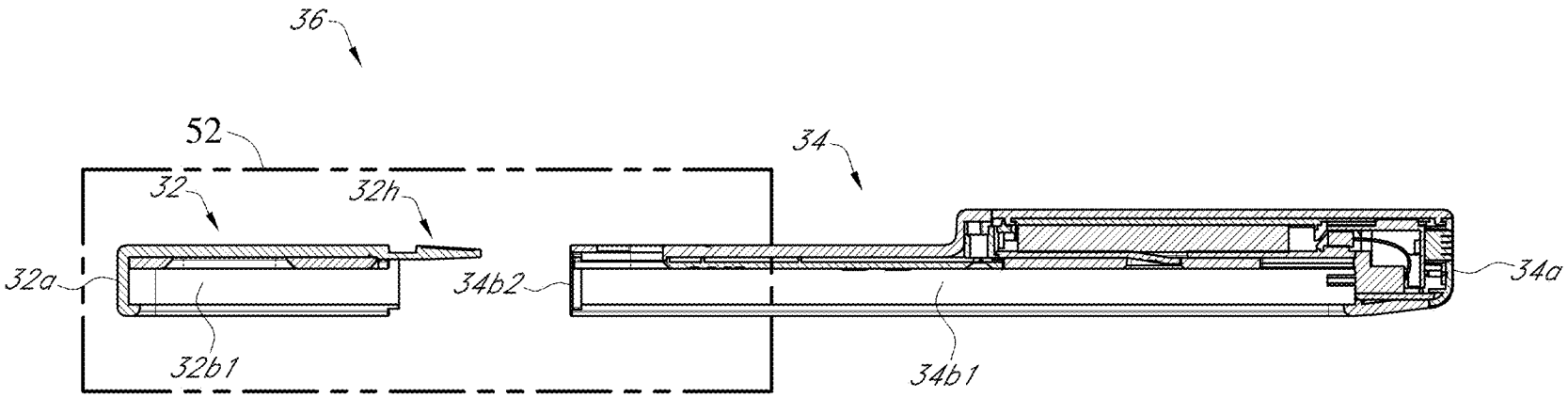
FIG. 51 is a cross-sectional-partial-exploded-side-elevational view of the case assembly of FIG. 24 taken along the 51-51 cutline of FIG. 45.

Turning to FIG. 51, depicted therein is a cross-sectional-partial-exploded-side-elevational view of device case assembly 30 taken along the 51-51 cutline of FIG. 45.

Figure 52:
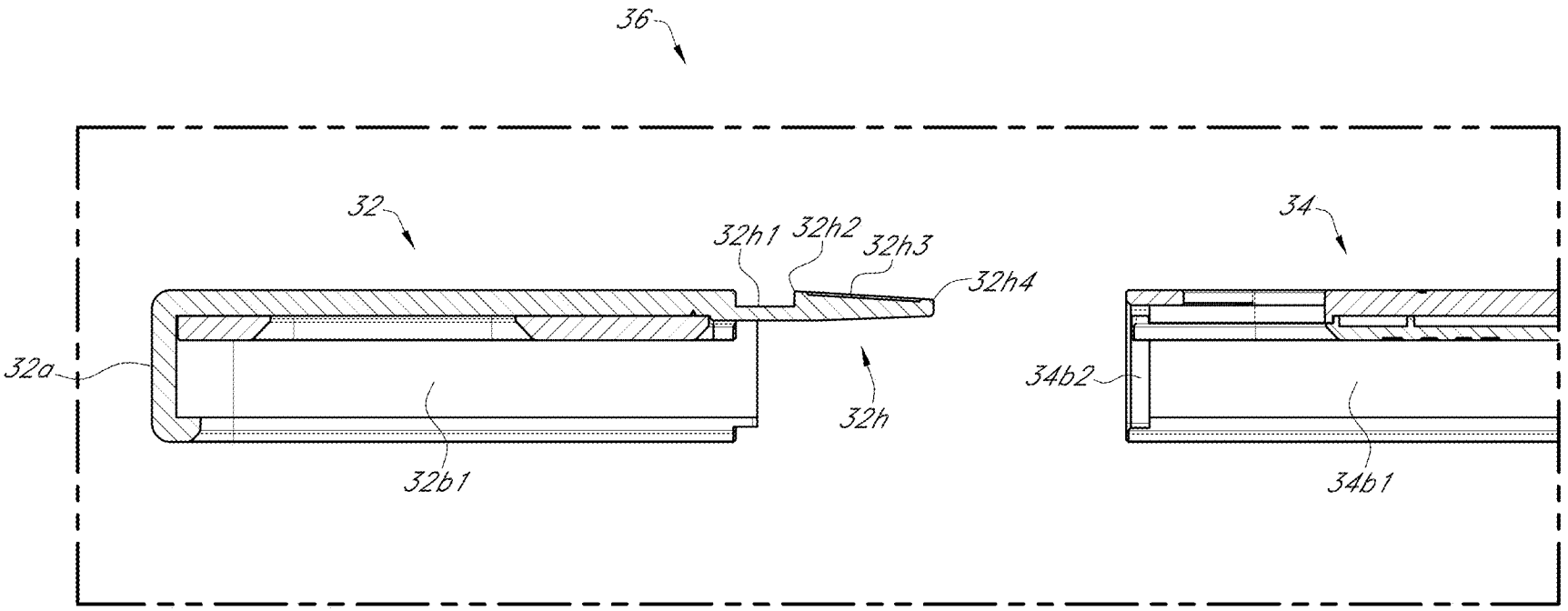
FIG. 52 is an enlarged portion identified by the "52" demarcated area of FIG. 51 of cross-sectional-partial-exploded-side-elevational view of the case assembly of FIG. 24 taken along the 51-51 cutline of FIG. 45.

Turning to FIG. 52, depicted therein is an enlarged portion identified by the "52" demarcated area of FIG. 51 of cross-sectional-partial-exploded-side-elevational view of device case assembly 30 taken along the 51-51 cutline of FIG. 45.

Figure 53:
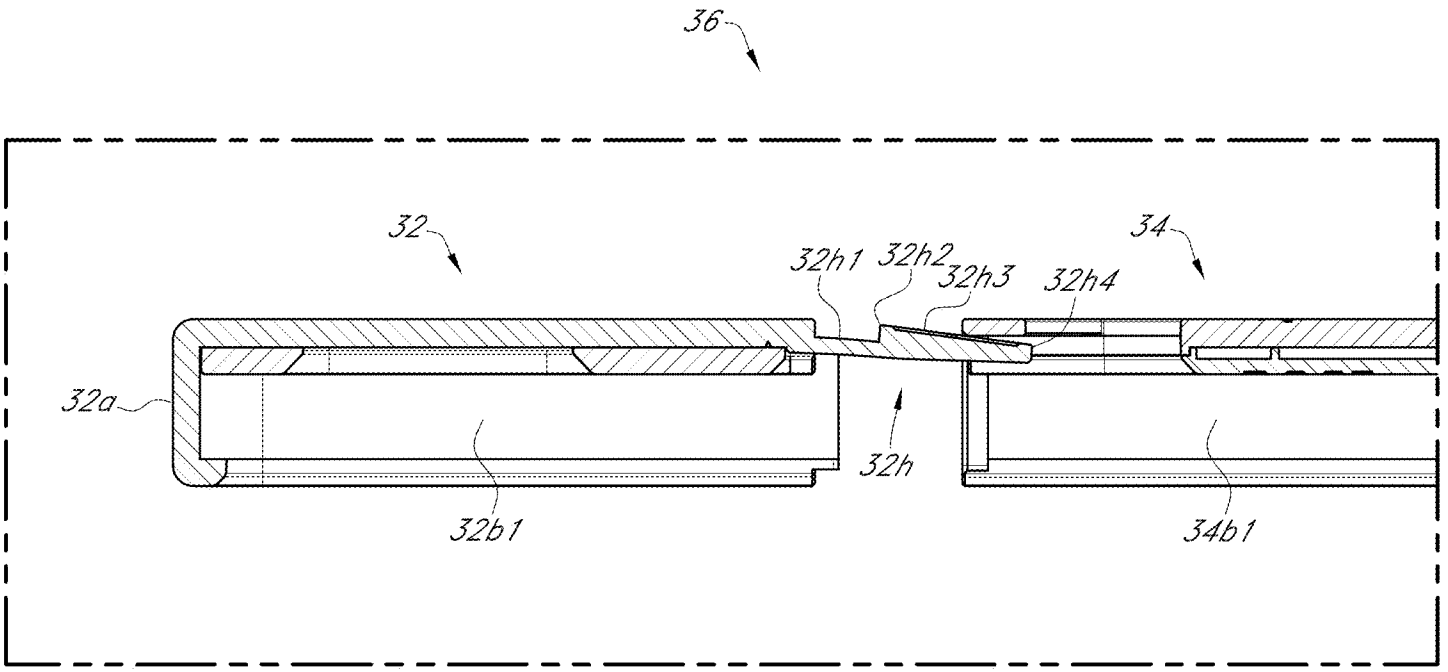
FIG. 53 is an enlarged portion of cross-sectional-partial-engaged-side-elevational view of the case assembly of FIG. 24 taken along the 51-51 cutline of FIG. 45.

Turning to FIG. 53, depicted therein is an enlarged portion of cross-sectional-partial-engaged-side-elevational view of device case assembly 30 taken along the 51-51 cutline of FIG. 45.

Figure 54:
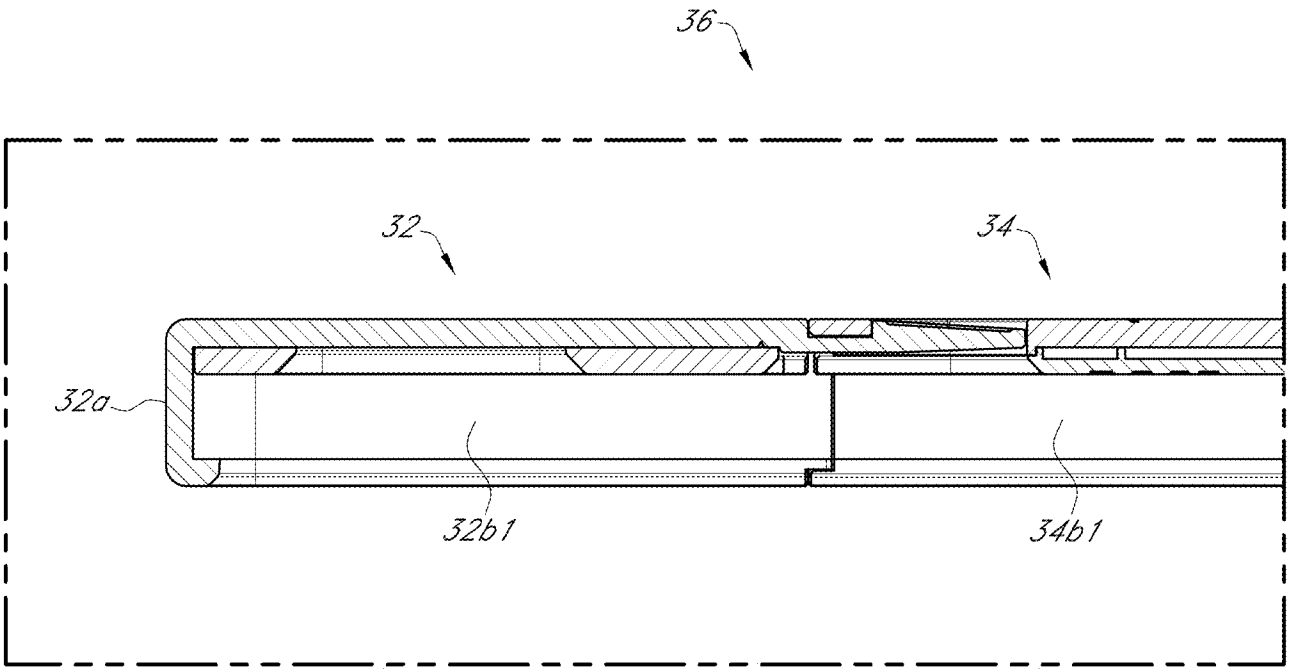
FIG. 54 is an enlarged portion of cross-sectional-engaged-side-elevational view of the case assembly of FIG. 24 taken along the 51-51 cutline of FIG. 45.

Turning to FIG. 54, depicted therein is an enlarged portion of cross-sectional-engaged-side-elevational view of device case assembly 30 taken along the 51-51 cutline of FIG. 45.

Figure 55:
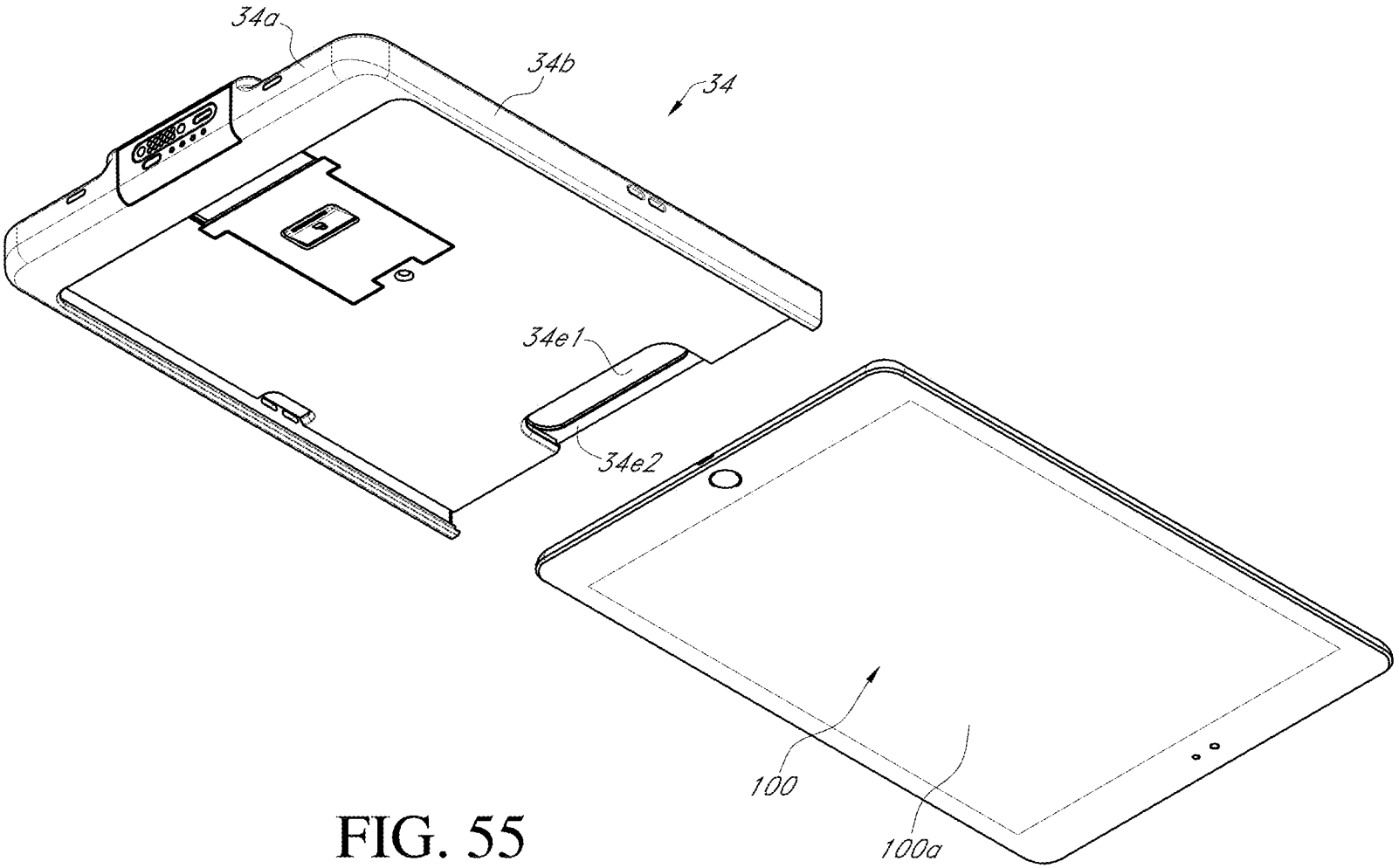
FIG. 55 is a front-rear perspective of a portion of the case assembly of FIG. 24 and the electronic device of FIG. 30.

Turning to FIG. 55, depicted therein is a front-rear perspective of a portion of device case assembly 30 and portable electronic device 100.

Figure 56:
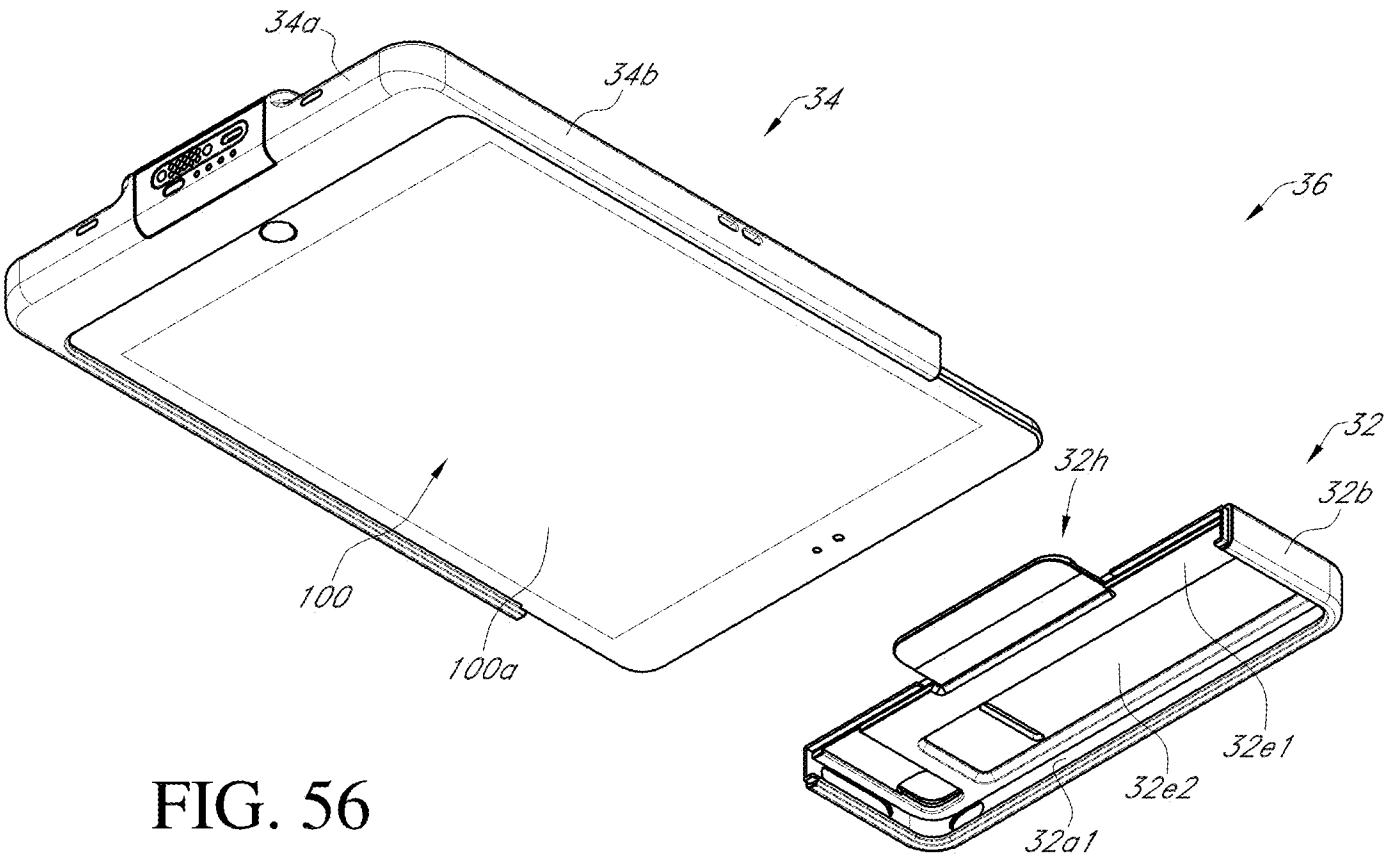
FIG. 56 is a front-rear perspective of a portion of the case assembly of FIG. 24 and the electronic device of FIG. 30.

Turning to FIG. 56, depicted therein is a front-rear perspective of a portion of device case assembly 30 and portable electronic device 100.

Figure 57:
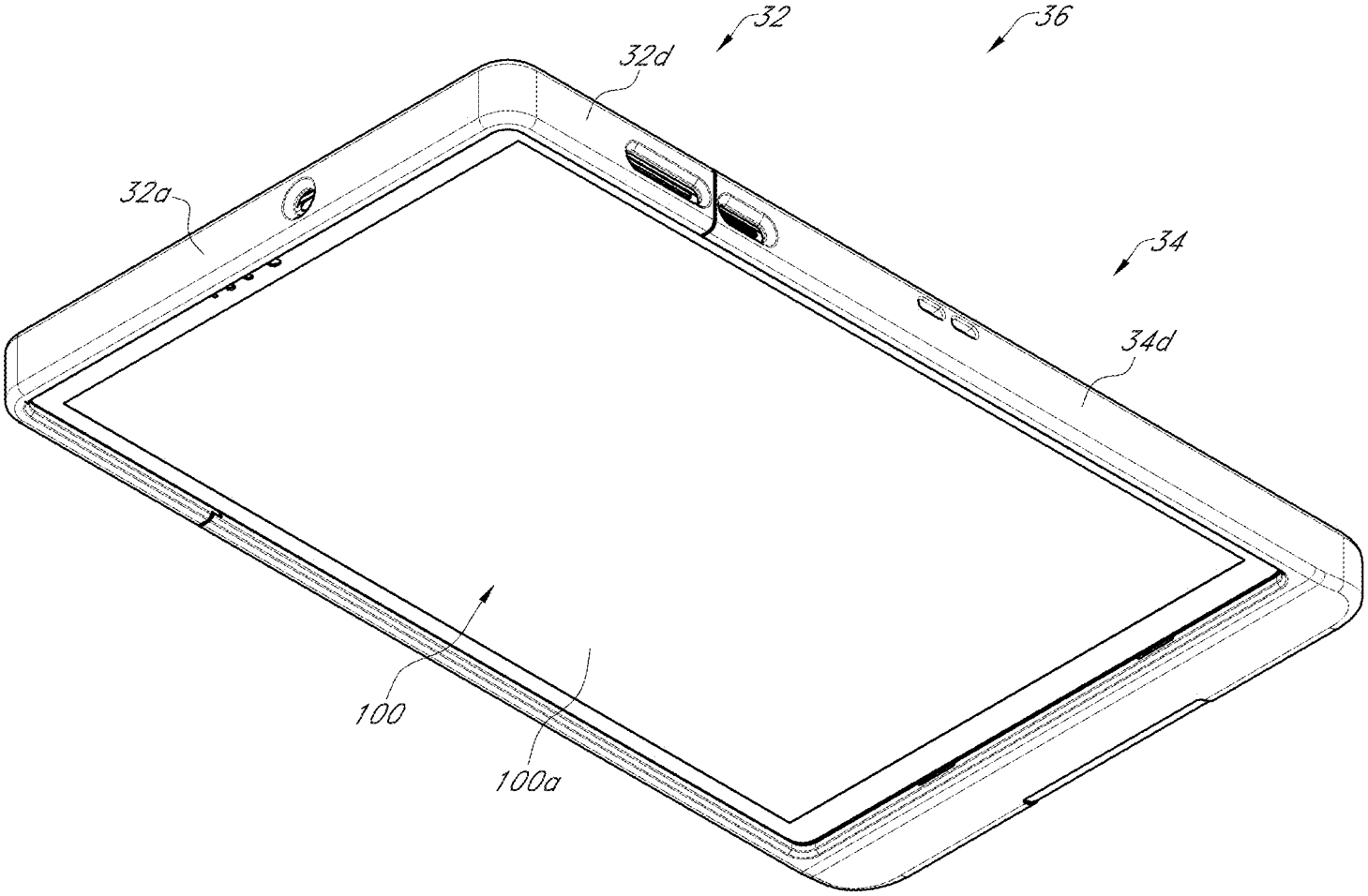
FIG. 57 is a front-rear perspective of a portion of the case assembly of FIG. 24 and the electronic device of FIG. 30.

Turning to FIG. 57, depicted therein is a front-rear perspective of a portion of device case assembly 30 and portable electronic device 100.

Figure 58:
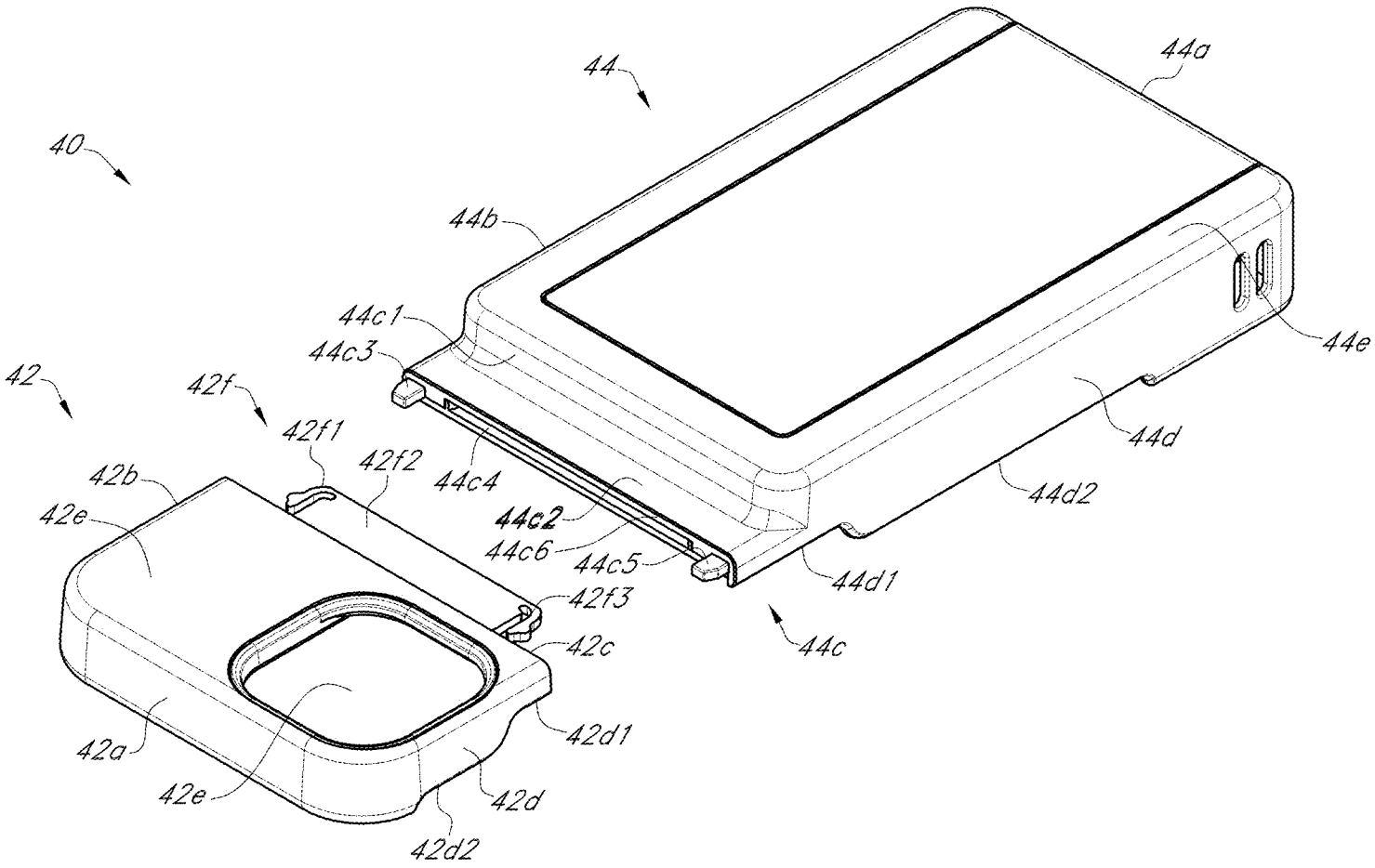
FIG. 58 is a partial-exploded-front-bottom-perspective view of a case assembly.

Turning to FIG. 58, depicted therein is a partial-exploded-front-bottom-perspective view of case assembly 40. Depicted implementation of case assembly 40 is shown to include cap assembly 42, and main assembly 44. Depicted implementation of cap assembly 42 is shown to include side wall 42*a*, side wall 42*b*, edge 42*c*, side wall 42*d*, aperture 42*e*, and tab member 42*f*. Depicted implementation of side wall 42*d* is shown to include recess 42*d*1, and recess 42*d*2. Depicted implementation of tab member 42*f* is shown to include tab body 42*f*2 with semi-flexible protrusion 42*f*1 and semi-flexible protrusion 42*f*3 extending therefrom. Depicted implementation of main assembly 44 is shown to include side wall 44*a*, side wall 44*b*, side assembly 44*c*, side wall 44*d*, and base 44*e*. Depicted implementation of side assembly 44*c* is shown to include side wall portion 44*c*1, extended portion 44*c*2, protrusion 44*c*3, aperture 44*c*4, protrusion 44*c*5, and edge 44*c*6. Depicted implementation of side wall 44*d* is shown to include recess 44*d*1, and recess 44*d*2.

Figure 59:
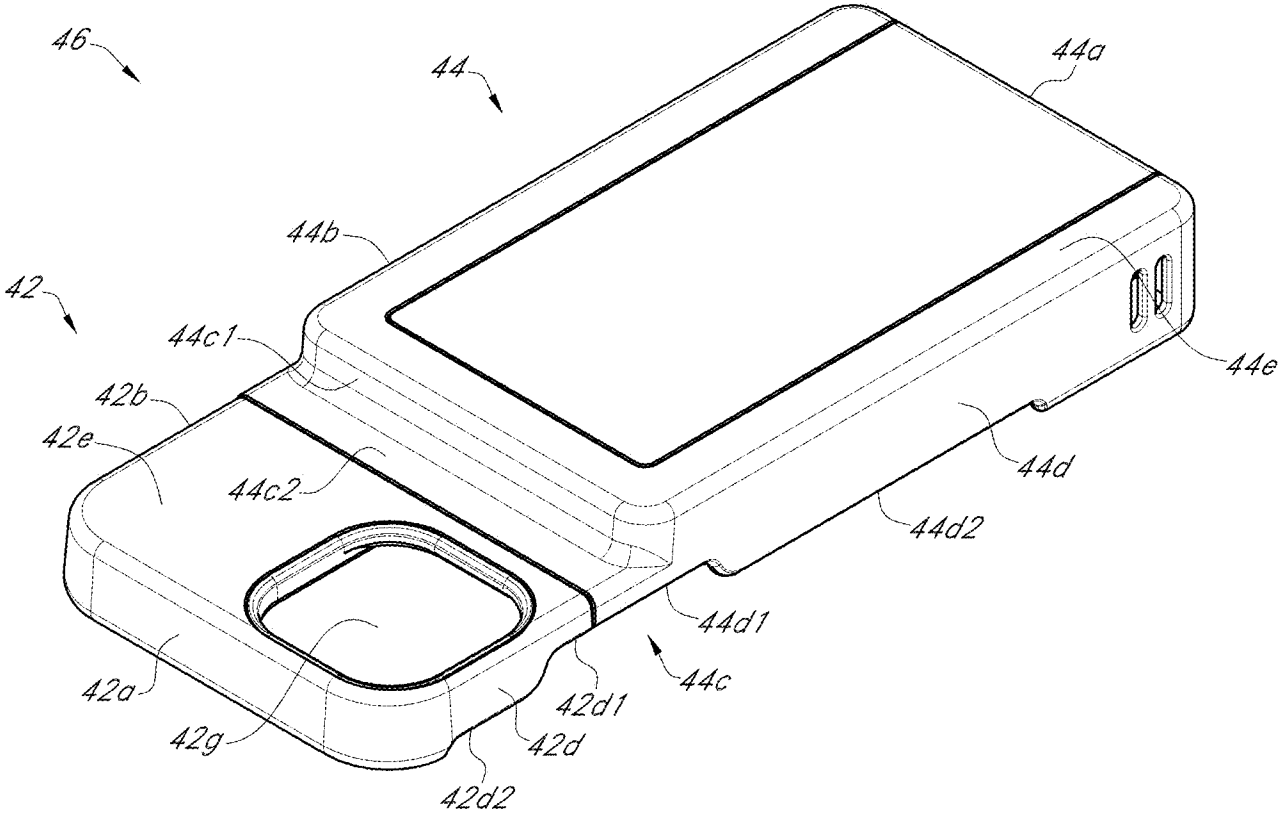
FIG. 59 is a front-bottom-perspective view of the case assembly of FIG. 58.

Turning to FIG. 59, depicted therein is a front-bottom-perspective view of case assembly 40.

Figure 60:
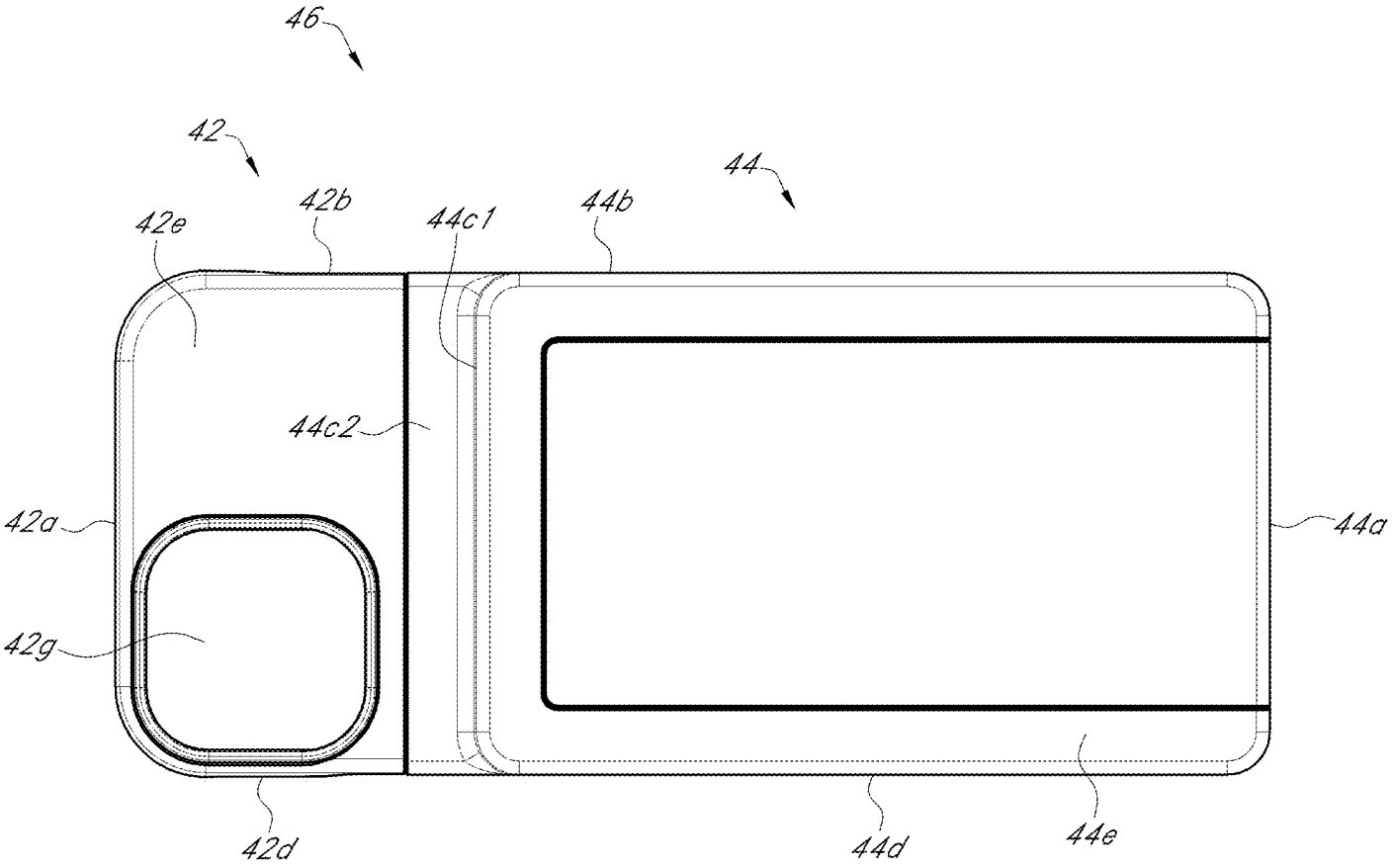
FIG. 60 is a bottom-plan view of the case assembly of FIG. 58.

Turning to FIG. 60, depicted therein is a bottom-plan view of case assembly 40.

Figure 61:
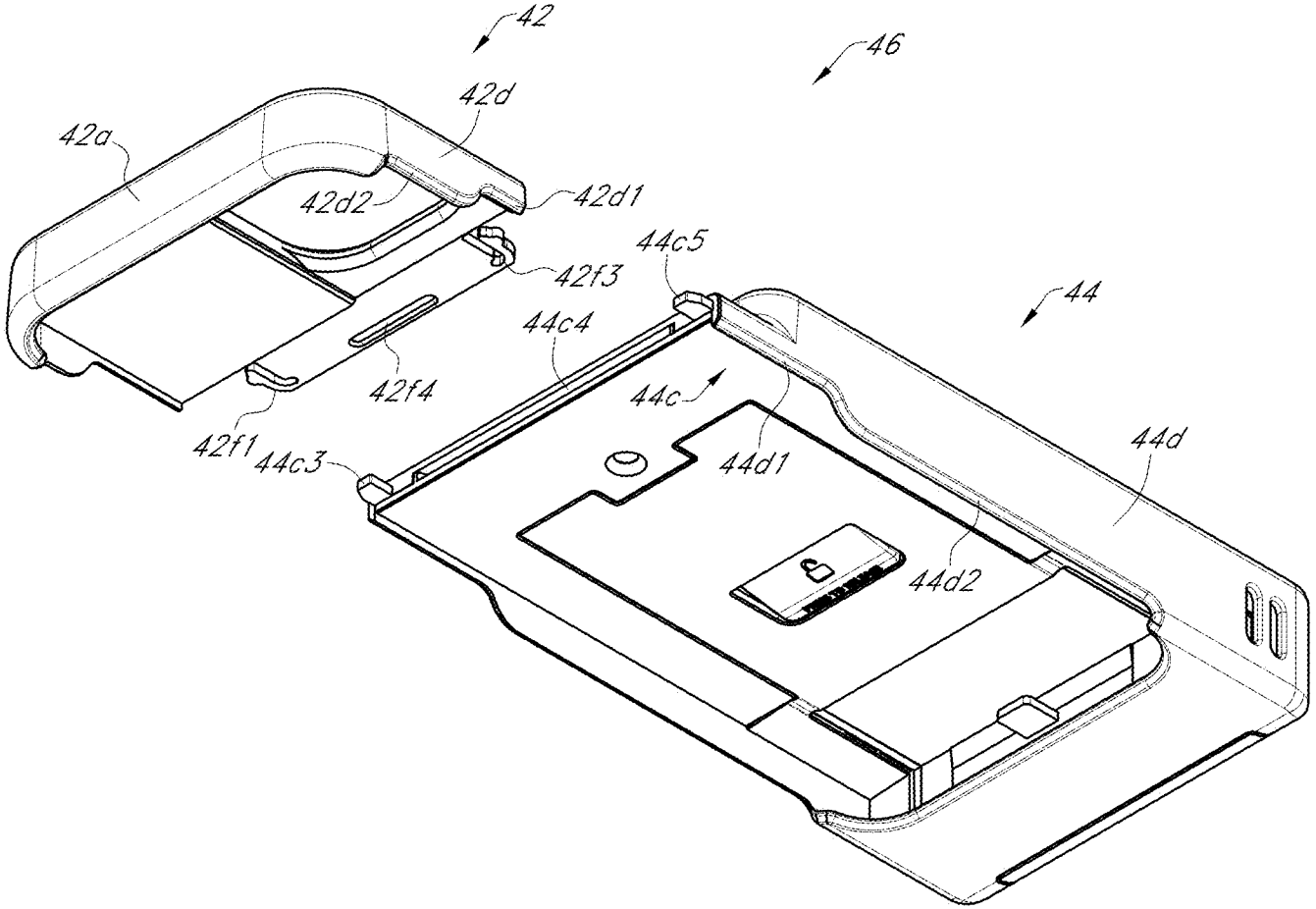
FIG. 61 is a partial-exploded-front-top-perspective view of the case assembly of FIG. 58.

Turning to FIG. 61, depicted therein is a partial-exploded-front-top-perspective view of case assembly 40. Depicted implementation of tab member 42*f* is shown to include recess 42*f*4.

Figure 62:
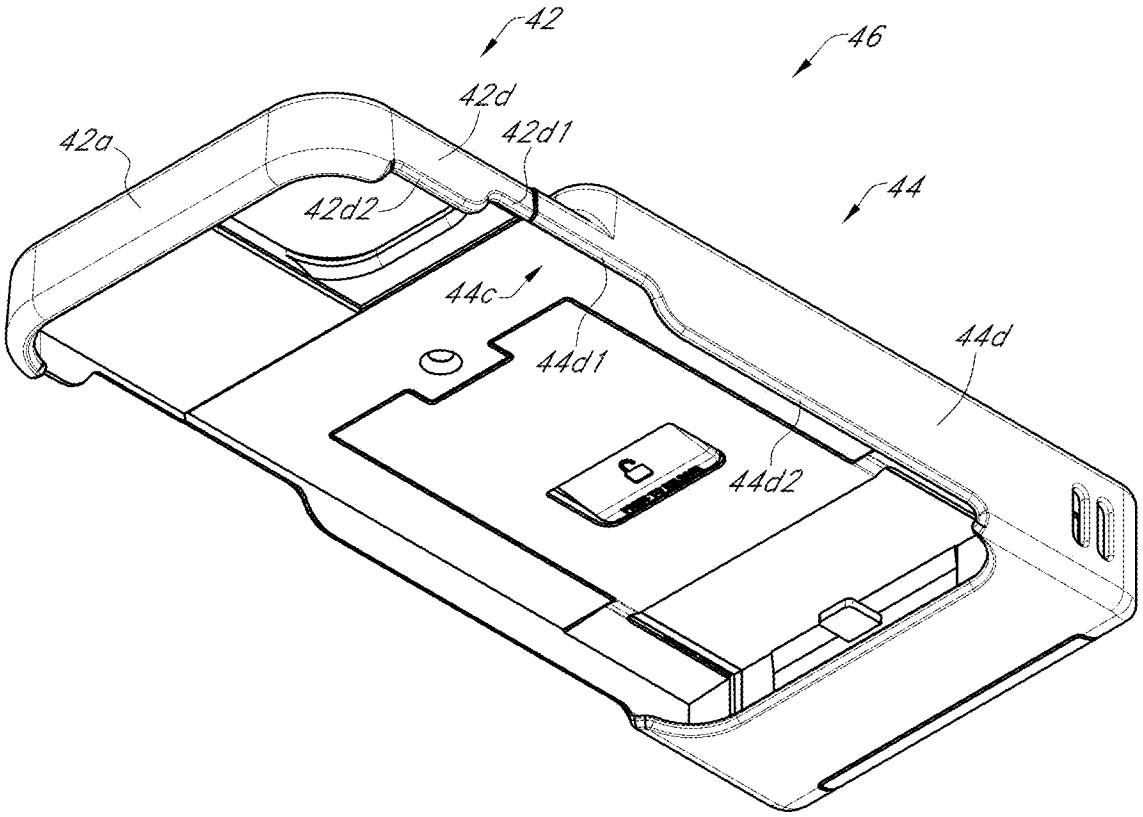
FIG. 62 is a front-top-perspective view of the case assembly of FIG. 58.

Turning to FIG. 62, depicted therein is a front-top-perspective view of case assembly 40.

Figure 63:
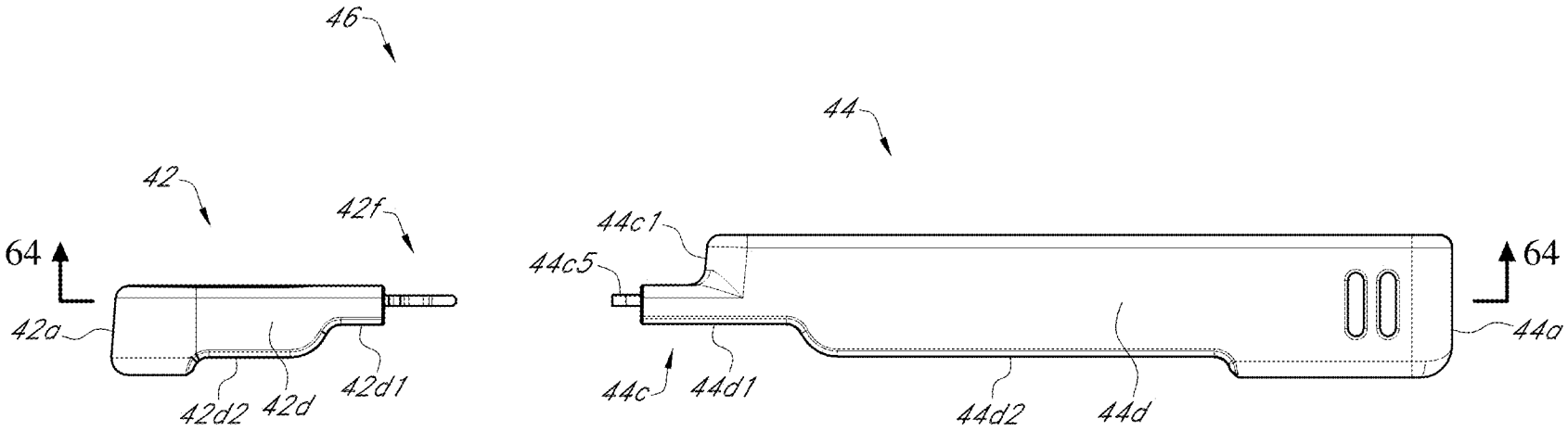
FIG. 63 is a partial-exploded-side-elevational view of the case assembly of FIG. 58.

Turning to FIG. 63, depicted therein is a partial-exploded-side-elevational view of case assembly 40.

Figure 64:
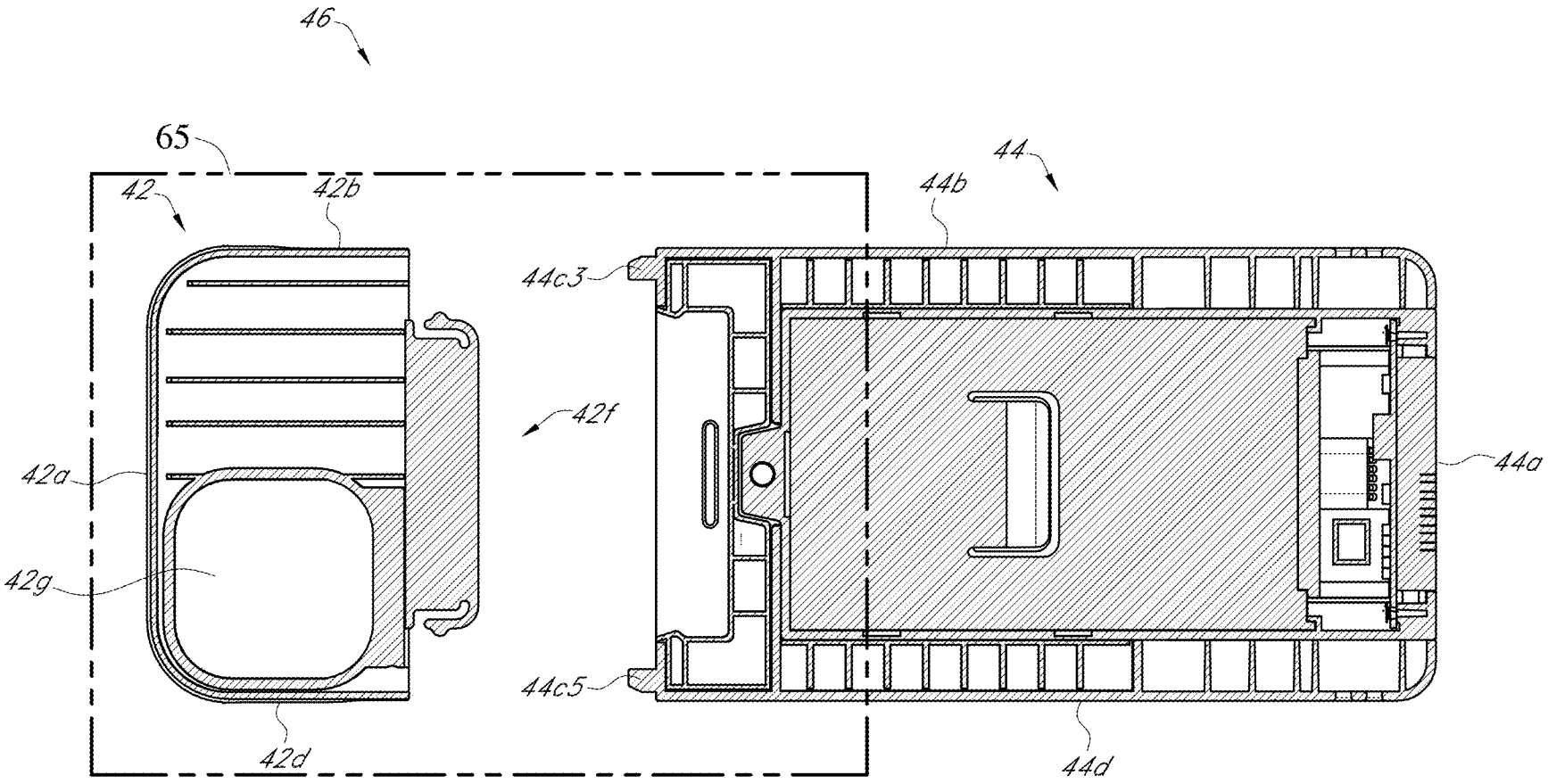
FIG. 64 is a partial-exploded-cross-sectional-bottom-plan view of the case assembly of FIG. 58 taken along the 64-64 cutline of FIG. 63.

Turning to FIG. 64, depicted therein is a partial-exploded-cross-sectional-bottom-plan view of case assembly 40 taken along the 64-64 cutline of FIG. 63.

Figure 65:
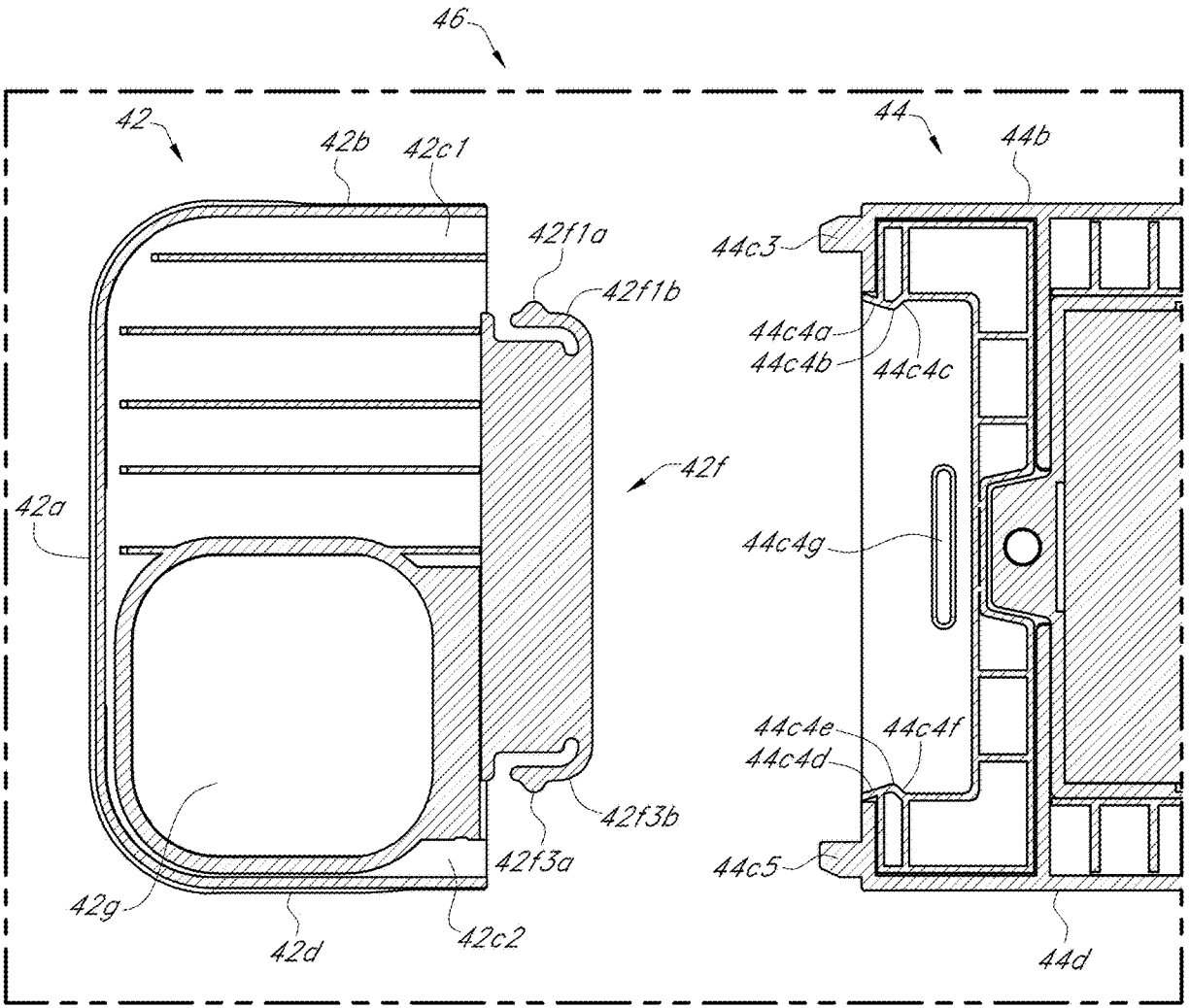
FIG. 65 is a portion of the partial-exploded-cross-sectional-bottom-plan view of the case assembly of FIG. 58 taken along the 65 dashed-line area of FIG. 64.

Turning to FIG. 65, depicted therein is a portion of the partial-exploded-cross-sectional-bottom-plan view of case assembly 40 taken along the 65 dashed-line area of FIG. 64. Depicted implementation of edge 42*c* is shown to include aperture 42*c*1, and aperture 42*c*2. Depicted implementation of tab member 42*f* is shown to include barb 42*f*1*a*, curvilinear member 42*f*1*b*, barb 42*f*3*a*, and curvilinear member 42*f*3*b*.

Depicted implementation of aperture 44*c*4 is shown to include front slope 44*c*4*a*, peak 44*c*4*b*, rear slope 44*c*4*c*, front slope 44*c*4*d*, peak 44*c*4*e*, rear slope 44*c*4*f*, and protrusion 44*c*4*g*. As depicted, aperture 44*c*4 is configured to receive semi-flexible protrusion 42*f*1, tab body 42*f*2, and semi-flexible protrusion 42*f*3 of tab member 42*f* when cap assembly 42 and main assembly 44 are coupled together.

Figure 66:
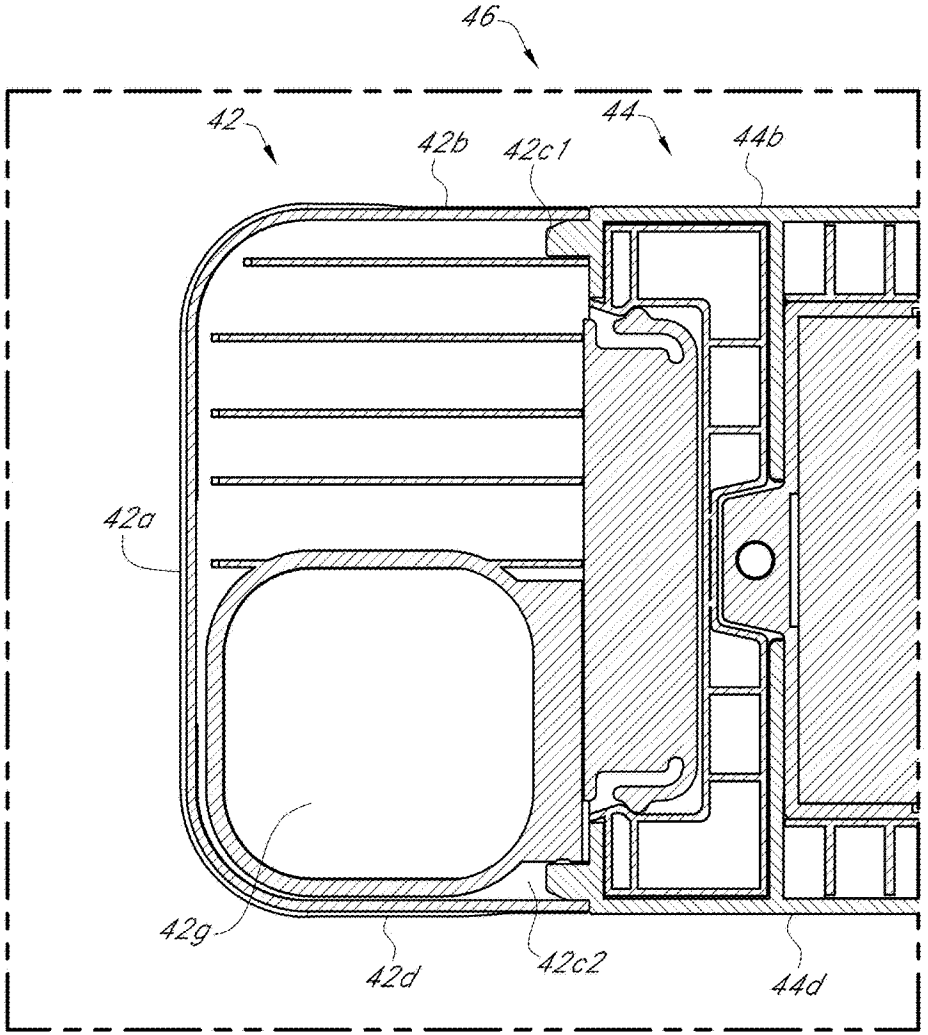
FIG. 66 is a cross-sectional-bottom-plan view of a portion of the case assembly of FIG. 58.

Turning to FIG. 66, depicted therein is a cross-sectional-bottom-plan view of a portion of case assembly 40.

Figure 67:
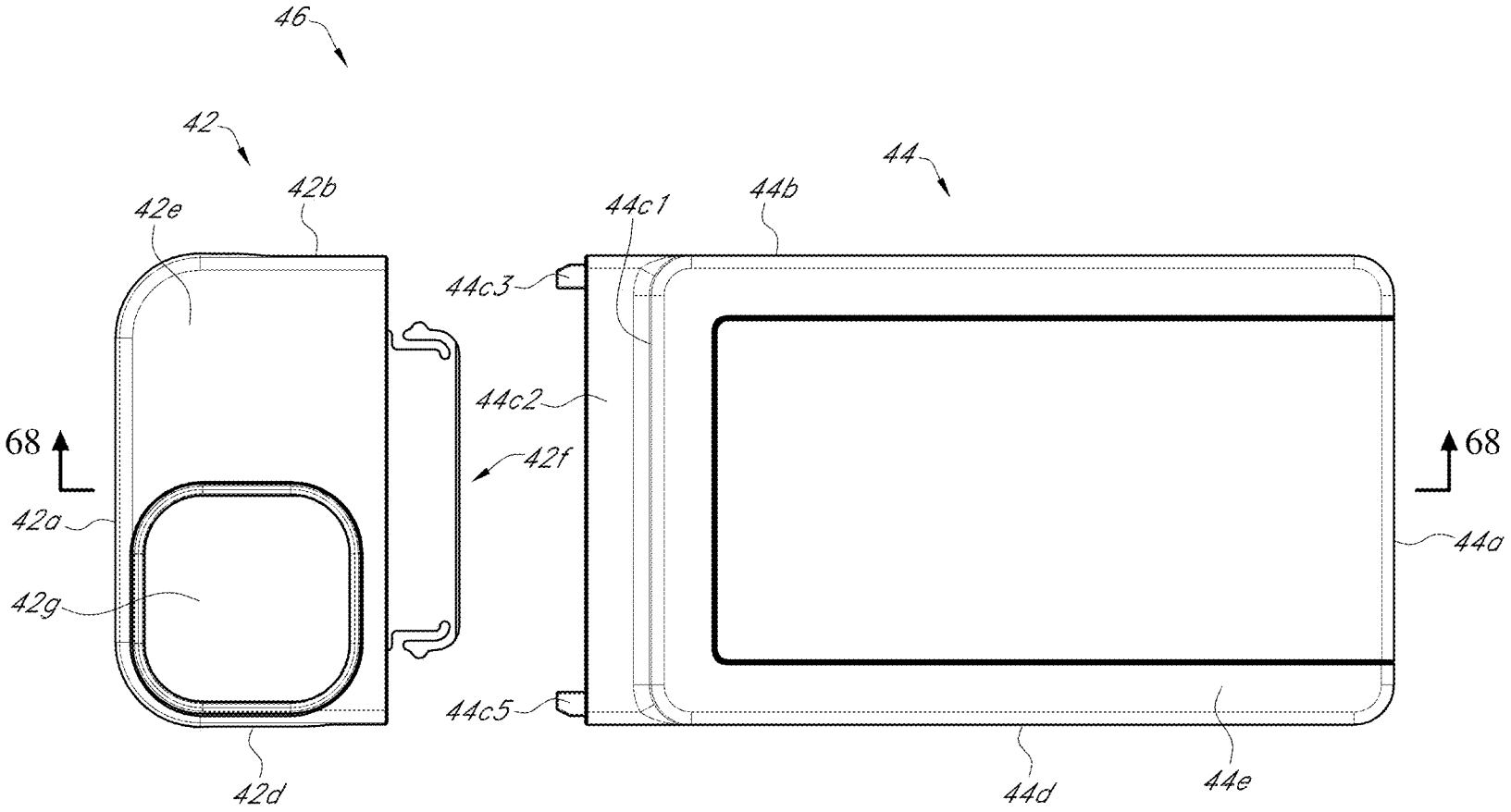
FIG. 67 is a portion of a bottom-plan view of the case assembly of FIG. 58 of FIG. 64.

Turning to FIG. 67, depicted therein is a portion of a bottom-plan view of case assembly 40.

Figure 68:
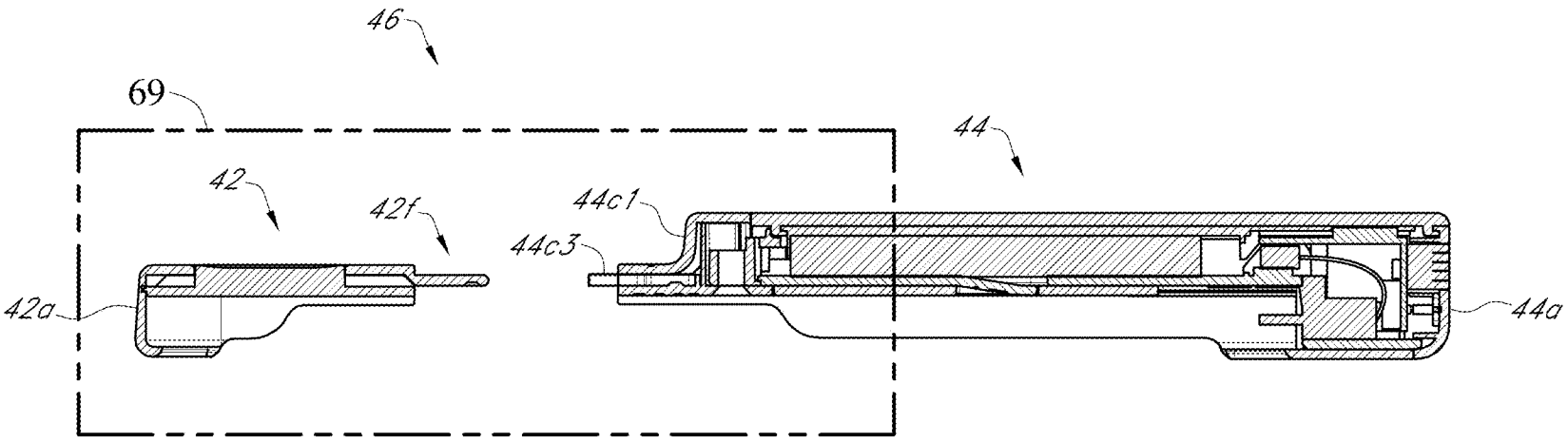
FIG. 68 is a partial-exploded-cross-sectional-side-elevational view of the case assembly of FIG. 58 taken along the 68-68 cutline of FIG. 67.

Turning to FIG. 68, depicted therein is a partial-exploded-cross-sectional-side-elevational view of case assembly 40 taken along the 68-68 cutline of FIG. 67.

Figure 69:
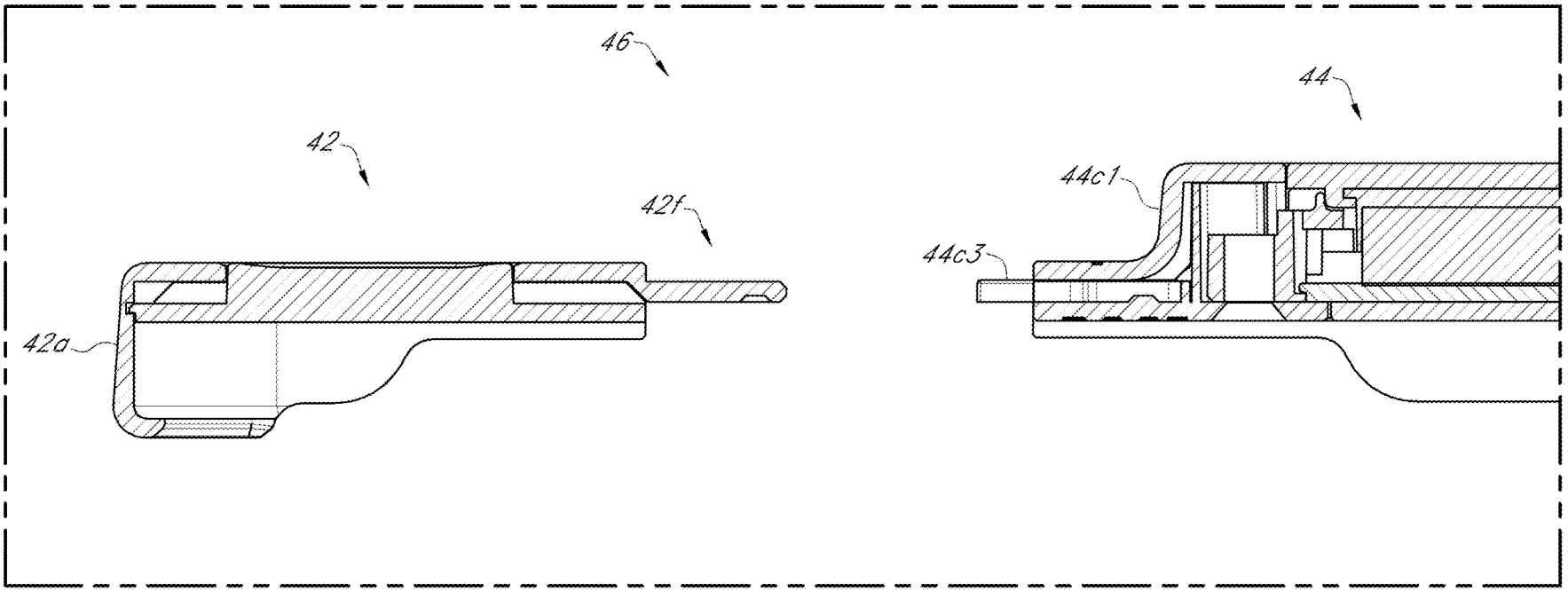
FIG. 69 is a portion of the partial-exploded-cross-sectional-side-elevational view of the case assembly of FIG. 58 taken along the 69 dashed-line area of FIG. 68.

Turning to FIG. 69, depicted therein is a portion of the partial-exploded-cross-sectional-side-elevational view of case assembly 40 taken along the 69 dashed-line area of FIG. 68.

Figure 70:
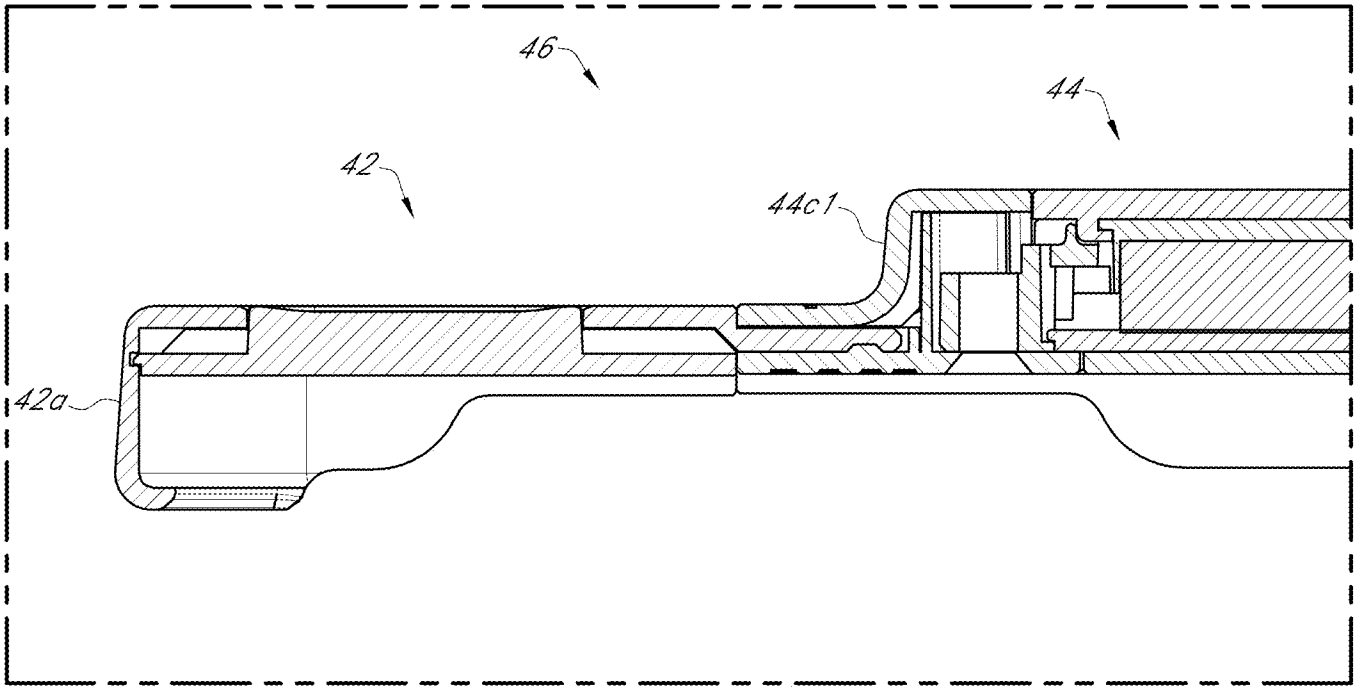
FIG. 70 is a portion of a cross-sectional-side-elevational view of the case assembly of FIG. 58.

Turning to FIG. 70, depicted therein is a portion of a cross-sectional-side-elevational view of case assembly 40.

Figure 71:
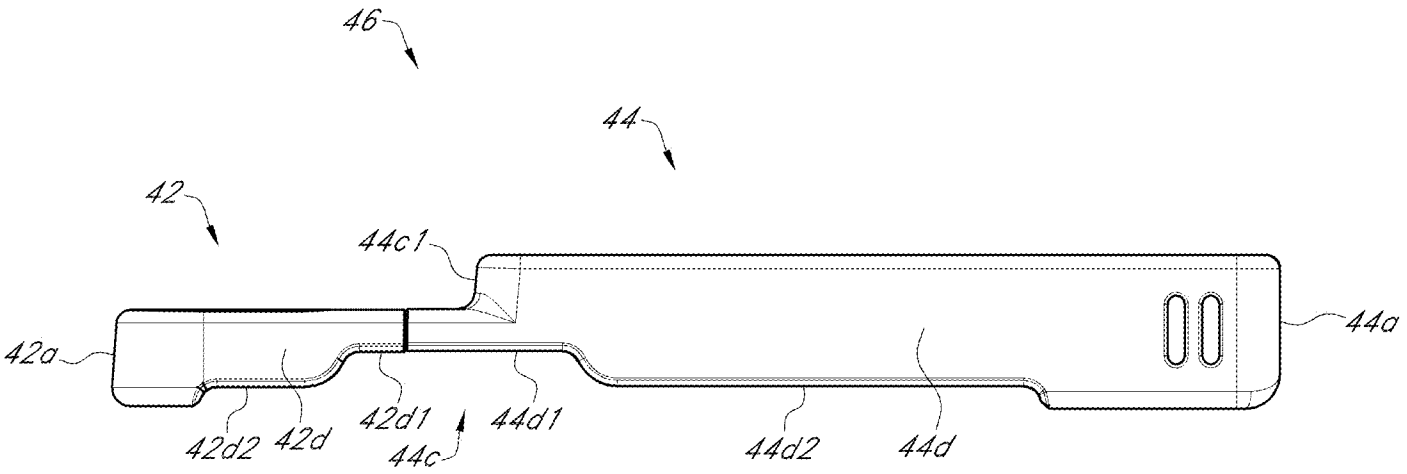
FIG. 71 is a side-elevational view of the case assembly of FIG. 58.

Turning to FIG. 71, depicted therein is a side-elevational view of case assembly 40.

Figure 72:
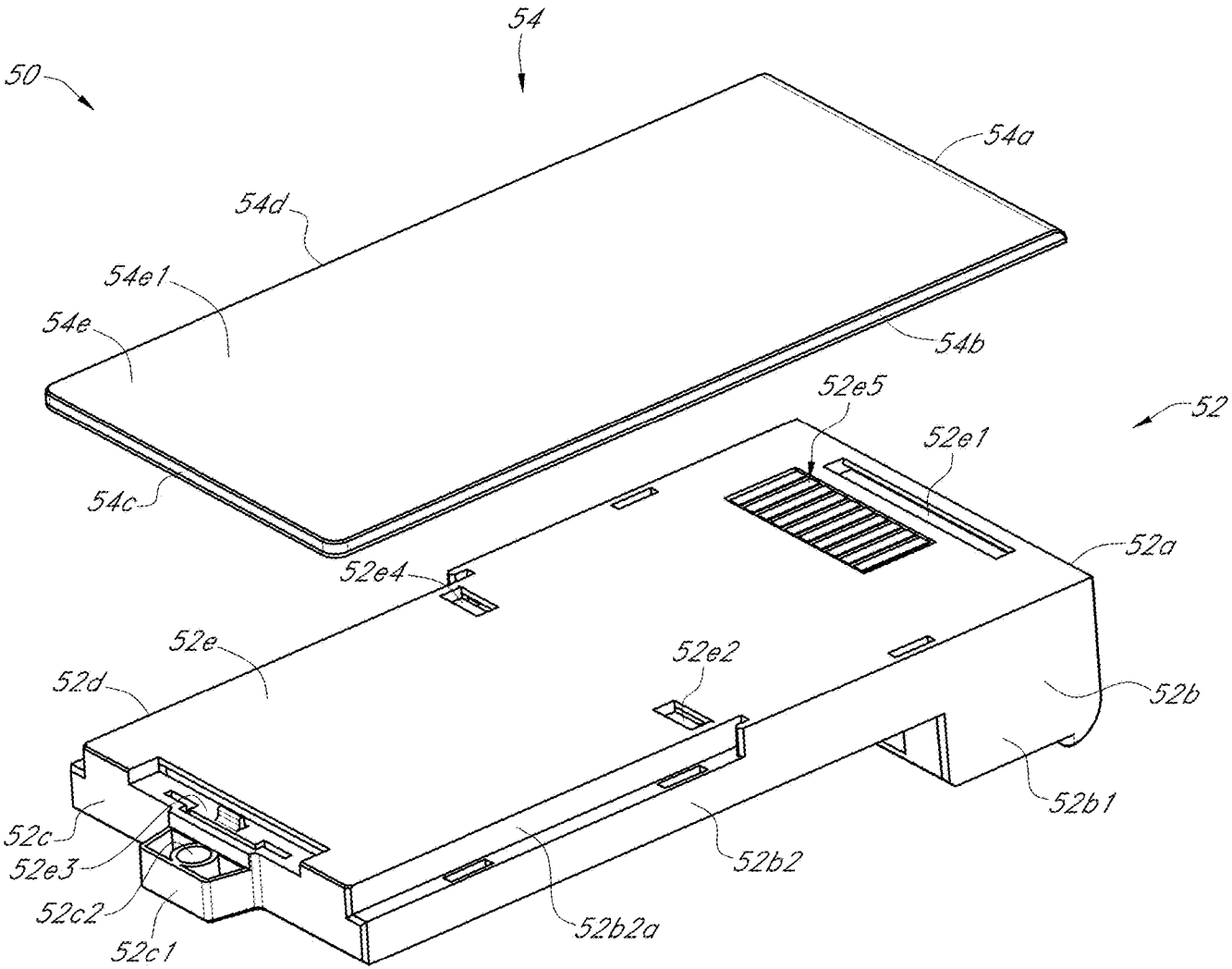
FIG. 72 is an exploded front-bottom-perspective view of an accessory assembly.

Turning to FIG. 72, depicted therein is an exploded front-bottom-perspective view of accessory assembly 50. Depicted implementation of accessory assembly 50 is shown to include main assembly 52, and cover assembly 54. Depicted implementation of main assembly 52 is shown to include side 52*a*, side 52*b*, side 52*c*, side 52*d*, and back side 52*e*. Depicted implementation of side 52*b* is shown to include base portion 52*b*1, extended portion 52*b*2, and elongated groove 52*b*2*a*, which can be seen as having an L-shaped side profile. Depicted implementation of side 52*c* is shown to include protrusion 52*c*1, and aperture 52*c*2. Depicted implementation of back side 52*e* is shown to include notch 52*e*1, notch 52*e*2, notch 52*e*3, notch 52*e*4, and electric contacts interface 52*e*5. Depicted implementation of cover assembly 54 is shown to include side 54*a*, side 54*b*, side 54*c*, side 54*d*, base 54*e*, and exterior side 54*e*1. In implementations, accessory assembly 50 can include various service functions for portable electronic device 100 such as storage of electrical power and electronic-based communication.

Figure 73:
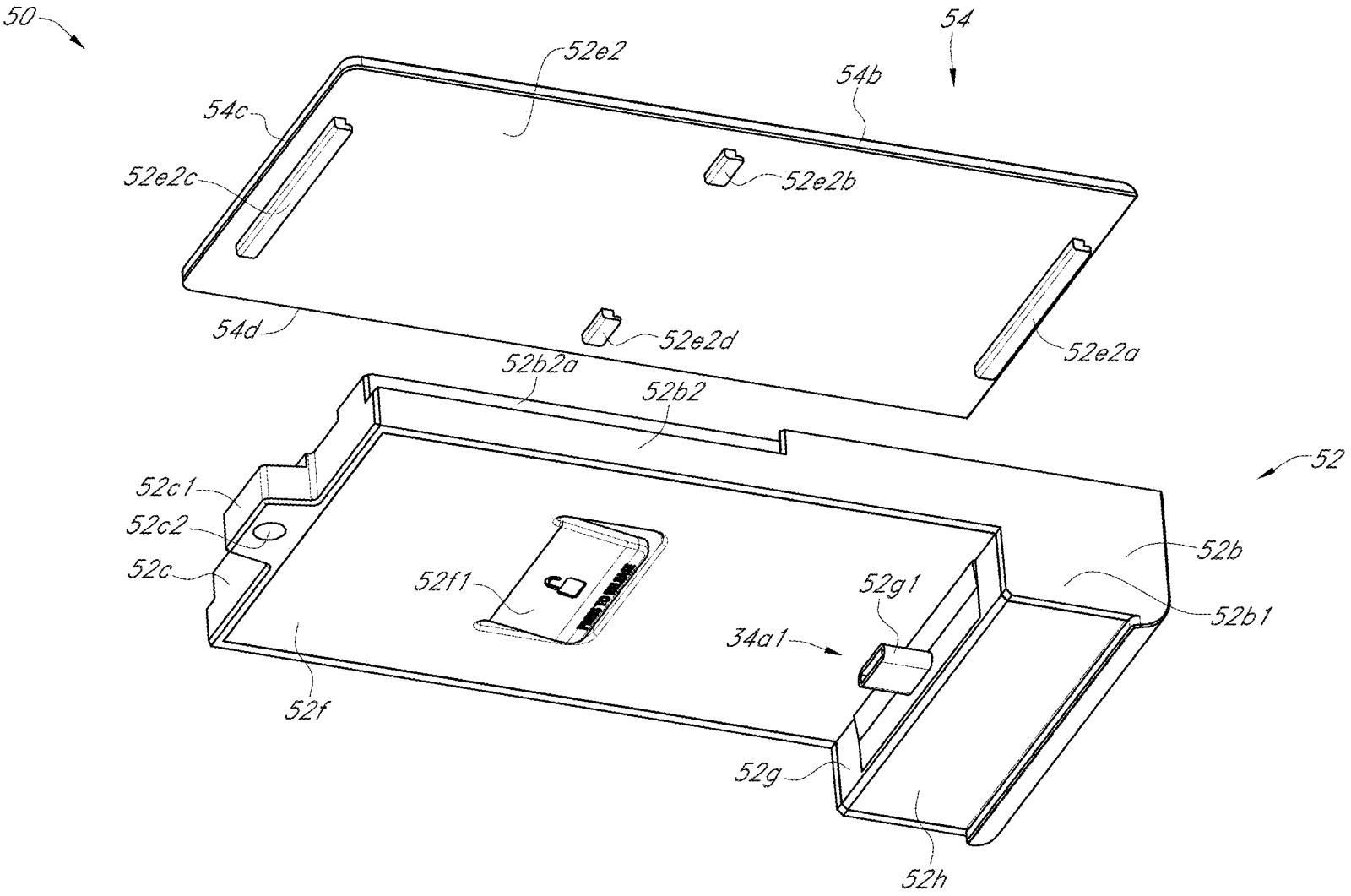
FIG. 73 is an exploded front-top-perspective view of the accessory assembly of FIG. 72.

Turning to FIG. 73, depicted therein is an exploded front-top-perspective view of accessory assembly 50. Depicted implementation of back side 52*e* is shown to include notch 52*e*2, protrusion 52*e*2*a*, protrusion 52*e*2*b*, protrusion 52*e*2*c*, and protrusion 52*e*2*d*. Depicted implementation of main assembly 52 is shown to include front portion 52*f* with hinged tab 52*f*1, coupling side 52*g* with electric plug 52*g*1, and front portion 52*h*.

Figure 74:
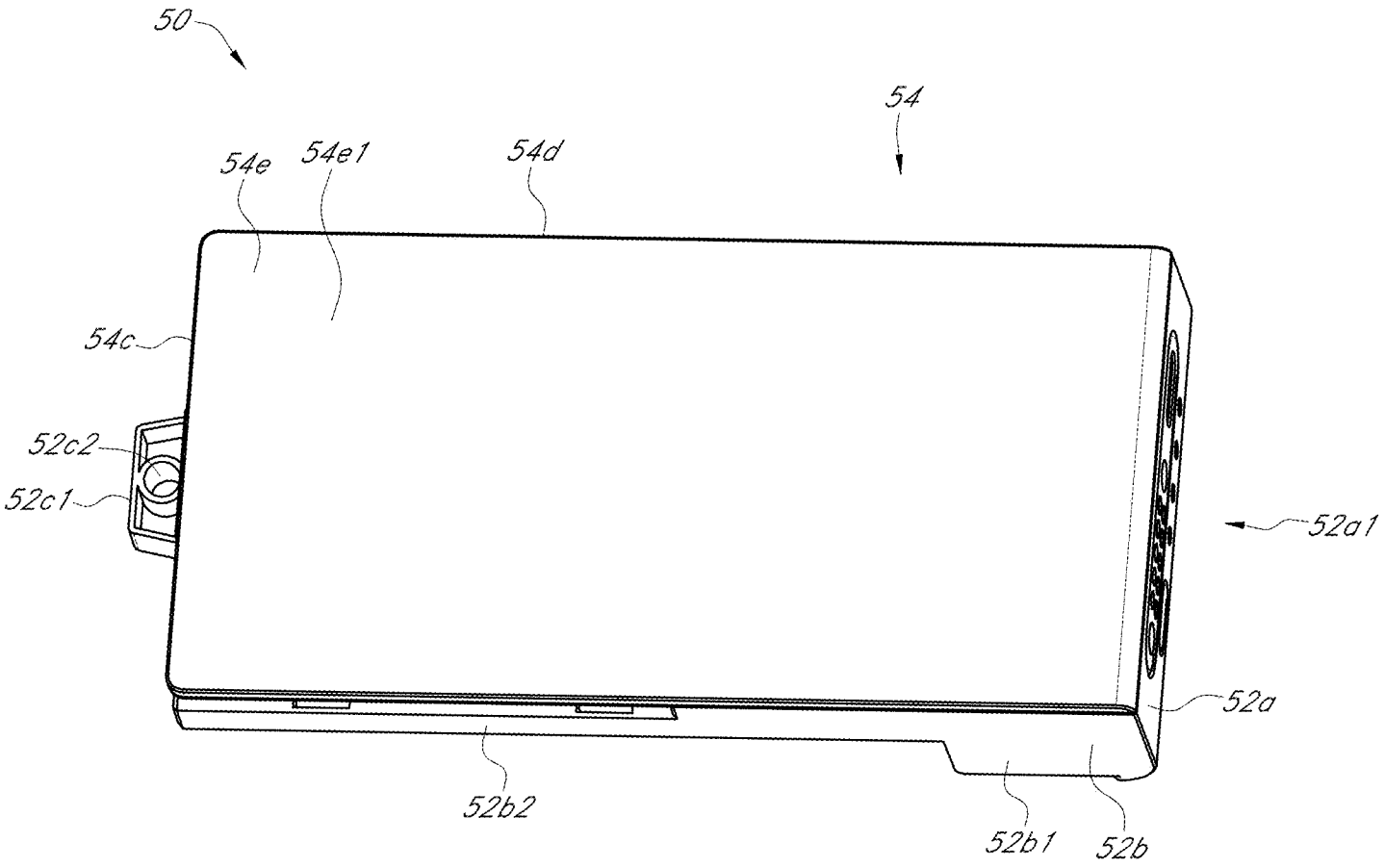
FIG. 74 is a bottom-perspective view of the accessory assembly of FIG. 72.

Turning to FIG. 74, depicted therein is a bottom-perspective view of accessory assembly 50. Depicted implementation of main assembly 52 is shown to include exterior electric interface 52*al*.

Figure 75:
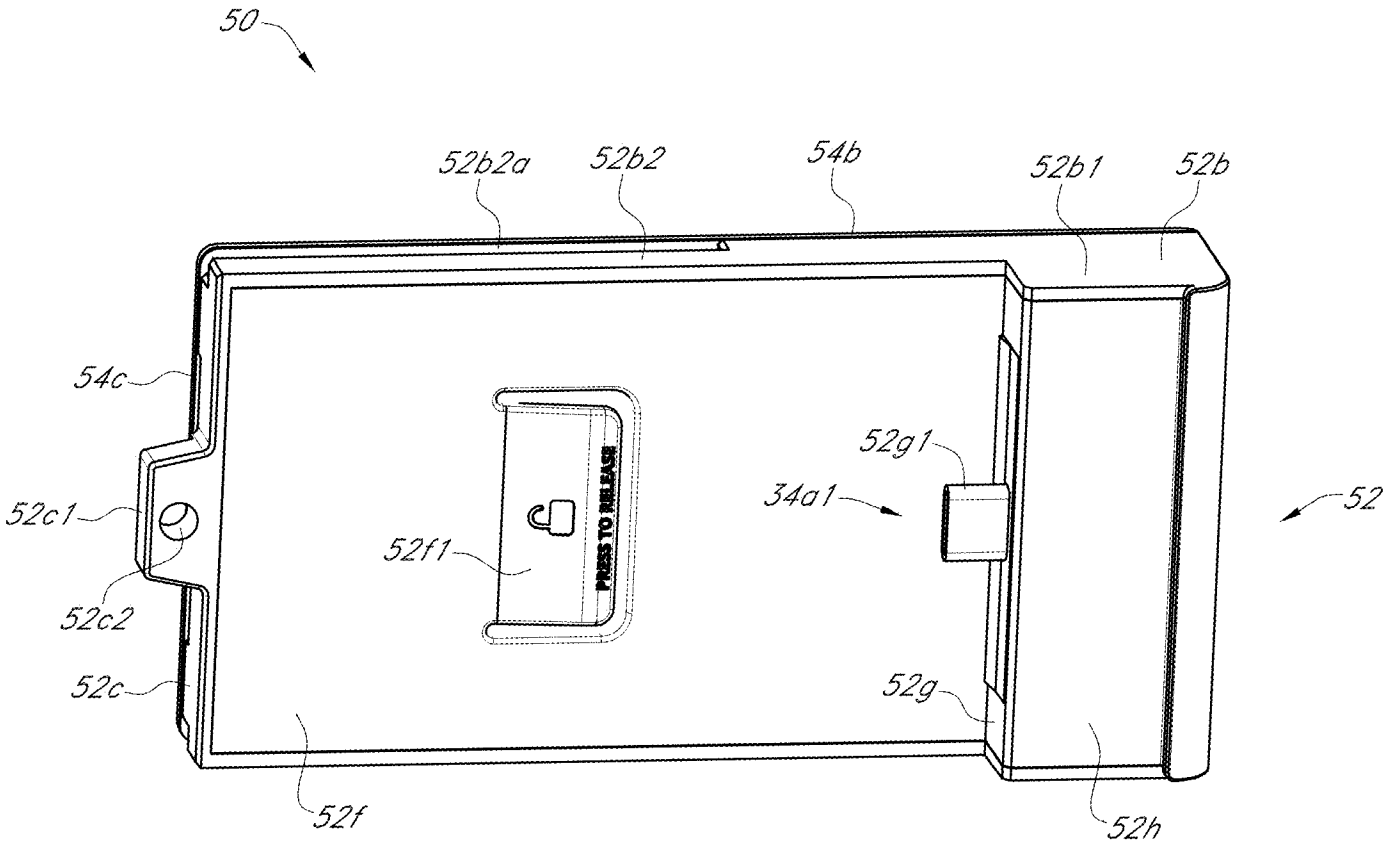
FIG. 75 is a top-perspective view of the accessory assembly of FIG. 72.

Turning to FIG. 75, depicted therein is a top-perspective view of accessory assembly 50.

Figure 76:
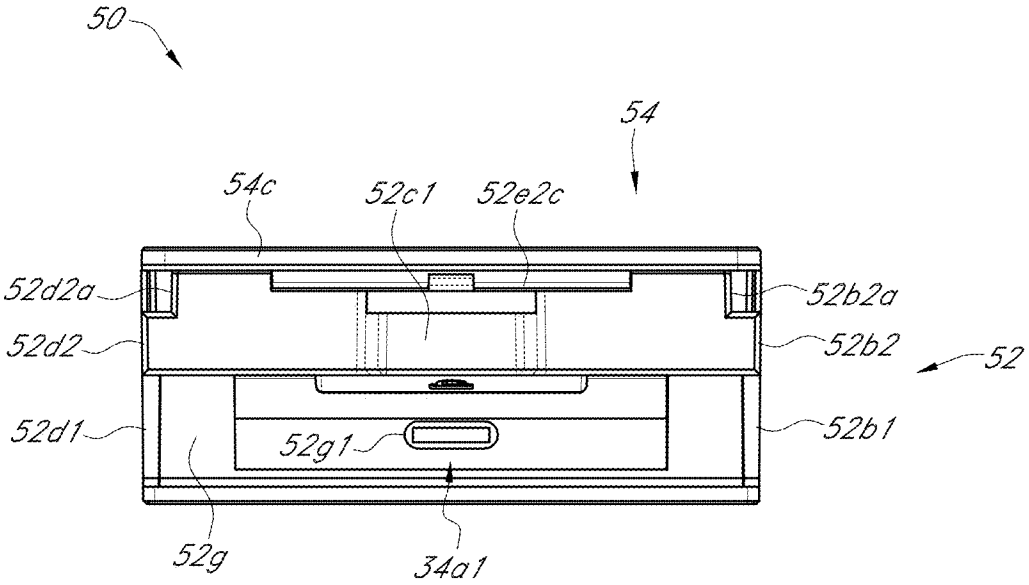
FIG. 76 is a front-elevational view of the accessory assembly of FIG. 72.

Turning to FIG. 76, depicted therein is a front-elevational view of accessory assembly 50. Depicted implementation of main assembly 52 is shown to include base portion 52*d*1, extended portion 52*d*2, and elongated groove 52*d*2*a*.

Figure 77:
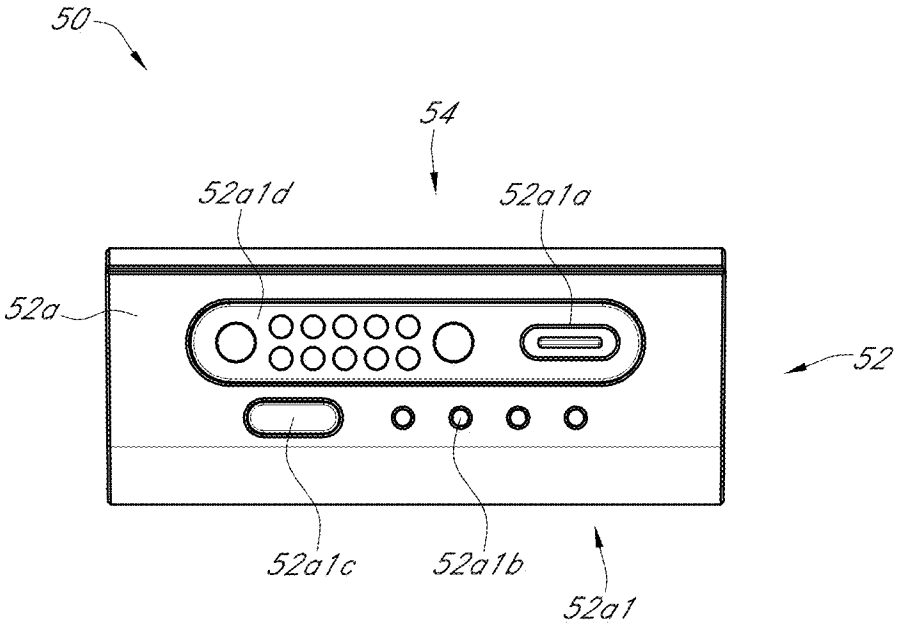
FIG. 77 is a rear-elevational view of the accessory assembly of FIG. 72.

Turning to FIG. 77, depicted therein is a rear-elevational view of accessory assembly 50. Depicted implementation of exterior electric interface 52*a*1 is shown to include interface portion 52*a*1*a*, interface portion 52*a*1*b*, interface portion 52*a*1*c*, and interface portion 52*a*1*d*.

Figure 78:
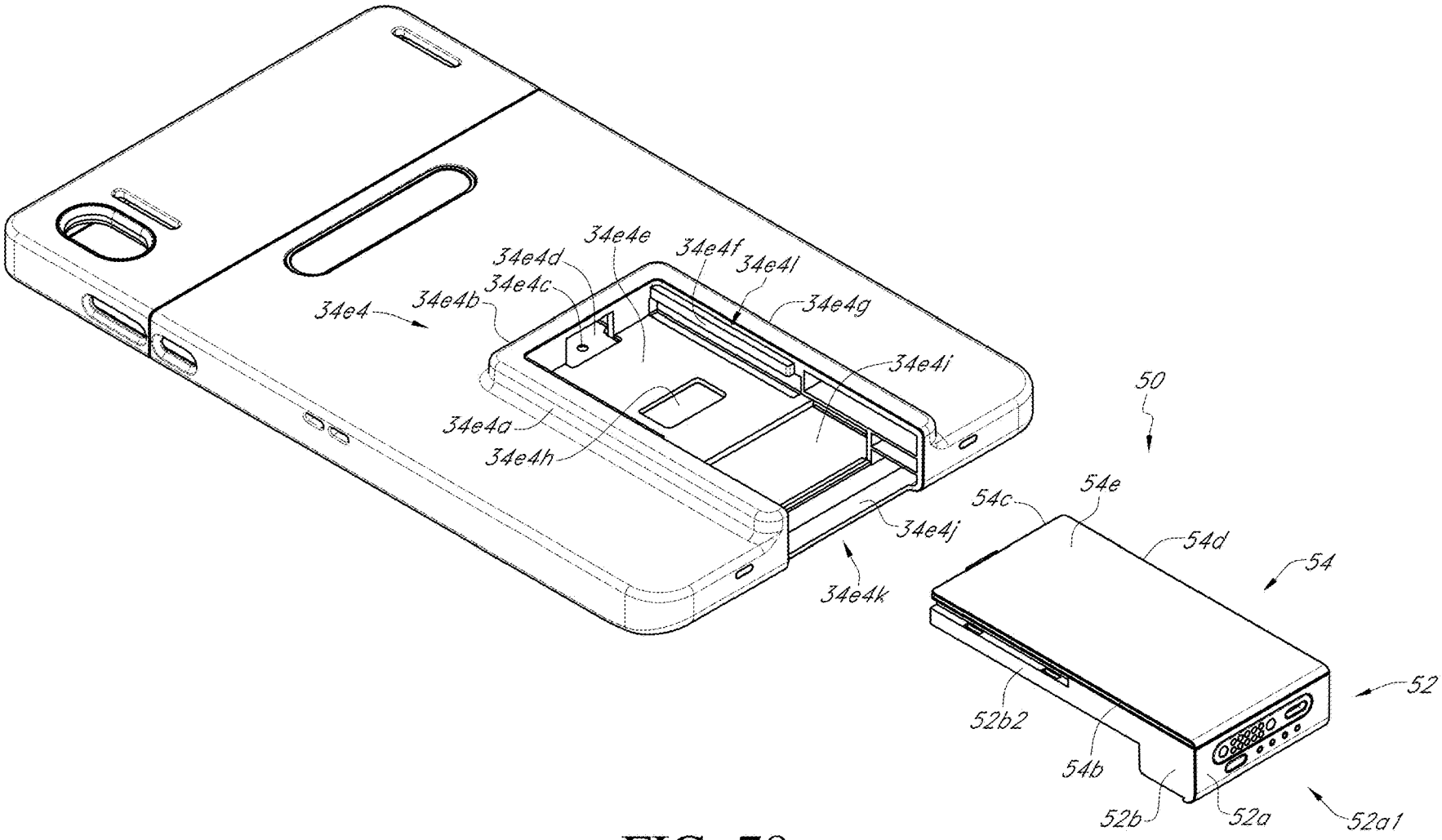
FIG. 78 is a rear-bottom perspective view of the accessory assembly of FIG. 72 uncoupled from the case assembly of FIG. 24.

Turning to FIG. 78, depicted therein is a rear-bottom perspective view of accessory assembly 50 uncoupled from device case assembly 30. Depicted implementation of coupler assembly 34*e*4 is shown to include side wall 34*e*4*a*, side wall 34*e*4*b*, aperture 34*e*4*c*, aperture 34*e*4*d*, raised base portion 34*e*4*e*, elongated protrusion 34*e*4*f*, side wall 34*e*4*g*, aperture 34*e*4*h*, aperture 34*e*4*i*, recessed base portion 34*e*4*j*, opening 34*e*4*k*, and interior area 34*e*4*l*. As depicted, interior area 34*e*4*l* is in part bounded by side wall 34*e*4*a*, side wall 34*e*4*b*, raised base portion 34*e*4*e*, side wall 34*e*4*g*, and recessed base portion 34*e*4*j* to couple with accessory assembly 50.

Figure 79:
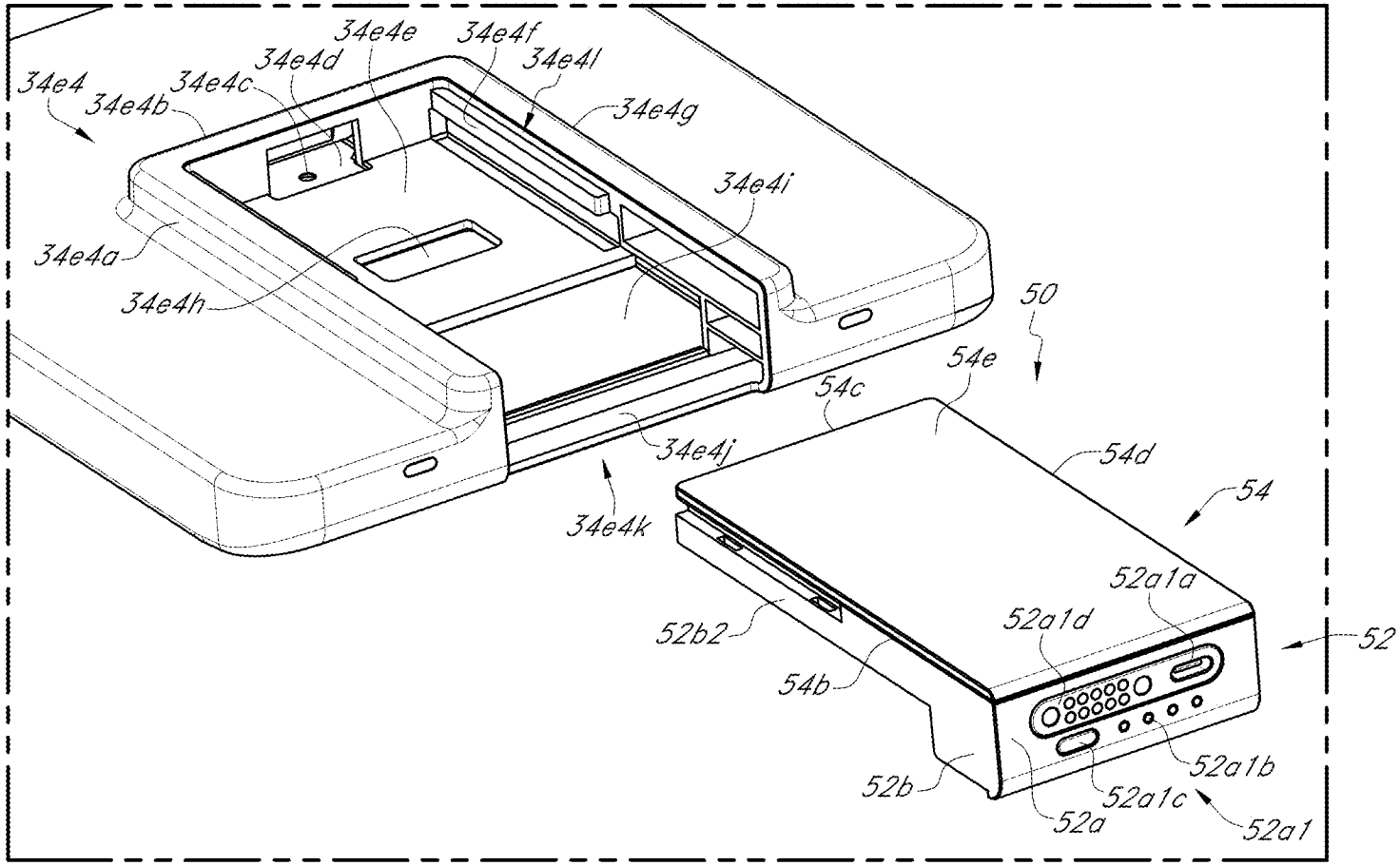
FIG. 79 is a rear-bottom perspective view of the accessory assembly of FIG. 72 uncoupled from a portion of the case assembly of FIG. 24.

Turning to FIG. 79, depicted therein is a rear-bottom perspective view of accessory assembly 50 uncoupled from a portion of device case assembly 30.

Figure 80:
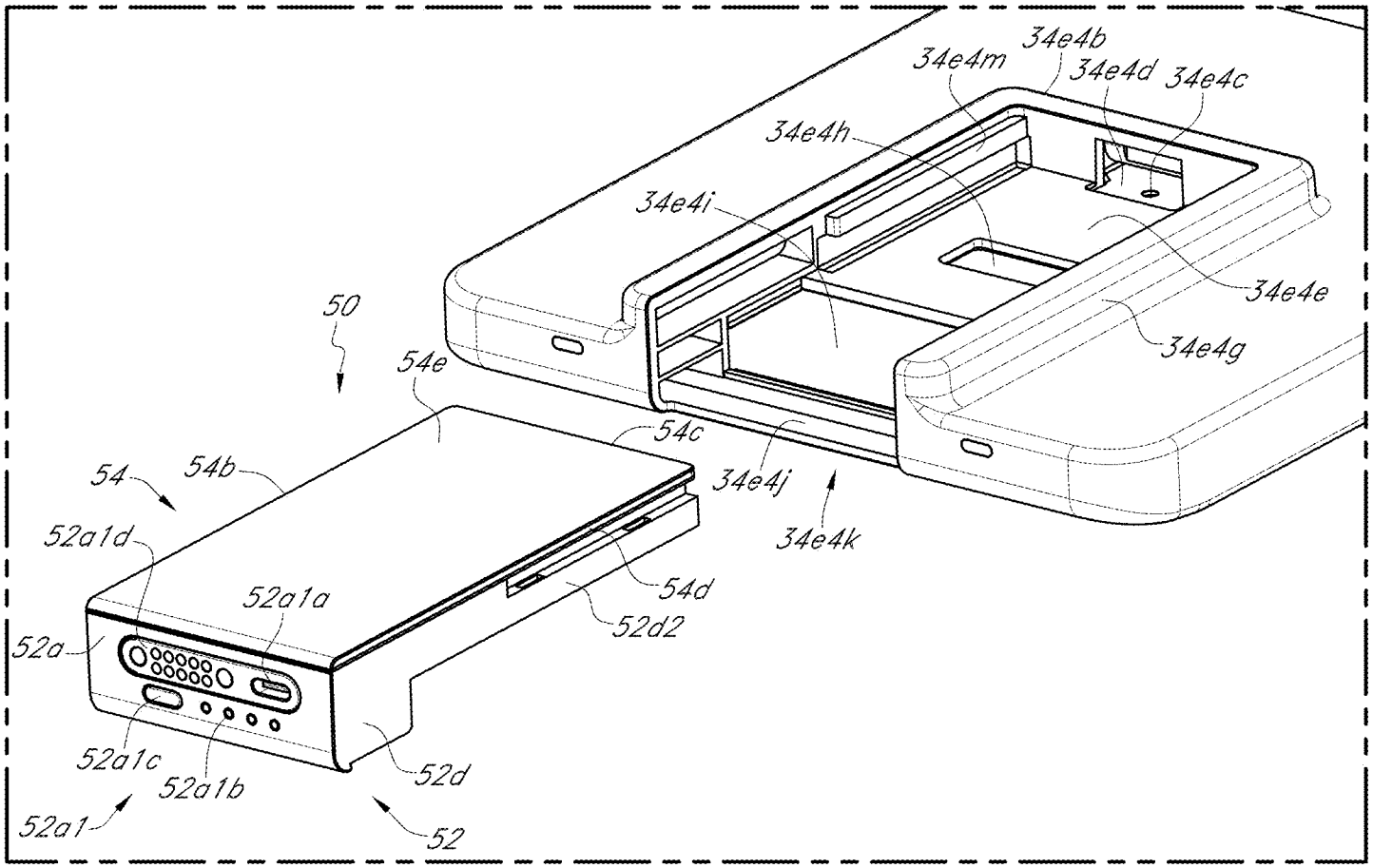
FIG. 80 is a rear-bottom perspective view of the accessory assembly of FIG. 72 uncoupled from a portion of the case assembly of FIG. 24.

Turning to FIG. 80, depicted therein is a rear-bottom perspective view of accessory assembly 50 uncoupled from a portion of device case assembly 30. Depicted implementation of coupler assembly 34*e*4 is shown to include elongated protrusion 34*e*4*m*.

Figure 81:
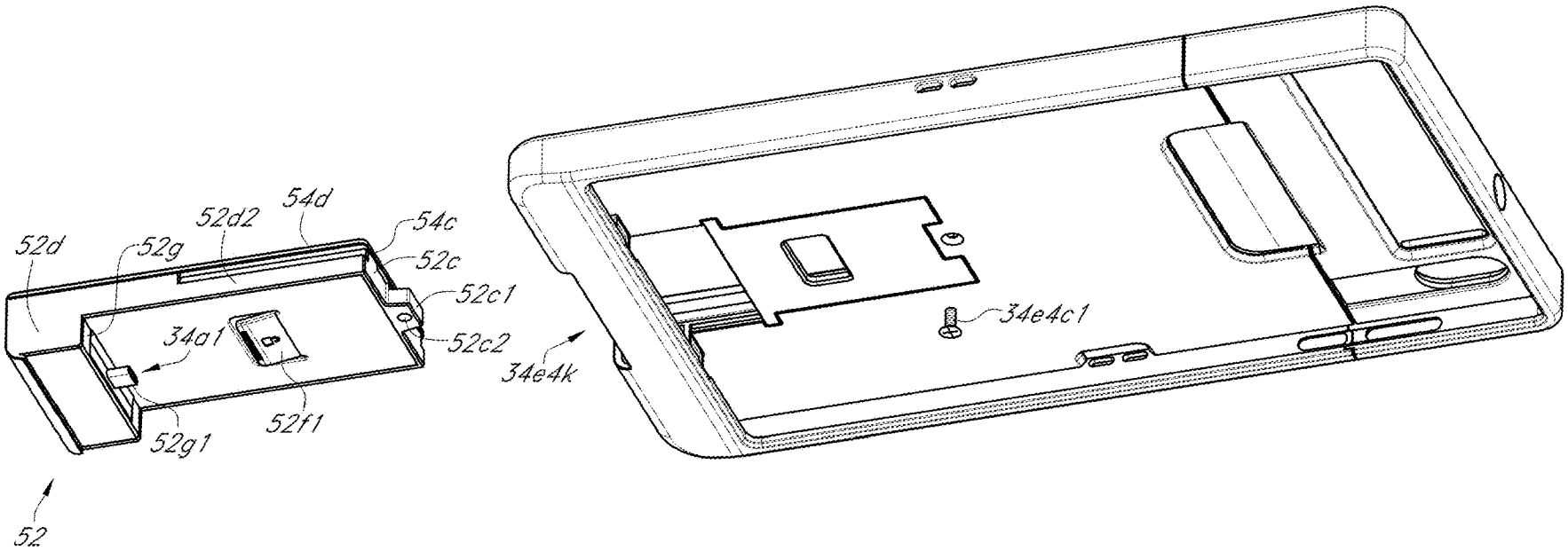
FIG. 81 is a front-top perspective view of the accessory assembly of FIG. 72 uncoupled from the case assembly of FIG. 24.

Turning to FIG. 81, depicted therein is a front-top perspective view of accessory assembly 50 uncoupled from device case assembly 30. Depicted implementation of aperture 34*e*4*c* is shown to include threaded coupler 34*e*4*c*1.

Figure 82:
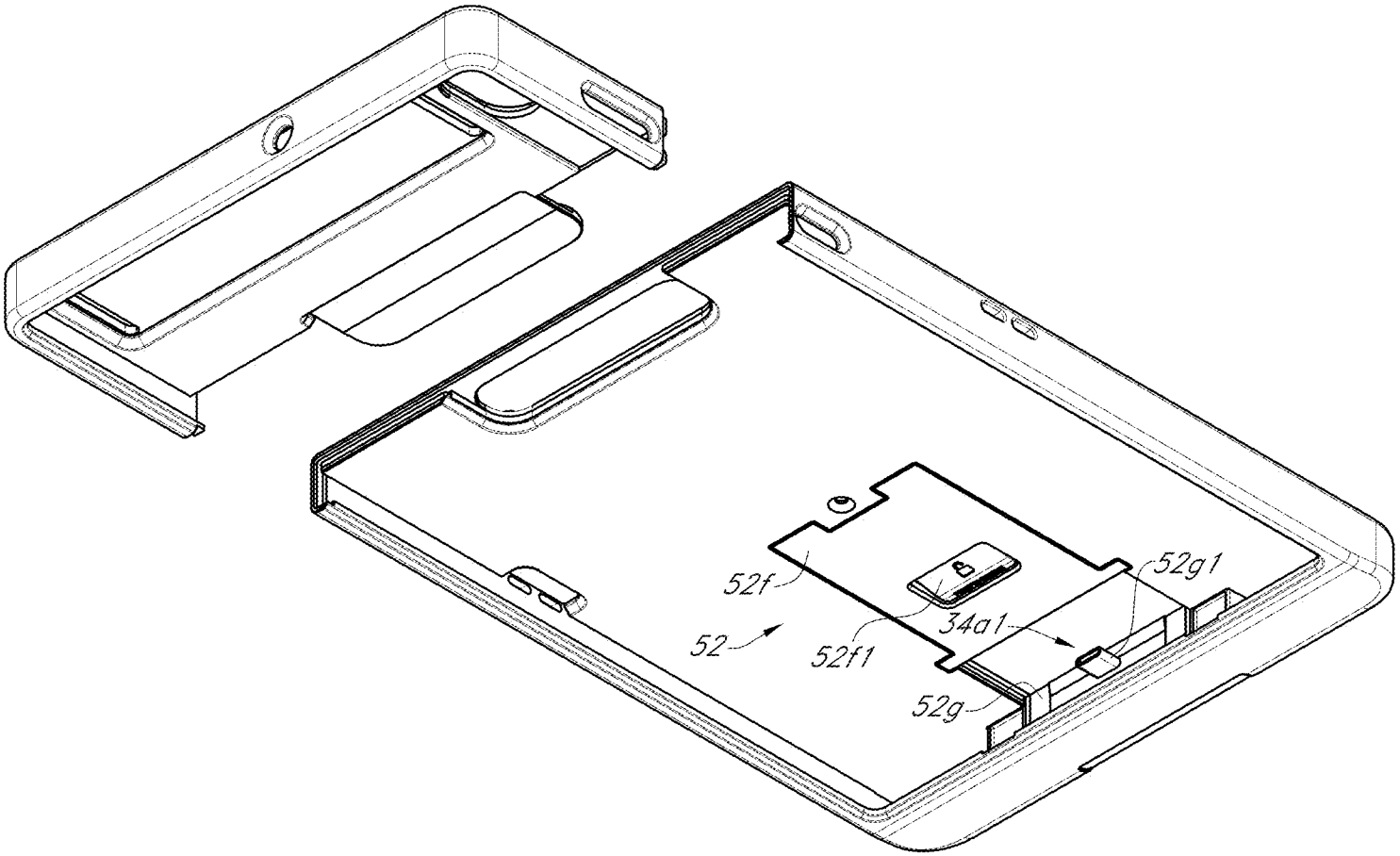
FIG. 82 is a front-top perspective view of the accessory assembly of FIG. 72 coupled with a portion of an exploded view of the case assembly of FIG. 24.

Turning to FIG. 82, depicted therein is a front-top perspective view of accessory assembly 50 coupled with a portion of an exploded view of device case assembly 30.

Figure 83:
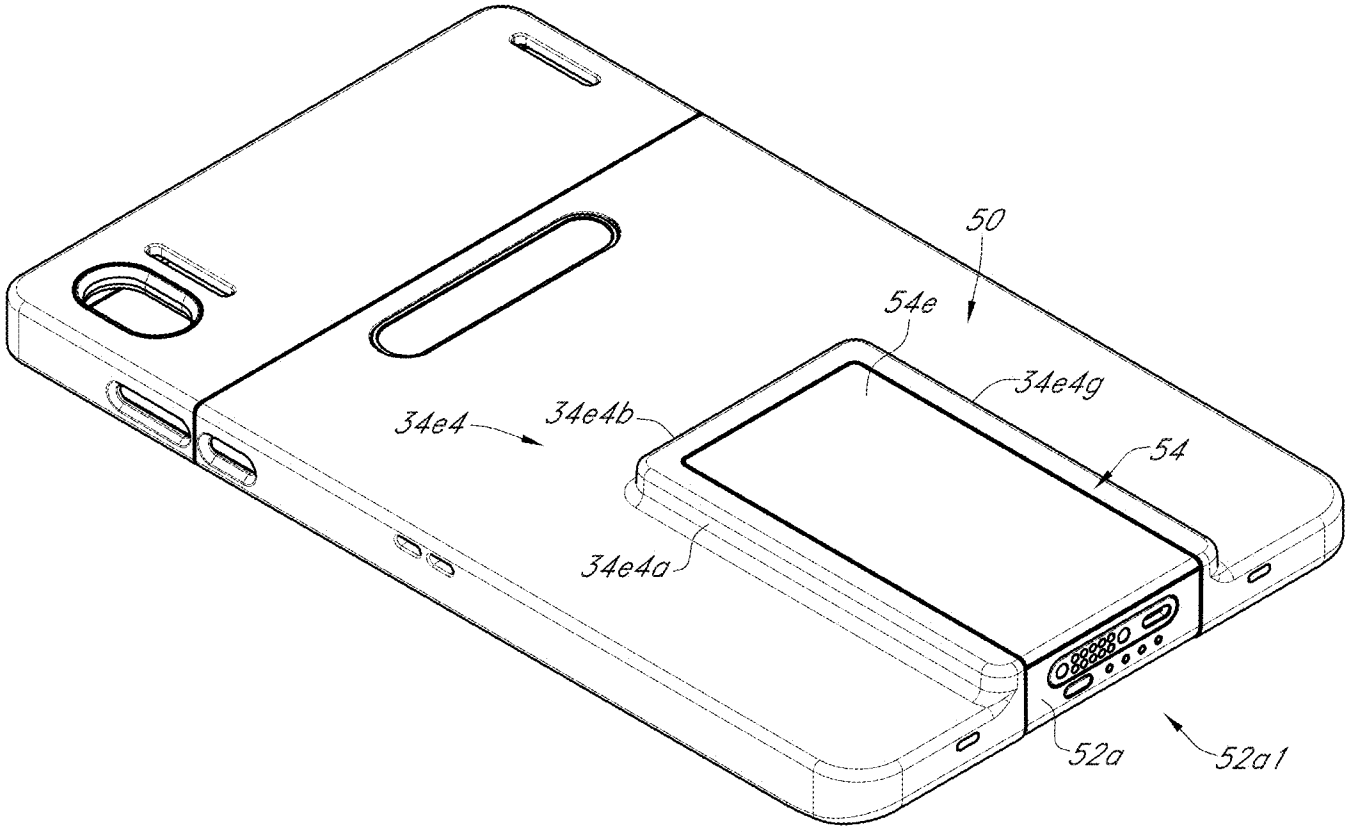
FIG. 83 is a rear-bottom perspective view of the accessory assembly of FIG. 72 coupled with the case assembly of FIG. 24.

Turning to FIG. 83, depicted therein is a rear-bottom perspective view of accessory assembly 50 coupled with device case assembly 30.

Figure 84:
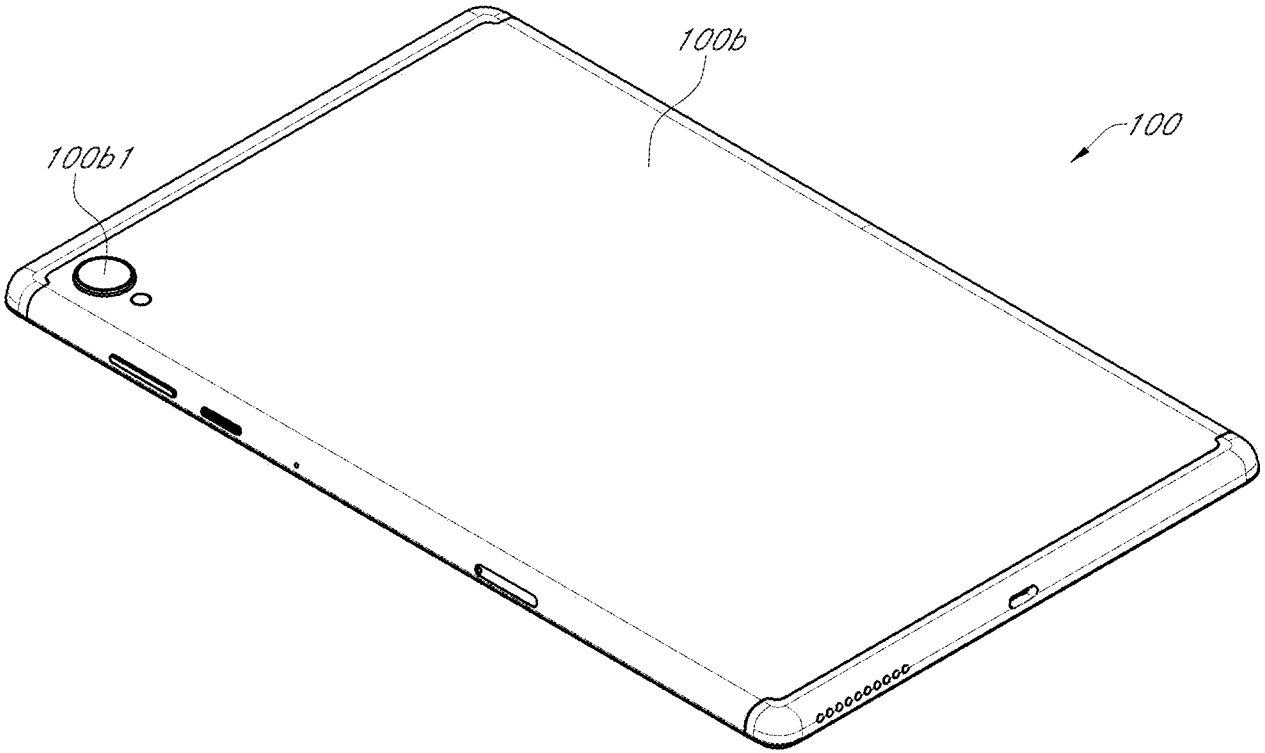
FIG. 84 is a bottom perspective view of the electronic device of FIG. 30.

Turning to FIG. 84, depicted therein is a bottom perspective view of portable electronic device 100. Depicted implementation of portable electronic device 100 is shown to include camera 100*b*1.

Figure 85:
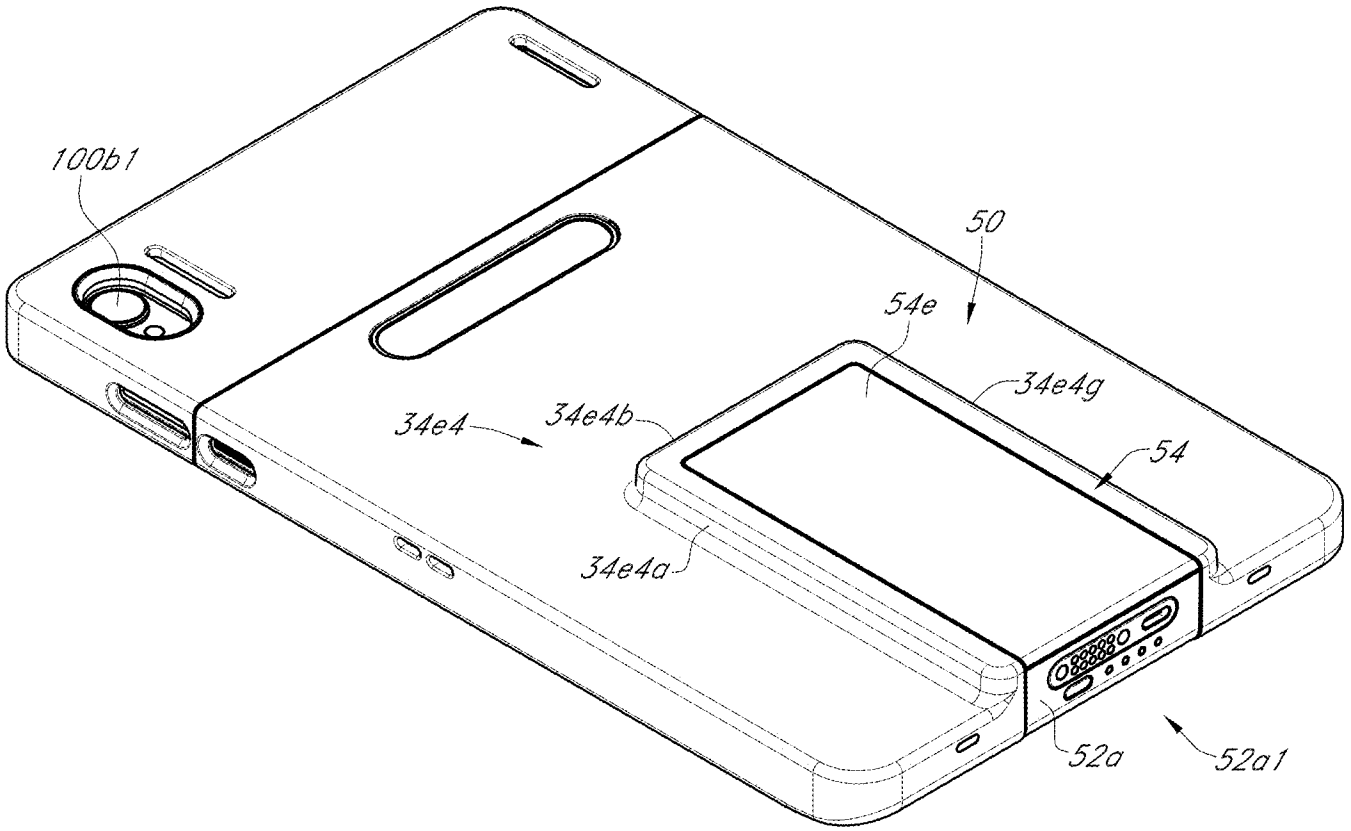
FIG. 85 is a rear-bottom perspective view of the accessory assembly of FIG. 72 coupled with the case assembly of FIG. 24 which is coupled with the electronic device of FIG. 30.

Turning to FIG. 85, depicted therein is a rear-bottom perspective view of accessory assembly 50 coupled with device case assembly 30 which is coupled with portable electronic device 100.

Figure 86:
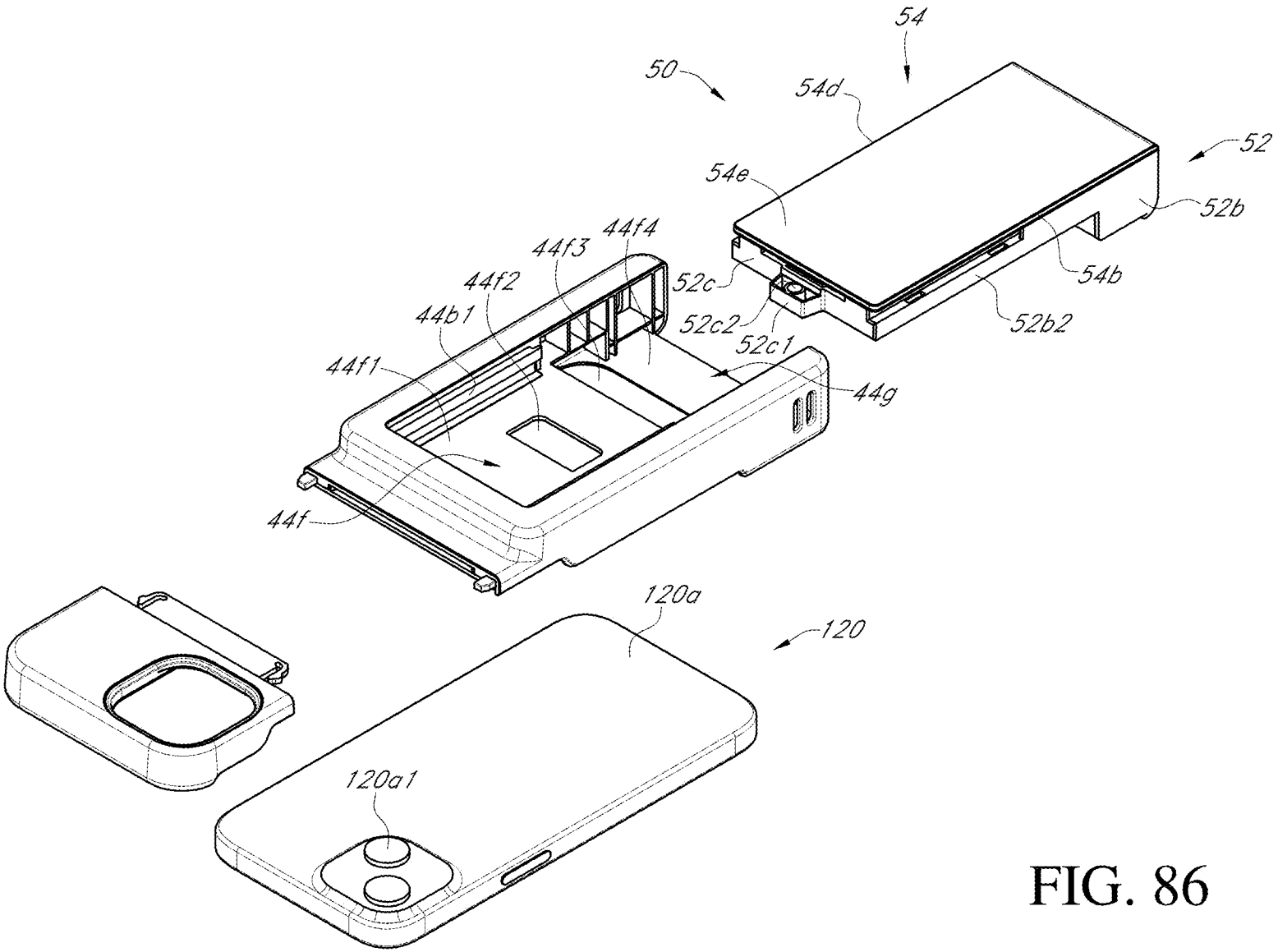
FIG. 86 is an exploded front-bottom perspective view of the case assembly of FIG. 58, the accessory assembly of FIG. 72, and an electronic device.

Turning to FIG. 86, depicted therein is an exploded front-bottom perspective view of case assembly 40, accessory assembly 50, and electronic device 120. Depicted implementation of main assembly 44 is shown to include elongated protrusion 44*b*1, and interior area 44*f* with raised base portion 44*f*1, aperture 44*f*2, aperture 44*f*3, and recessed base portion 44*f*4. Depicted implementation of electronic device 120 is shown to include back 120*a* with camera 120*al*.

Figure 87:
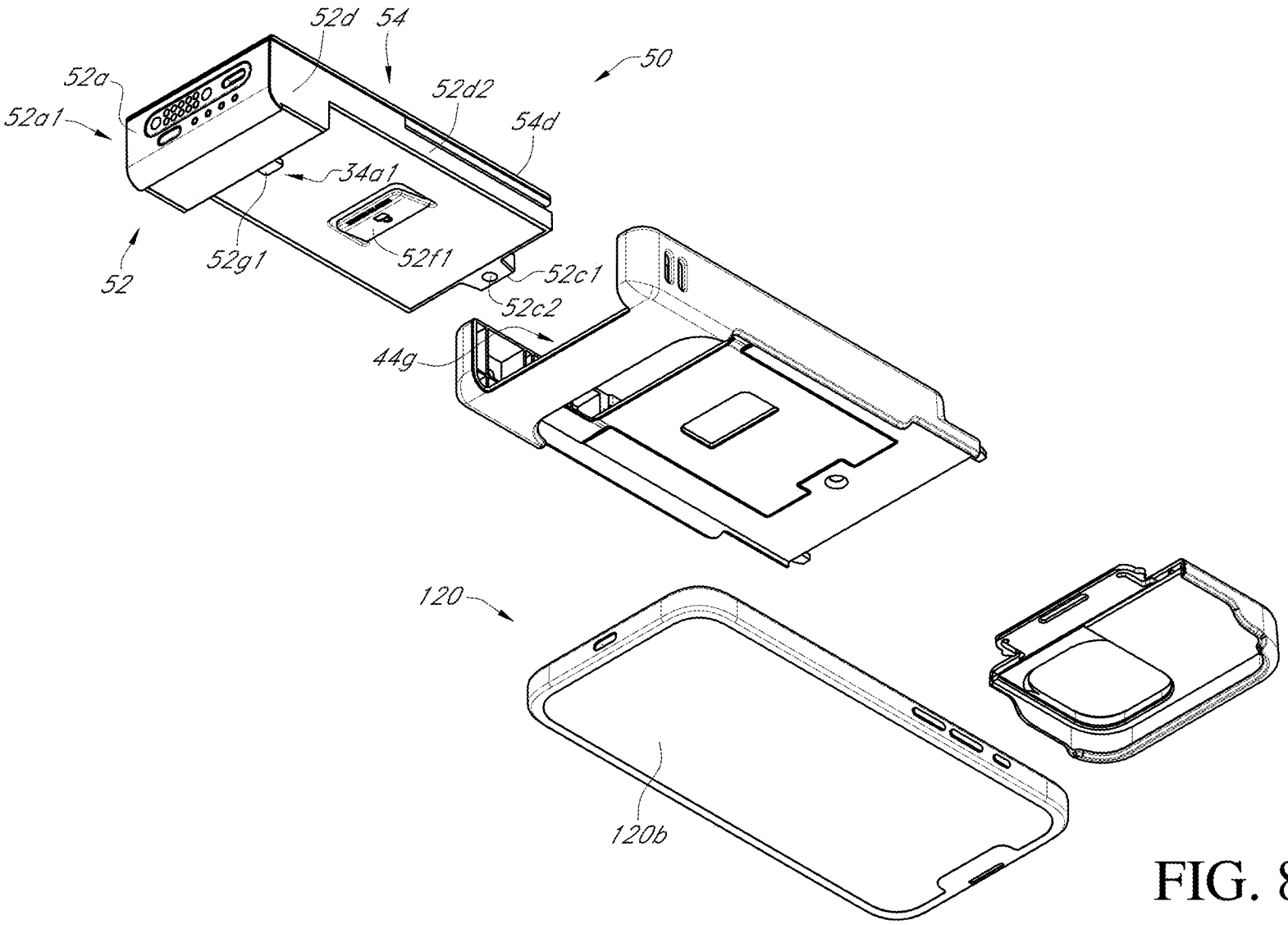
FIG. 87 is an exploded rear-top perspective view of the case assembly of FIG. 58, the accessory assembly of FIG. 72, and an electronic device.

Turning to FIG. 87, depicted therein is an exploded rear-top perspective view of case assembly 40, accessory assembly 50, and electronic device 120. Depicted implementation of electronic device 120 is shown to include front 120*b*.

Figure 88:
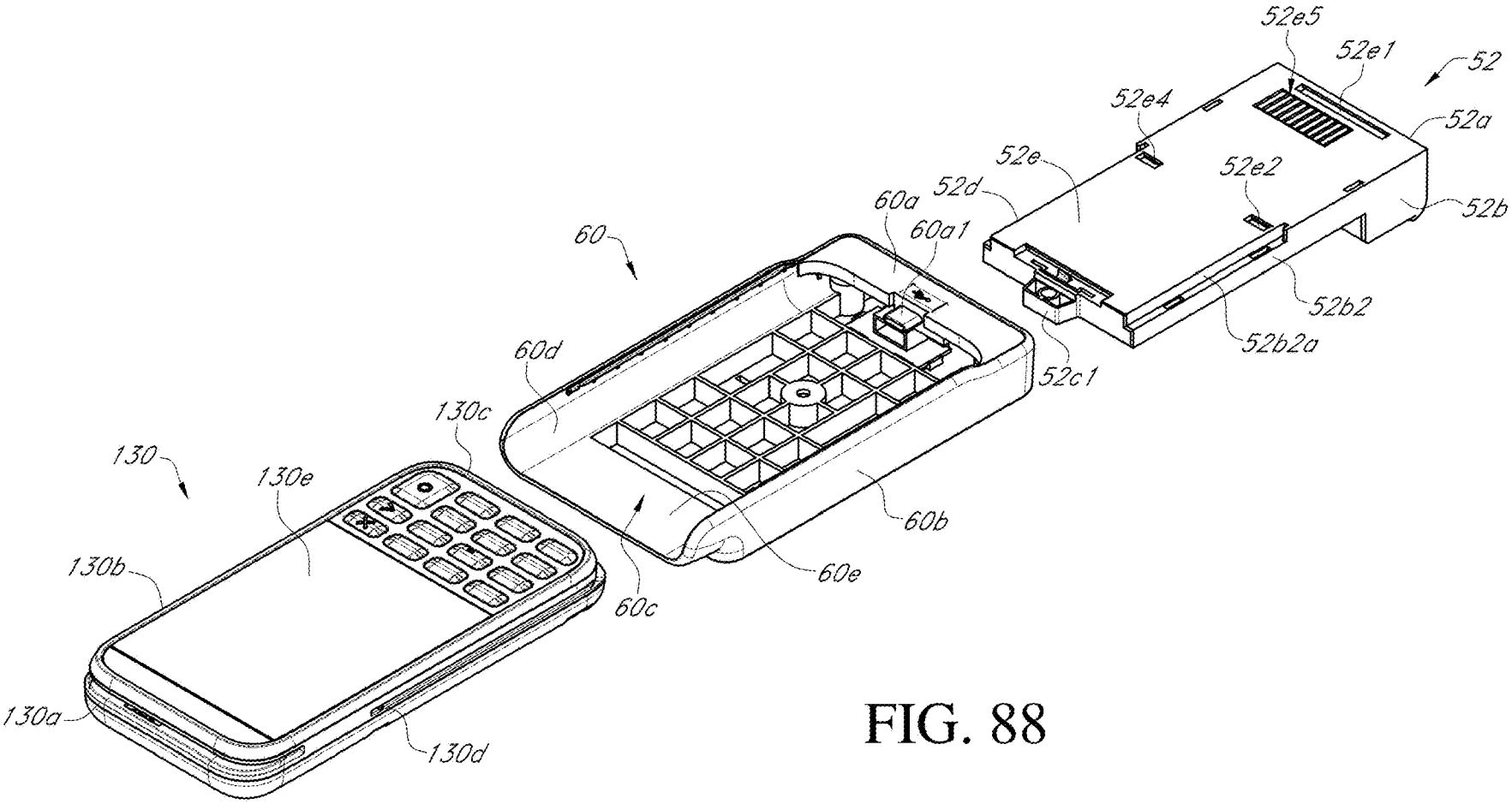
FIG. 88 is an exploded front-bottom perspective view of a portion of the accessory assembly of FIG. 72, an interface assembly, and a keypad assembly.

Turning to FIG. 88, depicted therein is an exploded front-bottom perspective view of a portion of accessory assembly 50, interface assembly 60, and electronic payment card reader assembly 130. Depicted implementation of interface assembly 60 is shown to include end wall 60*a* with electric plug 60*a*1, side wall 60*b*, interior area 60*c*, side wall 60*d*, and base 60*e*. Depicted implementation of electronic payment card reader assembly 130 is shown to include side 130*a*, side 130*b*, side 130*c*, side 130*d*, and side 130*e*.

Figure 89:
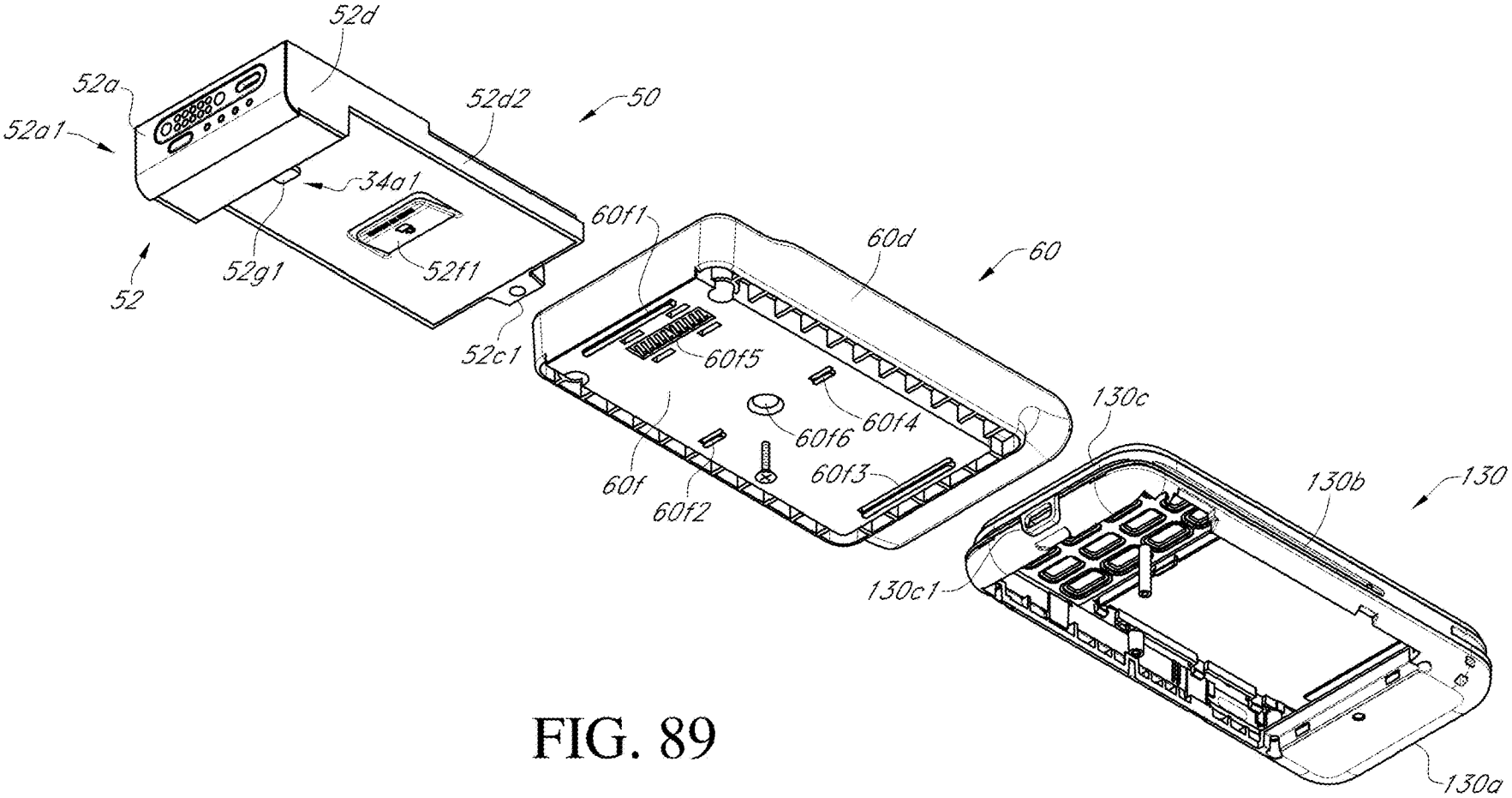
FIG. 89 is an exploded rear-top perspective view of a portion of the accessory assembly of FIG. 72, the interface assembly of FIG. 88, and the keypad assembly of FIG. 88.

Turning to FIG. 89, depicted therein is an exploded rear-top perspective view of a portion of accessory assembly 50, interface assembly 60, and electronic payment card reader assembly 130. Depicted implementation of base 60*f* is shown to include prong 60*f*1, prong 60*f*2, prong 60*f*3, prong 60*f*4, electric contacts interface 60*f*5, and aperture 60*f*6. In implementations electric contacts interface 60*f*5 is sized and positioned to engage with electric contacts interface 52*e*5 when interface assembly 60 is coupled with main assembly 52. Depicted implementation of side 130*c* is shown to include receptacle 130*c*1.

Figure 90:
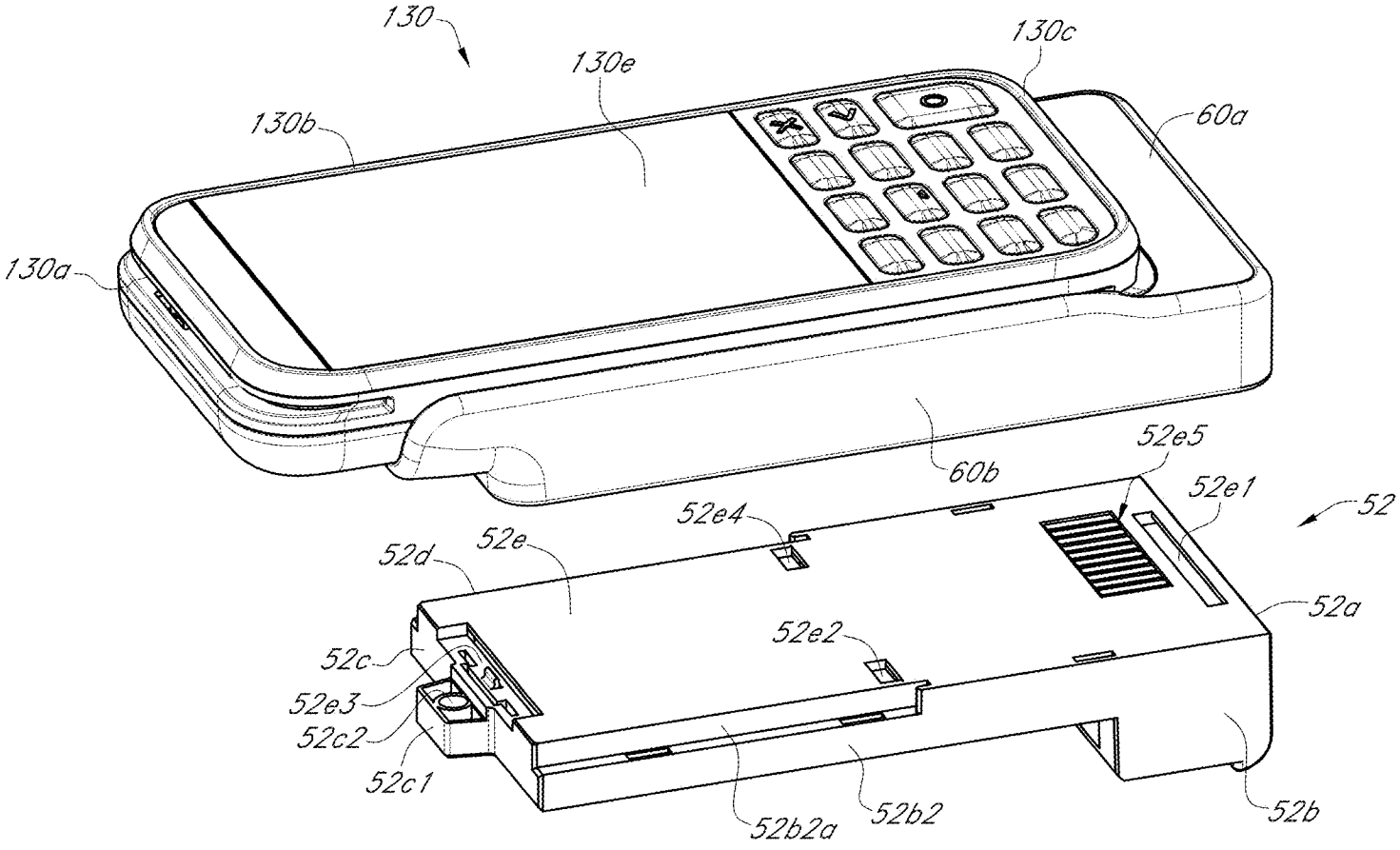
FIG. 90 is a partial exploded front-bottom perspective view of the keypad assembly of FIG. 88 coupled with the interface assembly of FIG. 88, and uncoupled with a portion of the accessory assembly of FIG. 72.

Turning to FIG. 90, depicted therein is a partial exploded front-bottom perspective view of electronic payment card reader assembly 130, coupled with interface assembly 60, and uncoupled with a portion of accessory assembly 50.

Figure 91:
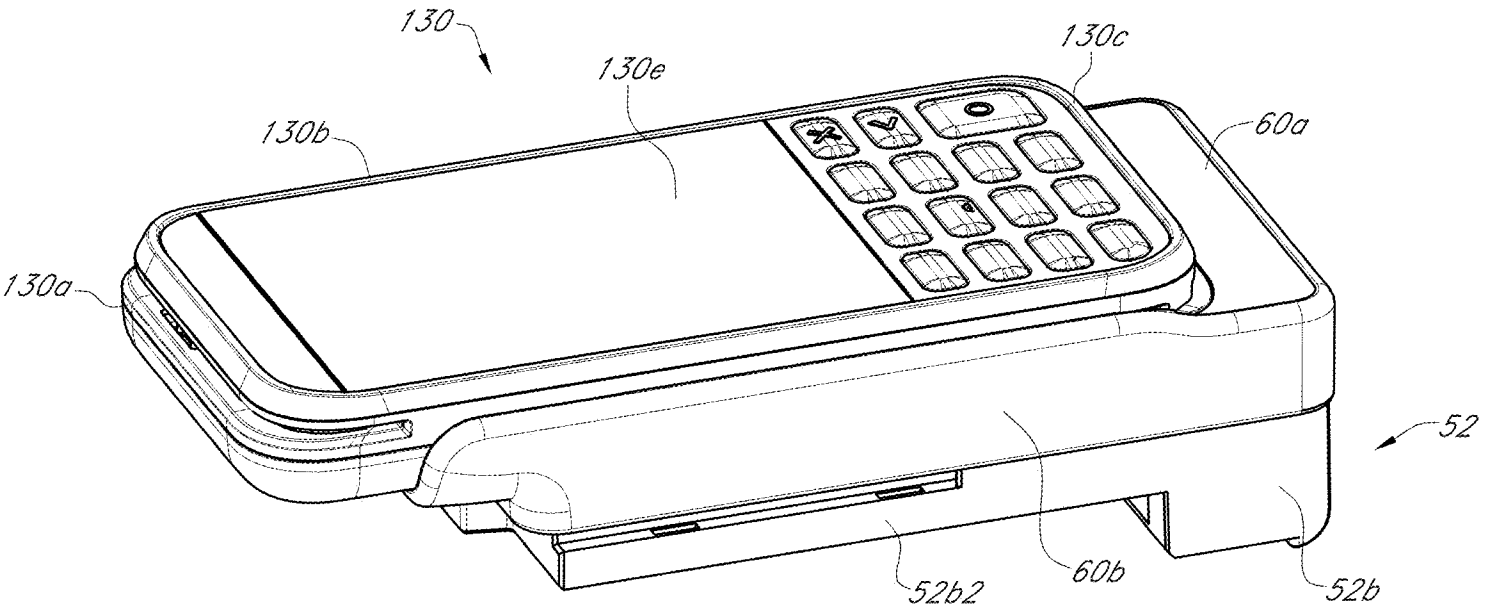
FIG. 91 is a front-bottom perspective view of the keypad assembly of FIG. 88 coupled with the interface assembly of FIG. 88, and coupled with a portion of the accessory assembly of FIG. 72.

Turning to FIG. 91, depicted therein is a front-bottom perspective view of electronic payment card reader assembly 130 coupled with interface assembly 60, and coupled with a portion of accessory assembly 50.

Figure 92:
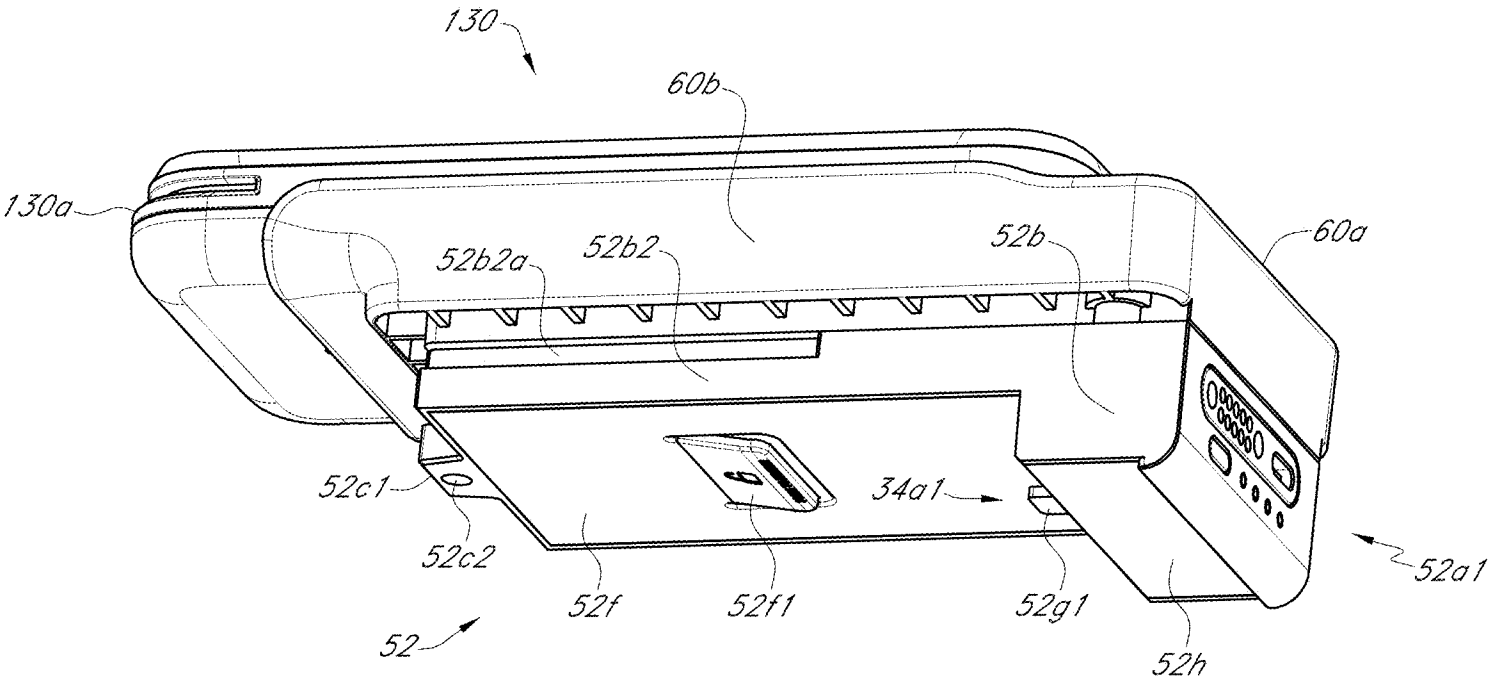
FIG. 92 is a partial exploded rear-top perspective view of the keypad assembly of FIG. 88 coupled with the interface assembly of FIG. 88, and uncoupled with a portion of the accessory assembly of FIG. 72.

Turning to FIG. 92, depicted therein is a partial exploded rear-top perspective view of electronic payment card reader assembly 130, coupled with interface assembly 60, and uncoupled with a portion of accessory assembly 50.

Figure 93:
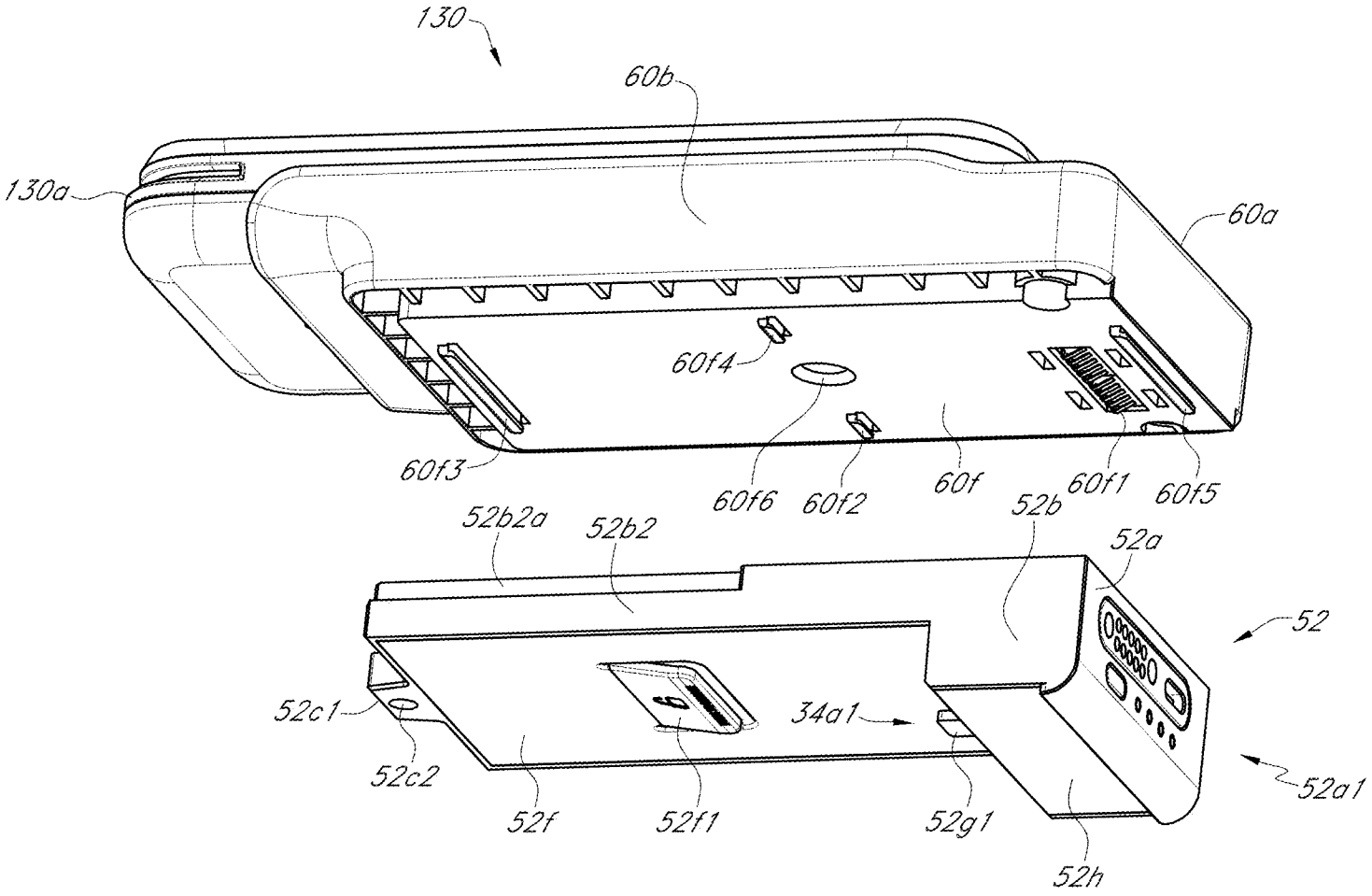
FIG. 93 is a rear-top perspective view of the keypad assembly of FIG. 88 coupled with the interface assembly of FIG. 88, and coupled with a portion of the accessory assembly of FIG. 72.

Turning to FIG. 93, depicted therein is a rear-top perspective view of electronic payment card reader assembly 130 coupled with interface assembly 60, and coupled with a portion of accessory assembly 50.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A system for a portable electronic device and a portable electronic device case, the system comprising:

(I) an accessory assembly including (A) a first side portion including and an exterior surface portion with at least one first notch portion therein, and (B) a second side portion extending perpendicular with the first side portion;

wherein the accessory assembly is removably couplable to the portable electronic device case and is removably couplable to the portable electronic device, wherein the accessory assembly includes at least one electronic function for the portable electronic device, wherein the first side portion of the accessory assembly remains unobstructed when the accessory assembly is coupled with the portable electronic device case, and wherein the first side portion of the accessory assembly remains unobstructed when the accessory assembly is coupled with the portable electronic device.

2. The system of claim 1 wherein the at least one first notch portion is positioned adjacent to an edge of the first side portion shared by the second side portion.

3. The system of claim 2 wherein the accessory assembly includes a third side portion extending perpendicularly to the first side portion and the second side portion, wherein the accessory assembly includes at least one second notch portion, and wherein the at least one second notch portion is positioned adjacent to an edge of the first side portion shared by the third side portion.

4. The system of claim 3 wherein the accessory assembly includes a fourth side portion extending perpendicularly to the first side portion and the third side portion, wherein the accessory assembly includes at least one third notch portion, and wherein the at least one third notch portion is positioned adjacent to an edge of the first side portion shared by the fourth side portion.

5. The system of claim 1 further including a cover assembly, wherein the cover assembly is removably couplable with the first side portion of the accessory assembly.

6. The system of claim 5 wherein the cover assembly includes at least one protrusion removably couplable with the at least one first notch portion the accessory assembly.

7. The system of claim 1 further including an adapter assembly, wherein the adapter assembly is removably couplable with the first side portion of the accessory assembly, and wherein the adapter assembly is removably couplable with at least one third assembly.

8. The system of claim 7 wherein the adapter assembly includes at least one protrusion removably couplable with the at least one first notch portion of the accessory assembly.

9. The system of claim 7 wherein the at least one third assembly is at least one electronic payment card reader.

10. A system for a portable electronic device and a portable electronic device case, the system comprising:

(I) an accessory assembly including (A) a first side portion including an exterior surface portion; and (II) a second assembly including (A) at least one exterior surface portion removably couplable with the exterior surface portion of the accessory assembly, wherein the accessory assembly is removably couplable to the portable electronic device case and is removably couplable to the portable electronic device, wherein the accessory assembly includes at least one electronic function for the portable electronic device, wherein the first side portion of the accessory assembly remains unobstructed when the accessory assembly is coupled with the portable electronic device case, and wherein the first side portion of the accessory assembly remains unobstructed when the accessory assembly is coupled with the portable electronic device.

11. The system of claim 10 wherein the exterior surface portion of the first side portion of the accessory assembly includes at least one first notch portion therein, wherein the accessory assembly includes a second side portion extending perpendicularly to the first side portion, and wherein the at least one first notch portion is positioned adjacent to an edge of the first side portion shared by the second side portion.

12. The system of claim 11 wherein the second assembly includes at least one first protrusion removably couplable with the at least one first notch portion of the accessory assembly.

13. The system of claim 10 wherein the second assembly is a cover assembly.

14. The system of claim 10 wherein the second assembly is an adapter assembly removably couplable with at least one electronic payment card reader assembly.

15. A system for a portable electronic device, the system comprising:

(I) an accessory assembly including (A) a first side portion including and an exterior surface portion with at least one notch portion therein, and (B) a second side portion extending perpendicular with the first side portion; and (II) a portable electronic device case assembly including (A) a coupler assembly;

wherein the accessory assembly includes at least one electronic function for the portable electronic device, wherein the accessory assembly is removably couplable with the coupler assembly of the portable electronic device case, and wherein the first side portion of the accessory assembly remains unobstructed when the accessory assembly is coupled with the portable electronic device case.

16. The system of claim 15 further including a third assembly removably couplable with the accessory assembly.

17. The system of claim 16 wherein the third assembly is removably couplable with the at least one notch portion of the accessory assembly.

18. The system of claim 16 wherein the third assembly is a cover assembly.

19. The system of claim 16 wherein the third assembly is an adapter assembly removably couplable with a fourth assembly.

20. The system of claim 19 wherein the fourth assembly is at least one electronic payment card reader assembly.

* * * * *